US005132201A

United States Patent [19]

Yagihara et al.

[11] Patent Number: 5,132,201

[45] Date of Patent: * Jul. 21, 1992

[54] SILVER HALIDE PHOTOGRAPHIC MATERIAL WITH REDOX RELEASER

[75] Inventors: Morio Yagihara; Hisashi Okada, both of Kanagawa, Japan

[73] Assignee: Fuji Photo Film Co., Ltd., Kanagawa, Japan

[ * ] Notice: The portion of the term of this patent subsequent to Apr. 9, 2008 has been disclaimed.

[21] Appl. No.: 789,810

[22] Filed: Nov. 12, 1991

Related U.S. Application Data

[63] Continuation of Ser. No. 424,621, Oct. 20, 1989, abandoned.

[51] Int. Cl.[5] ..... G03C 5/54; G03C 1/34; G03C 1/06; G03C 1/42

[52] U.S. Cl. ..... 430/264; 430/223; 430/502; 430/505; 430/559; 430/564; 430/566; 430/594; 430/598; 430/955; 430/957; 430/959

[58] Field of Search ..... 430/223, 955, 957, 959, 430/264, 502, 505, 564, 566, 559, 598, 594

[56] References Cited

U.S. PATENT DOCUMENTS

| | | | |
|---|---|---|---|
| 2,857,274 | 10/1958 | Land et al. | 430/251 |
| 3,379,529 | 4/1968 | Porter et al. | 96/36 |
| 3,443,939 | 5/1969 | Bloom et al. | 96/3 |
| 3,620,746 | 11/1971 | Barr | 96/3 |
| 3,725,062 | 4/1973 | Anderson et al. | 96/3 |
| 3,844,785 | 10/1975 | Puschel et al. | 96/29 D |
| 3,928,312 | 12/1975 | Fleckenstein | 260/156 |
| 3,930,863 | 1/1976 | Shiba et al. | 96/74 |
| 4,053,312 | 10/1977 | Fleckenstein | 96/3 |
| 4,055,428 | 10/1977 | Koyama et al. | 96/73 |
| 4,108,663 | 8/1978 | Tanaka et al. | 96/74 |
| 4,135,929 | 1/1979 | Fernandez et al. | 96/29 |
| 4,332,878 | 6/1982 | Akimura et al. | 430/264 |
| 4,336,322 | 6/1982 | Fujita et al. | 430/242 |
| 4,377,634 | 3/1983 | Mifune et al. | 430/440 |
| 4,517,286 | 5/1985 | Noguchi et al. | 430/223 |
| 4,684,604 | 8/1987 | Harder | 430/375 |
| 4,740,453 | 4/1988 | Nakamura et al. | 430/223 |
| 4,770,990 | 9/1988 | Nakamura et al. | 430/223 |
| 5,002,862 | 3/1991 | Yagihara et al. | 430/959 |
| 5,006,444 | 4/1991 | Okada et al. | 430/264 |

FOREIGN PATENT DOCUMENTS

| | | |
|---|---|---|
| 0045129 | 3/1982 | European Pat. Off. . |
| 49-129536 | 12/1974 | Japan . |
| 52-057828 | 5/1977 | Japan . |
| 61-213847 | 9/1986 | Japan . |
| 62-245263 | 10/1987 | Japan . |
| 62-260153 | 11/1987 | Japan . |
| 1417712 | 12/1975 | United Kingdom . |
| 1423849 | 2/1976 | United Kingdom . |
| 2054880 | 2/1981 | United Kingdom . |
| 2059091 | 4/1981 | United Kingdom . |
| 2059092 | 4/1981 | United Kingdom . |

OTHER PUBLICATIONS

*Research Disclosure* No. 12822, Dec. 1974, p. 18.

*Primary Examiner*—Richard L. Schilling
*Attorney, Agent, or Firm*—Sughrue, Mion, Zinn, Macpeak & Seas

[57] ABSTRACT

A silver halide photographic material composed of a support having thereon at least one light-sensitive silver halide emulsion layer, at least one layer of the material containing a compound represented by formula (I):

$$\mathrm{PUG}\text{-}(\mathrm{Time})_t\text{-}\mathrm{V}\text{-}\overset{\overset{\displaystyle R}{|}}{\mathrm{N}}\text{-}\mathrm{O}\text{-}\mathrm{X} \qquad \text{(I)}$$

wherein X represents hydrogen or a group capable of providing hydrogen upon hydrolysis; Time represents a divalent linking group; t is 0 or 1; PUG represents a photographically useful group; V represents a carbonyl group, a sulfonyl group, a sulfoxy group, an iminomethylene group, $$-\underset{\underset{\displaystyle W}{|}}{\mathrm{CH}}-\mathrm{CH_2}-,$$

wherein W represents an electrophilic group, or V represents $$-\overset{\overset{\displaystyle O}{\|}}{\underset{\underset{\displaystyle R_0}{|}}{\mathrm{P}}}-,$$

wherein $R_0$ represents an alkoxy group or an aryloxy group; and R represents hydrogen, an aliphatic group, an aromatic group or $$\mathrm{PUG}\text{-}(\mathrm{Time})_t\text{-}\underset{\underset{\displaystyle W}{|}}{\mathrm{CH}}-\mathrm{CH_2}-,$$

wherein PUG, Time, t, and W are as defined above. The redox compound is capable of releasing a photographically useful reagent using any conventional developing agent, has excellent storage stability, and provides rapid release of the photographically useful reagent.

23 Claims, No Drawings

SILVER HALIDE PHOTOGRAPHIC MATERIAL WITH REDOX RELEASER

This is a Continuation of application Ser. No. 07/424,621 filed Oct. 20, 1989, now abandoned.

FIELD OF THE INVENTION

The present invention relates to a silver halide photographic material. More particularly, the present invention relates to a silver halide photographic material containing a compound which imagewise releases a photographically useful group during development.

BACKGROUND OF THE INVENTION

It has been known that the properties of photographic images can be remarkably improved by releasing a photographically useful reagent imagewise while silver images are formed.

One example of such an approach is the use of a DIR coupler in color photographic light-sensitive materials. A DIR coupler undergoes a coupling reaction with an oxidation product of a color developing agent upon development to release a development inhibitor, improving the graininess of color images, the sharpness by an edge effect and the color reproducibility by the dispersion of the development inhibitor into other layers. The details of such a DIR coupler are described in U.S. Pat. Nos.3,227,554 and 4,248,962, JP-B-58-9942 and JP-B-51-16141 (The term "JP-B" as used herein means an "examined Japanese patent publication"), and JP-A-52-90932, JP-A-56-114946, JP-A-57-154234, JP-A-58-188035, JP-A-57-151944 and JP-A-58-217932 (British Patent 396873) (The term "JP-A" as used herein means an "unexamined published Japanese patent application").

In recent years, it has been known that the use of a coupler which undergoes coupling reaction with an oxidation product of a color developing agent to release a competing compound, development inhibitor or fogging agent improves the graininess of color images or the sensitivity as described in British Patent 1,546,837, U.S. Pat. No. 3,408,194, and JP-A-57-138636, JP-A-57-150845 (U.S. Pat. No. 4,390,618), JP-A-59-50439, and JP-A-59-170840 (U.S. Pat. No. 4,628,024).

A colored coupler having an azo dye portion as an eliminatable group undergoes a coupling reaction with an oxidation product of a color developing agent to imagewise release an azo dye which then flows out into the processing solution. As a result, the colored coupler having an azo dye portion is left counterimagewise to give a masking effect for the improvement in color reproducibility. This is further described in JP-A-51-26034 and JP-A-51-110328, U.S. Pat. No. 4,049,929, and British Patents 1,443,875, and 1,464,361.

Thus, these functional couplers release a photographically useful reagent contribute to improvement in the image quality of color images and sensitivity. However, these functional couplers release a photographically useful reagent only by a coupling reaction with an oxidation product of a color developing agent. Therefore, these functional couplers have the fundamental disadvantage that they cannot be used in the field of light-sensitive materials which do not use a color developing agent, i.e., black-and-white photographic light-sensitive materials or diffusion transfer photographic materials. These functional couplers have another disadvantage that they produce an azomethine dye which has a bad effect on color reproducibility. DIR couplers as described in JP-A-49-77635 and JP-A-50-20725 or dye-discharging type couplers as described in JP-A-59-168444 have been proposed to eliminate such a disadvantage. However, these couplers remain insufficient. For example, these couplers have a low coupling activity or cause a remarkable contamination in the processing solution.

Extensive studies have been made to develop a redox compound which eliminates the disadvantages of these functional couplers and releases a photographically useful reagent regardless of the type of the developing agent used. However, it must such that redox compounds so far developed require further improvement.

For example, known redox compounds include DIR hydroquinones as described in JP-A-49-129536 (U.S. Pat. No. 3,930,863), and U.S. Pat. Nos. 3,379,529, 3,620,746, 4,332,878, and 4,377,634; DIR aminophenols as described in JP-A-52-57828 (U.S. Pat. No. 4,108,663); p-nitrobenzyl derivatives as described in EP 45,129; hydrazine derivatives as described in U.S. Pat. No. 4,684,604, and redox compounds having at least one carbonyl group as described in JP-A-61-213847. However, many of these compounds cannot release a photographically useful reagent from the oxidation product as fast as practically required. Even compounds which can release a photographically useful reagent as fast as required exhibit a poor storage stability. Thus, it has been difficult to develop a redox compound with both rapid function and excellent storage stability.

SUMMARY OF THE INVENTION

It is therefore an object of the present invention to provide a redox compound capable of releasing a photographically useful reagent regardless of the type of developing agent used.

It is another object of the present invention to provide a redox compound excellent in storage stability which can rapidly release a photographically useful reagent from its oxidation product.

It is a further object of the present invention to provide a silver halide photographic material having improved image quality.

It is still a further object of the present invention to provide a high sensitivity silver halide photographic material.

These and other objects of the present invention will become more apparent from the following detailed description and examples.

It has now been found that these and other objects of the present invention are accomplished with a silver halide photographic material comprising at least one light-sensitive silver halide emulsion layer, characterized in that there is contained at least one photographic reagent represented by the general formula (I):

$$\mathrm{PUG}\text{-}(\text{Time})_t\text{-}\mathrm{V}\text{-}\overset{\overset{\displaystyle R}{|}}{\mathrm{N}}\text{-}\mathrm{O}\text{-}\mathrm{X} \qquad \text{(I)}$$

wherein X represents a hydrogen atom or a group capable of producing a hydrogen atom upon hydrolysis; Time represents a divalent connecting group; t represents an integer 0 or 1; PUG represents a photographically useful group; V represents a carbonyl group, a sulfonyl group, a sulfoxy group, an iminomethylene group, a thiocarbonyl group,

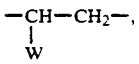

wherein W represents an electrophilic group, or V represents

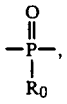

wherein $R_0$ represents an alkoxy group or aryloxy group; and R represents a hydrogen atom, an aliphatic group, an aromatic group or

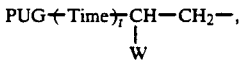

wherein PUG, Time, t and W are as defined above.

DETAILED DESCRIPTION OF THE INVENTION

The present invention is now described in greater detail.

Specific examples of the group represented by X capable of producing a hydrogen atom upon hydrolysis include groups which are known as blocking groups for a photographic reagent.

Specific examples of such known blocking groups include blocking groups such as acyl group and sulfonyl group as described in JP-B-48-9968 and JP-B-47-44805 (U.S. Pat. No. 3,615,617), JP-A-52-8828 and JP-A-57-82834, and U.S. Pat. No. 3,311,476, for example,

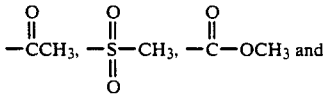

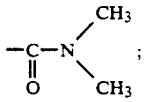

blocking groups which undergo a reverse Michael reaction to release a photographically useful reagent as described in JP-B-55-17369 (U.S. Pat. No. 3,888,677), JP-B-55-9696 (U.S. Pat. No. 3,791,830), and JP-B-55-34927 (U.S. Pat. No. 4,009,029), JP-A-59-105640, for example,

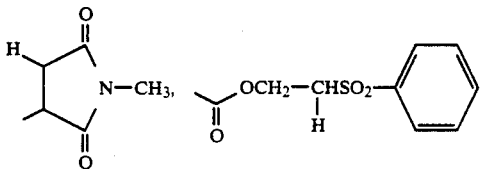

and

-continued

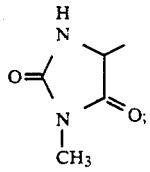

blocking groups which undergo an intramolecular electron transfer to release a photographically useful reagent while producing quinonemethide or quinonemethide compounds as described in JP-B-39727, U.S. Pat. Nos. 3,674,478, 3,932,480, and 3,993,661, and JP-A-57-135944, JP-A-57-135945, and JP-A-57-136640, for example,

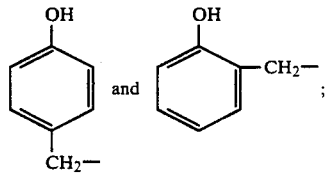

blocking groups utilizing an intramolecular ring closure reaction as described in JP-A-55-55-53330 and JP-A-59-218439, for example,

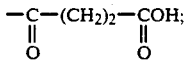

blocking groups utilizing cleavage of a 5- or 6-membered ring as described in JP-A-57-76541 (U.S. Pat. No. 4,335,200), JP-A--135949, JP-A-57-179842, JP-A-59-137945, JP-A-59-140445, JP-A-59-219741 and JP-A-60-41034, for example,

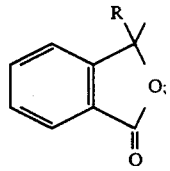

blocking groups which undergo a Michael reaction to release a photographic reagent as described in JP-A-59-201057, JP-A-43739, JP-A-61-95346 and JP-A-61-95347, for example,

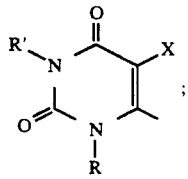

and blocking groups such as imidomethyl group described in JP-A-57-158638, for example,

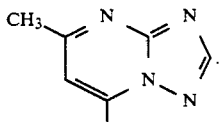

Time represents a divalent connecting group which may have a timing function. The subscript represents an integer 0 or 1. When t is 0, it means that PUG is directly bonded to V.

The divalent connecting group represented by Time is a group which releases PUG through a reaction of one or more stages, after Time-PUG is released from the oxidation product of the redox nucleus.

Examples of the divalent connecting group represented by Time include connecting groups which undergo an intramolecular ring closure reaction of a p-nitrophenoxy derivative to release a photographically useful group (PUG) as described in U.S. Pat. No. 4,248,962 (JP-A-54-145135), connecting groups which undergo an intramolecular ring closure reaction after a ring cleavage to release PUG as described in U.S. Pat. Nos. 4,310,612 (JP-A-55-53330) and 4,358,525, connecting groups which undergo an intramolecular ring closure reaction of a carboxyl group in succinic monoester or analogous compound thereof to release PUG while producing an acid anhydride as described in U.S. Pat. Nos. 4,330,617, 4,446,216 and 4,483,919, and JP-A-59-121328, connecting groups which undergo an electron transfer via a double bond by which an aryloxy group or heterocyclic oxy group is conjugated to release PUG while producing quinomonomethane or analogous compounds thereof as described in U.S. Pat. Nos. 4,409,323, 4,421,845, and 4,416,977 (JP-A-57-135944), and JP-A-58-209736 and JP-A-58-209738; connecting groups which undergo an electron transfer in a portion having a nitrogen-containing heterocyclic enamine structure to release PUG from the Γ-position of enamine as described in U.S. Pat. No. 4,420,554 (JP-A-57-136640), and JP-A-57-135945, JP-A-57-188035, JP-A-58-98728, and JP-A-58-209737; connecting groups which undergo an electron transfer to a carbonyl group conjugated with a nitrogen atom in a nitrogen-containing heterocyclic group to release PUG by an intramolecular ring closure reaction of an oxy group thus formed as described in JP-A-57-56837; connecting groups which release PUG with the formation of an aldehyde as described in U.S. Pat. No. 4,146,396 (JP-A-52-90932), and JP-A-59-93442 and JP-A-59-75475; connecting groups which release PUG with the decarboxylation of an carboxyl group as described in JP-A-51-146828, JP-A-57-179842 and JP-A-59-104641; connecting groups having a —O—COOCRaRb—PUG structure which produce PUG with the formation of an aldehyde following decarboxylation; connecting groups which release PUG with the formation of isocyanate as described in JP-A-60-7429; and connecting groups which undergo coupling reaction with an oxidation product of a color developing agent to release PUG as described in U.S. Pat. No. 4,438,193.

Time may consist of a combination of two or more divalent connecting groups (e.g., connecting groups represented by the general formulae (T-1) to (T-10) shown later).

Preferred examples of the group represented by Time include those represented by the following general formulae (T-1) to (T-10).

The mark (*) indicates the position where the group Time is bonded to V in formula (I), and (*) (*) indicates the position where the group Time is bonded to PUG in formula (I).

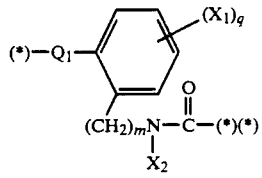

(T-1)

wherein $Q_1$ represents

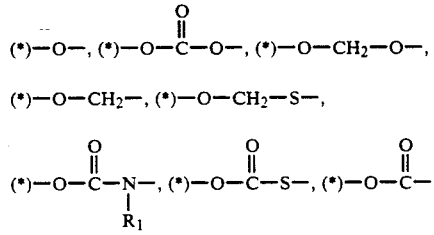

in which $R_1$ represents a hydrogen atom, an aliphatic group, aromatic group or heterocyclic group.

$X_1$ represents a hydrogen atom, an aliphatic group, aromatic group, heterocyclic group, —O—$R_2$, —S$R_2$,

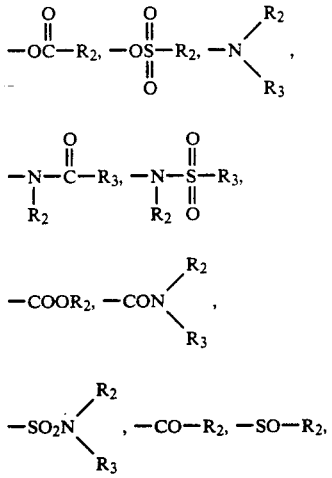

a cyano group, halogen atom (e.g., fluorine, chlorine, iodine) or nitro group.

$R_2$ and $R_3$ may be the same or different and each has the same meaning as $R_1$; $X_2$ has the same meaning as $R_1$; and q in an integer of from 1 to 4. When q is 2 or more, the plurality of substituents represented by $X_1$ may be the same or different or may be connected to each other to form a ring.

The subscript m is an integer of 0, 1 or 2.

Examples of the group represented by formula (T-1) and the preparation method thereof are described in U.S. Pat. No. 4,248,962.

(T-2)

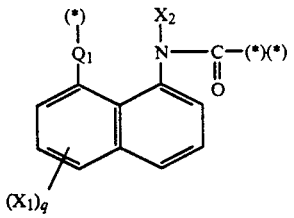

wherein $Q_1$, $X_1$, $X_2$ and q each is as defined in the general formula (T-1). The groups of formula (T-2) can be prepared in the same manner as (T-1).

(T-3)

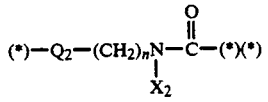

wherein $Q_2$ represents

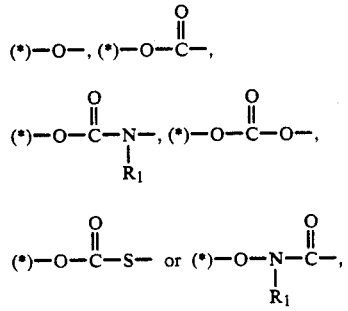

wherein n is an integer of 1 to 4, preferably 1, 2 or 3, and $R_1$ and $X_2$ each is as defined in formula (T-1). The groups of formula (T-3) can be prepared in the same manner as (T-1).

(T-4)

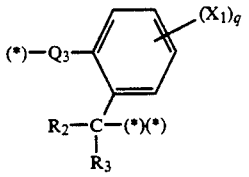

wherein $Q_3$ represents

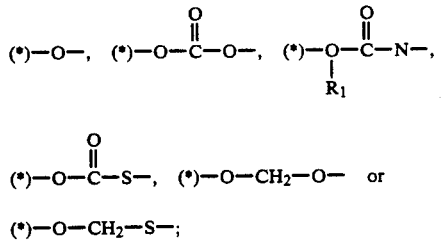

$R_1$, $R_2$, $R_3$, $X_1$ and q each is as defined in the formula (T-1). Examples of the group represented by the general formula (T-4) include timing groups as defined in U.S. Pat. No. 4,409,323, and can be prepared by the preparation method described in U.S. Pat. No. 4,409,323.

(T-5)

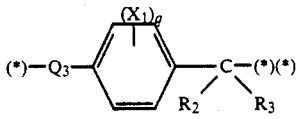

wherein $Q_3$, $R_2$, $R_3$, $X_1$ and q each is as defined in formula (T-4). The groups of formula (T-5) can be prepared in the same manner as (T-4).

(T-6)

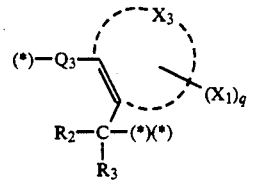

wherein $X_3$ represents an atomic group containing atoms selected from carbon, nitrogen, oxygen and sulfur required to form a 5- to 7-membered heterocyclic group. This heterocyclic group may be condensed with benzene rings or 5- to 7-membered heterocyclic rings. Preferred examples of such heterocyclic groups include pyrrole, pyrazole, imidazole, triazole, furan, oxazole, thiophene, thiazole, pyridine, pyridazine, pyrimidine, pyrazine, azepine, oxepine, indole, benzofuran and quinoline.

$Q_3$, $X_1$, q, $R_2$ and $R_3$ each is as defined in formula (T-4). Examples of the group represented by the general formula (T-6) include timing groups as described in British Patent 2,096,783, and can be prepared by the preparation method described in British Patent 2,096,783, U.S. Pat. Nos. 4,421,845 and 4,416,977.

(T-7)

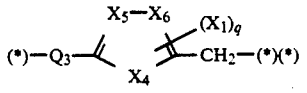

wherein $X_4$ represents an atomic group containing atoms selected from carbon, nitrogen, oxygen and sulfur required to form a 5- to 7- membered heterocyclic group. $X_5$ and $X_6$, which may be the same or different, each represents

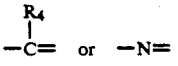

in which $R_4$ represents a hydrogen atom, an aliphatic group or aromatic group. This heterocyclic group may be condensed with benzene rings or 5- to 7-membered heterocyclic groups. Preferred examples of such heterocyclic groups include pyrrole, imidazole, triazole, furan, oxazole, oxadiazole, thiophene, thiazole, thiadiazole, pyridine, pyridazine, pyrimidine, pyrazine, azepine, oxepine, and isoquinoline. $Q_3$, $X_1$ and q each is as defined in the general formula (T-4). The groups of formula (T-7) can be prepared in the same manner as (T-6).

(T-8)

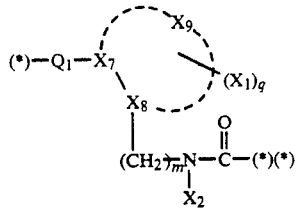

wherein $X_9$ represents an atomic group containing atoms selected from carbon, nitrogen, oxygen and sulfur required to form a 5- to 7- membered heterocyclic group. $X_7$ and $X_8$, which may be the same or different, each represents $$-\overset{|}{C}= \quad \text{or} \quad >N-.$$

This heterocyclic group may be condensed with benzene rings or 5- to 7-membered heterocyclic groups. Preferred examples of such heterocyclic groups include pyrrolidine, piperidine, and benzotriazole in addition to those described for formula (T-6). $Q_1$, $X_1$, $X_2$, m and q each is as defined in the general formula (T-1). The groups of formula (T-8) can be prepared as described in JP-A-54-145,135.

(T-9)

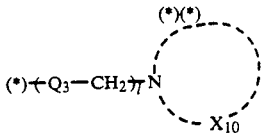

wherein $X_{10}$ has the same meaning as $X_9$ defined in the general formula (T-8); and $Q_3$ is as defined in the general formula (T-4); and l represents 0 or 1.

Preferred examples of such heterocyclic groups include those shown below:

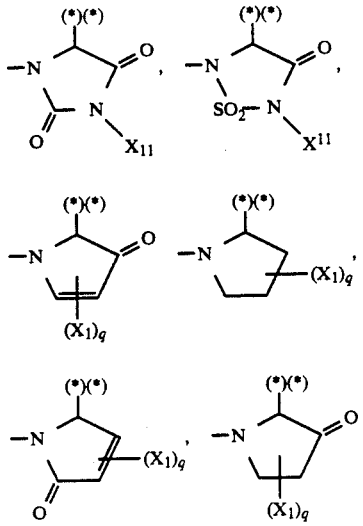

-continued

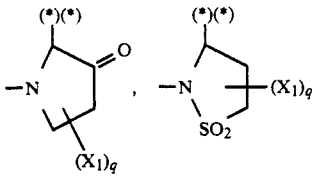

wherein $X_1$ and q each is as defined in formula (T-1); $X_{11}$ represents a hydrogen atom, an aliphatic group, an aromatic group, acyl group, sulfonyl group, alkoxycarbonyl group, sulfamoyl group, heterocyclic group or carbamoyl group. The groups of formula (T-9) can be prepared as described in JP-A-57-135945.

(T-10)

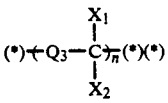

wherein X and $X_2$ are as defined in formula (T-1); $Q_3$ is as defined in formula (T-4); and n is as defined in formula (T-3) and preferably represents 1 or 2. The groups of formula (T-10) can be prepared as described in JP-A-52-90932 (U.S. Pat. No. 4,146,396).

In formulae (T-1) to (T-10), when $X_1$, $X_2$, $R_1$, $R_2$, $R_3$ and $R_4$ contain an aliphatic group, it is preferably a $C_{1-20}$ group, more preferably a $C_{1-10}$ group, which may be saturated or unsaturated, substituted or unsubstituted, cyclic or straight-chain or branched-chain, for example, an alkyl, alkenyl or alkynyl group. When $X_1$, $X_2$, $R_1$, $R_2$, $R_3$and $R_4$ contain an aromatic group, it is a $C_{6-20}$ group, preferably a $C_{6-10}$ group, more preferably a substituted or unsubstituted monocyclic or dicyclic aryl group, e.g., phenyl or naphthyl group. When $X_1$, $X_2$, $R_1$, $R_2$, $R_3$ and $R_4$ contain a heterocyclic group, it is a 3- to 10-membered, preferably 5- or 6-membered, saturated or unsaturated heterocyclic group containing at least one of nitrogen, oxygen and sulfur atom as a hetero atom. The heterocyclic group may be a monocyclic or a condensed ring with a heterocyclic or an aromatic ring. Preferred examples of such heterocyclic groups include a pyridyl group, furyl group, thienyl group, triazolyl group, imidazolyl group, pyrazolyl group, thiadiazolyl group, oxadiazolyl group and pyrolidinyl group.

When Time is represented by formula (T-1), (T-2) or (T-4), $X_1$ is preferably bonded at the ortho or para position relative to the group $Q_1$ or $Q_3$. When Time is represented by formula (T-5), $X_1$ is preferably bonded at the ortho position relative to the group $Q_3$.

The substituents which may be present in $X_1$, $X_2$, $R_1$, $R_2$, $R_3$ and $R_4$ include alkyl, aralkyl, alkenyl, alkynyl, alkoxy, aryl, substituted amino, acylamino, sulfonylamino, ureido, urethane, aryloxy, sulfamoyl, carbamoyl, alkylthio, arylthio, sulfonyl, sulfinyl, hydroxy, halogen, cyano, sulfo, carboxyl, alkyloxycarbonyl, aryloxycarbonyl, acyl, alkoxycarbonyl, acyloxy, carbonamido, sulfonamido, nitro, alkylthio and arylthio groups.

Preferred examples of divalent connecting groups represented by Time include those shown below; but the present invention is not to be construed as being limited thereto.

T-(1)
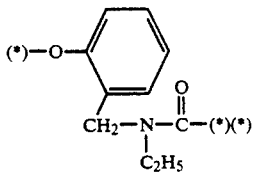
T-(2)
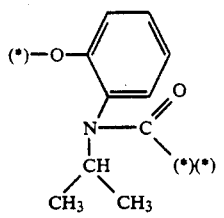
T-(3)
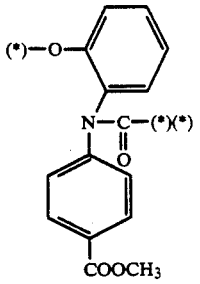
T-(4)
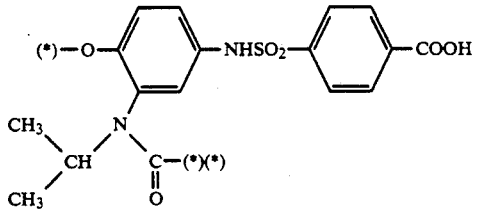
T-(5)
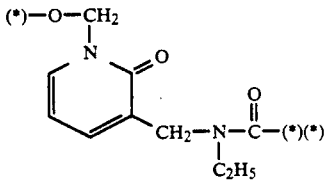
T-(6)
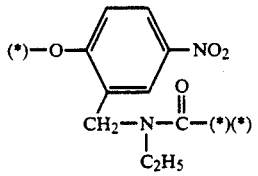
T-(7)
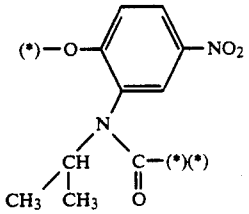
T-(8)
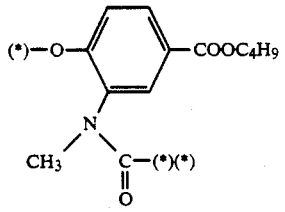
T-(9)
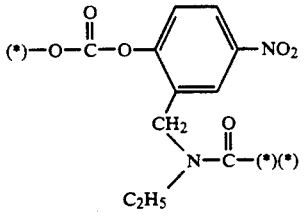
T-(10)
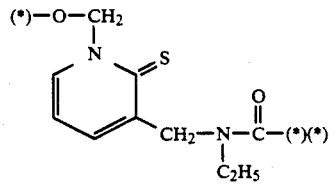
T-(11)
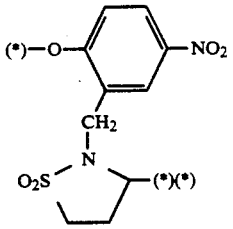
T-(12)
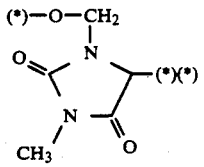
T-(13)
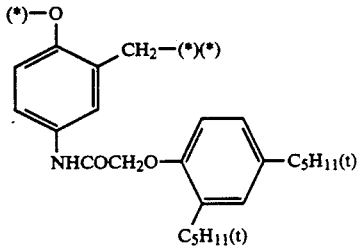
T-(14)
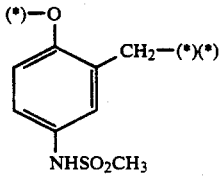

-continued
T-(15)
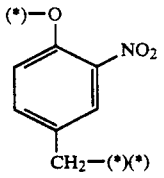
T-(16)
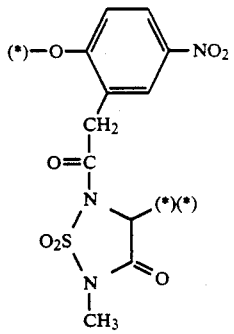
T-(17)
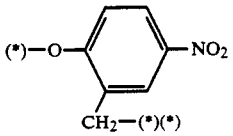
T-(18)
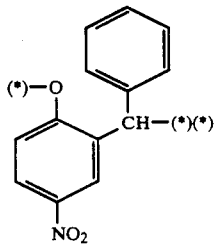
T-(19)
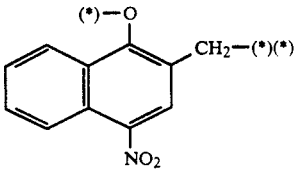
T-(20)
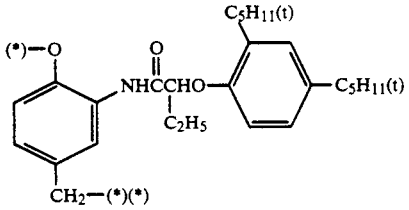
T-(21)
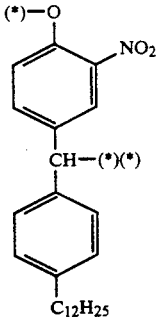
T-(22)
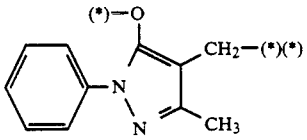
T-(23)
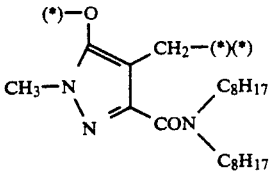
T-(24)
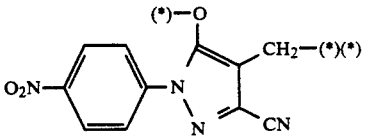
T-(25)
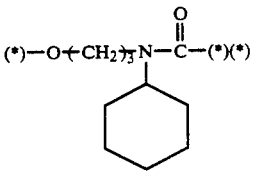
T-(26)
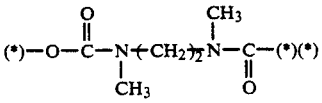

-continued
T-(27)
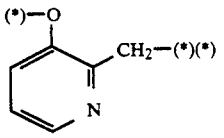
T-(28)
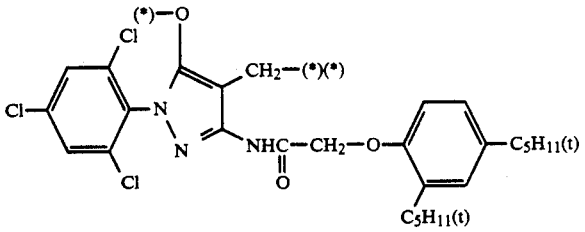
T-(29)
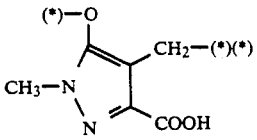
T-(30)
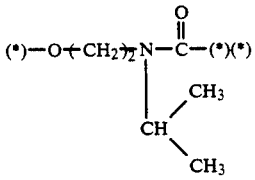
T-(31)
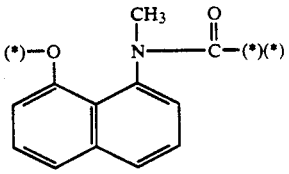
T-(32)
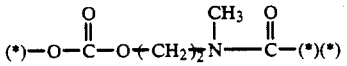
T-(33)
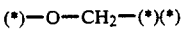
T-(34)
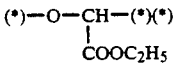
T-(35)
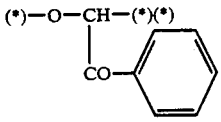
T-(36)
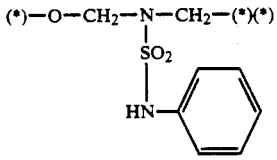
T-(37)
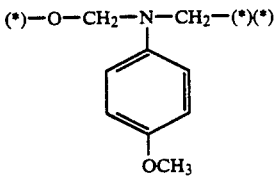
T-(38)
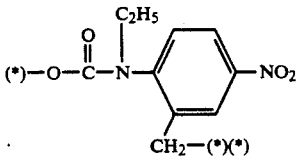
T-(39)
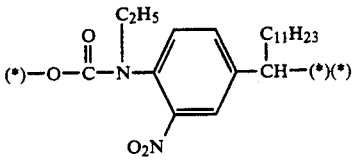
T-(40)
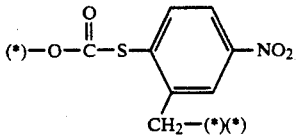

-continued

T-(41)

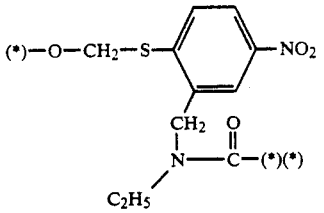

T-(42)

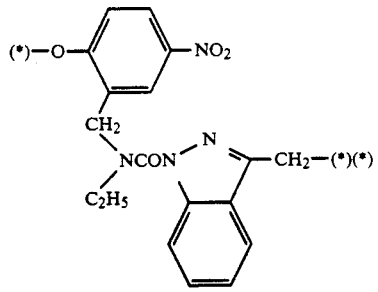

PUG represents a photographically useful group in the form of (Time)$_t$ or PUG, as described in JP-A-62-260153 and U.S. Pat. No. 4,684,604.

Examples of such a photographically useful group include development inhibitors, development accelerators, fogging agents, couplers, coupler-releasing couplers, diffusible or nondiffusible dyes, desilvering accelerators, silver halide solvents, competing compounds, developing agents, auxiliary developing agents, fixing accelerators, fixing inhibitors, image stabilizers, toners, processing dependency improvers, halftone improvers, photographic dyes, surface active agents, film hardeners, ultraviolet absorbers, fluorescent brightening agents, desensitizers, contrast developers, chelating agents, and precursors thereof.

Since many of these photographically useful groups have more than one photographically useful function, typical examples thereof will be described in detail hereafter.

The development inhibitor represented by PUG or (Time—$_t$PUG is a known development inhibitor containing a hetero atom via which a bond is made. Examples of such a known development inhibitor are described in C. E. K. Mees & T. H. James, *The Thoery of Photographic Processes,* (3rd ed., 1966, Macmillan), p 344–346. Specific examples of such a known development inhibitor include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, and mercaptcaryls.

The development inhibitors represented by PUG may be substituted by substituents which may be further substituted.

Examples of such substituents include an alkyl group, aralkyl group, alkenyl group, alkynyl group, alkoxy group, aryl group, substituted amino group, acylamino group, sulfonylamino group, ureido group, urethane group, aryloxy group, sulfamoyl group, carbamoyl group, alkylthio group, arylthio group, sulfonyl group, sulfinyl group, hydroxyl group, halogen atom, cyano group, sulfo group, alkyloxycarbonyl group, aryloxycarbonyl group, acyl group, alkoxycarbonyl group, acyloxy group, carboxyamido group, sulfonamito group, carboxyl group, sulfoxy group, phosphono group, phosphinico group, and amido phosphate.

Preferred among these substituents are a nitro group, sulfo group, carboxyl group, sulfamoyl group, phosphono group, phosphinico group, and sulfonamido group.

Specific examples of development inhibitors are as follows, but the present invention is not to be construed as being limited thereto.

1. Mercaptotetrazole derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-(4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole-hydrochloride
(32) 1-(2-Diethylaminoethyl)-5-mercaptotetrazole
(33) 2-(5-Mercapto-1-tetrazole)ethyltrimethylammonium chloride
(34) 1-(3-Phenoxycarbonylphenyl)-5-mercaptotetrazole
(35) 1-(3-Maleinimidephenyl)-6-mercaptotetrazole 2. Mercaptotriazole derivatives (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine derivatives (1) Thiouracyl
(2) Methylthiouracyl
(3) Ethylthiouracyl
(4) Propylthiouracyl
(5) Nonylthiouracyl
(6) Aminothiouracyl (7) Hydroxythiouracyl 5. Mercaptobenzimidazole derivatives (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Caproamide-2-mercaptobenzimidazole
(11) 5-(2-Ethylhexanoylamino)-2-mercaptobenzamidazole 6. Mercaptothiadiazole derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzothiazole derivatives (1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole 8. Mercaptobenzoxazole derivatives (1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzothiazole 9. Benzotriazole derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chloro-benzotriazole
(10) 4,5,6-Trichlorobenzotriazole
(11) 5-Carboxybenzotriazole
(12) 5-Sulfobenzotriazole sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole 10. Benzimidazole derivatives (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitrol-2-(trifluoromethyl)benzimidazole 11. Indazole derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole derivatives (1) 5-(4-Nitrophenyl)tetrazole
(2) 5-Phenyltetrazole
(3) 5-(3-Carboxyphenyl)-tetrazole 13. Tetrazole derivatives (1) 4-Hydroxy-6-methyl-5-nitro-1,3,3a,7-tetraazaindene
(2) 4-Mercapto-6-methyl-5-nitro-1,3,3a,7-tetraazaindene 14. Mercaptoaryl derivatives (1) 4-Nitrothiophenol
(2) Thiophenol
(3) 2-Carboxythiophenol The present development inhibitor may undergo substitution reaction following a redox reaction in the development process to be released from the redox nucleus in formula [I] and then become a development-inhibiting compound which can be converted into a compound substantially having little or no development inhibiting effect.

The development inhibitor which changes its development inhibiting effect is represented by the following formula [II], as described in JP-A-151,944 (U.S. Pat. No. 4,477,563) and JP-A-58-205150:

—AF—CCD [II]

Preferred examples of the group represented by AF in formula [II] are as follows, with the position of substitution by CCD. The mark (*)(*)(*) indicates the —A-F—CCD position at which the group is bonded to Time.

(P-1)

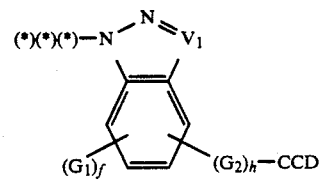

-continued (P-2)

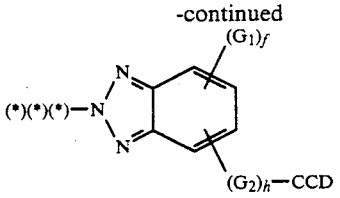

(P-3)

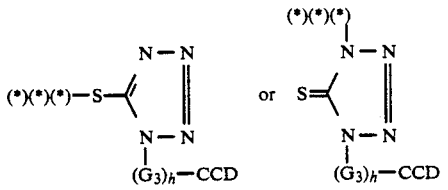

(P-4)

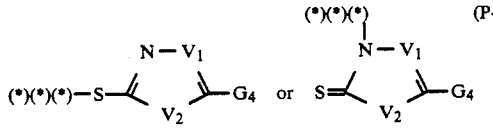

(P-5)

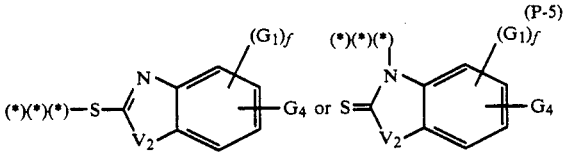

wherein $G_1$ represents a hydrogen atoms, a halogen atom, an alkyl group (e.g., methyl, ethyl), acylamino group (e.g., benzamido, hexanamido), alkoxy group (e.g., methoxy, benzyloxy), sulfonamido group (e.g., methanesulfonamido, benzenesulfonamido), aryl group (e.g., phenyl, 4-chlorophenyl), alkylthio group (e.g., methylthio, butylthio), alkylamino group (e.g., cyclohexylamino), anilino group (e.g., anilino, 4-methoxycarbonylanilino), amino group, alkoxycarbonyl group (e.g., methoxycarbonyl, butoxycarbonyl), acyloxy group (e.g., acetyl, butanoyl, benzoyl), nitro group, cyano group, sulfonyl group (e.g., butanesulfonyl, benzenesulfonyl), aryloxy group (e.g., phenoxy, naphthyloxy), hydroxyl group, thioamido group (e.g., butanethioamido, benzenethiocarbonamido), carbamoyl group (e.g., carbamoyl, N-arylcxarbamoyl), sulfamoyl group (e.g., sulfamoyl, N-arylsulfamoyl), carboxyl group, ureido group (e.g., ureido, N-ethylureide) or aryloxycarbonyl group (e.g., phenoxycarbonyl, 4-methoxycarbonyl).

$G_2$ represents any group which can be a divalent group among the groups represented by $G_1$.

$G_3$ represents a substituted or unsubstituted alkylene group or substituted or unsubstituted arylene group which may contain an ether bond, ester bond, thioether bond, amido bond, ureido bond, imido bond, sulfon bond, sulfonamido bond, or carbonyl group. These bonds and a plurality of alkylene groups and arylene groups may be connected to each other to form a divalent group as a whole.

$V_1$ represents a nitrogen atom or a methine group. $V_2$ represents an oxygen atom, sulfur atom,

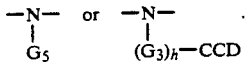

$G_4$ represents any groups represented by, $G_1$ or $(G_3)_h$—CCD.. $G_5$ represents a hydrogen atom, an alkyl group (e.g., methyl, ethyl) or aryl group (e.g., phenyl, naphthyl).

The subscript f is 1 or 2, and h is 0 or 1. When f is 2, the two $G_1$'s may be the same or different. In formulae (P-4) and (P-5), at least one of the groups represented by $V_2$ and $G_4$ is a group containing CCD.

In formulae (P-1), (P-2), (P-3), (P-4) and (P-5), when $G_1$, $G_2$, $G_3$, $G_4$ or $G_5$ contains an alkyl group, the alkyl group may be a $C_{1-22}$, preferably $C_{1-10}$, substituted or unsubstituted straight-chain, branched-chain, or cyclic, saturated or unsaturated group. When G1, G2, G3, G4 or G5 contains an aryl group, the aryl group is a $C_{6-10}$ group, preferably a substituted or unsubstituted phenyl group.

In formula (II), preferred examples of the group represented by CCD include those represented by formulae (D-1) to (D-16).

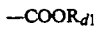

(D-1)

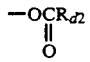

(D-2)

wherein $R_{d1}$ and $R_{d2}$ each represents a substituted or unsubstituted alkyl group (preferably a $C_{1-10}$ alkyl group, e.g., methyl, ethyl, 2,3-dichloropropyl, 2,2,3,3-tetrafluoropropyl, butoxycarbonylmethylcyclohexylaminocarbonylmethyl, methoxyethyl, propargyl), substituted or unsubstituted aryl group (preferably a $C_{6-10}$ aryl group, e.g., phenyl, 3,4-methyleneoxyphenyl, p-methoxyphenyl, p-cyanophenyl, m-nitrophenyl) or a substituted or unsubstituted aralkyl group (preferably a $C_{7-12}$ aralkyl group, e.g., benzyl, p-nitrobenzyl).

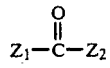

(D-3)

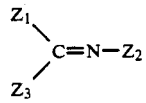

(D-4)

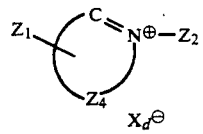

(D-5)

wherein $Z_1$ and $Z_2$ each represents a bond to AF or a hydrogen atom, an alkylamino group (e.g., —$CH_3$—NH—,

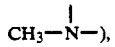

), alkyl group (e.g., methyl, propyl, methoxymethyl, benzyl), aryl group (e.g., phenyl, 4-chlorophenyl, naphthyl, 4-methoxyphenyl, 4-butanamidophenyl), acylamido group which may be substituted at the nitrogen atom (e.g., acetamide, berzamide) or 4- to 7-membered substituted or unsubstituted heterocyclic group containing hetero atoms selected from nitrogen, sulfur and oxygen atoms (e.g., 2-pyridyl, 2-pyrrolidinyl, 4-imidazolyl, 3-chloro-5-pyrazolyl).

$Z_3$ represents a hydrogen atom, a halogen atom, alkyl group (e.g., methyl, propyl), aryl group (e.g., phenyl, 4-chlorophenyl, naphthyl), heterocyclic group (4- to 7-membered substituted or unsubstituted heterocyclic group containing hetero atoms selected from nitrogen, sulfur and oxygen, (e.g., 2-pyridyl, 2-pyrrolidinyl), alkoxy group (e.g., methoxy, butoxy), acyl group (e.g., acetyl, benzoyl), carbamoyl group which may be substituted at the nitrogen atom (e.g., N-butylcarbamoyl, N-phenylcarbamoyl), sulfamoyl group which may be substituted at the nitrogen atom (e.g., N-phenylsulfamoyl), sulfonyl group (e.g., propanesulfonyl, benzenesulfonyl), alkoxycarbonyl group (e.g., ethoxycarbonyl), acylamino group (e.g., acetamido, benzamido), sulfonamido group (e.g., benzenesulfonamido), alkylthio group (e.g., butylthio) or ureido group which may be substituted at the nitrogen atom (e.g., 3-phenylureid, 3-butylureido). $Z_1$ and $Z_3$ may be connected to each other to form a ring.

In formula (D-5), $Z_4$ represents an atomic group necessary for forming a 5- or 6-membered unsaturated heterocyclic group containing atoms selected from carbon, hydrogen, nitrogen, oxygen and sulfur atoms. $X_d\ominus$ represents an organic sulfonic acid anion, organic carboxylic acid anion, halogen ion or inorganic anion (e.g., tetrafluoroborate necessary for change balance). Examples of heterocyclic groups formed by $Z_4$ are as follows, wherein $Z_1$ is bonded in any substitutable position.

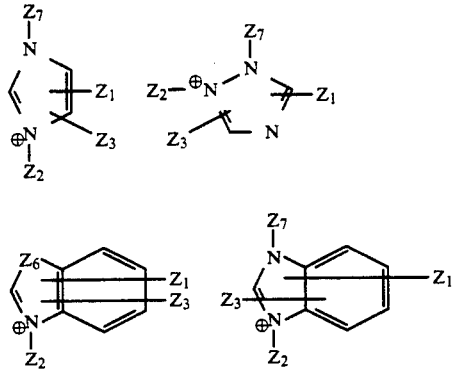

wherein $Z_7$ represents any group represented by $Z_1$ or $Z_2$; and $Z_6$ represents an oxygen atom or sulfur atom;

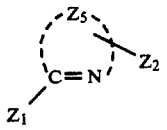

(D-6)

wherein $Z_1$, $Z_2$ and $Z_3$ are as defined in formula (D-4) and $Z_5$ represents an atomic group necessary for forming a 5- to 7-membered ring together with

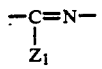

and represents an atomic group which does not provide

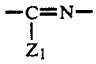

with an aromatic property, and which is selected from carbon, oxygen and nitrogen atoms, preferably alkylene group which may be substituted (e.g., $-(CH_2)_4-$), an alkenylene group which may be substituted (e.g., $-CH_2-CH=CH-CH_2-$,

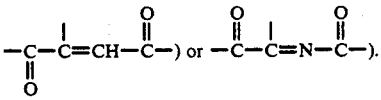

In the general formulae (D-3), (D-4), (D-5) and (D-6), when $Z_1$, $Z_2$, $Z_3$ or $Z_7$ contains an alkyl group portion, the alkyl group may be a $C_{1-16}$, preferably $C_{1-10}$, substituted or unsubstituted, straight-chain or branched, chainlike or cyclic, or saturated or unsaturated alkyl group. When $Z_1$, $Z_2$, $Z_3$ or $Z_7$ contains an aryl group portion, the aryl group is a $C_{6-10}$, preferably substituted or unsubstituted phenyl group.

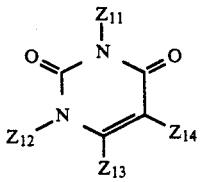

(D-7)

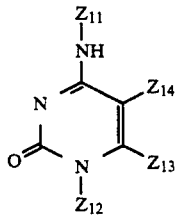

(D-8)

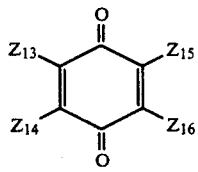

(D-9)

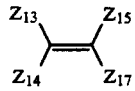

(D-10)

In the general formulae (D-7) to (D-10), at least one of $Z_{11}$ to $Z_{17}$ is AF group described above or a group containing AF group.

$Z_{11}$ and $Z_{12}$, which may be the same or different, each represents a hydrogen atom, an alkyl group, aryl group or AF group.

$Z_{13}$, $Z_{14}$, $Z_{15}$and $Z_{16}$, which may be the same or different, each represents a hydrogen atom, an alkyl group, aryl group, halogen atom (e.g., chlorine), alkoxy group (e.g., methoxy, butoxy), aryloxy group (e.g., phenoxy, p-carbonylphenoxy), arylthio group (e.g., methylthio, butylthio), alkoxycarbonyl group (e.g., ethoxycarbonyl, octylcarbonyl), aryloxycarbonyl group (e.g., phenoxycarbonyl), alkanesulfonyl group (e.g., methanesulfonyl), sulfamoyl group (e.g., sulfamoyl, methylsulfamoyl), carbamoyl group (e.g., carbamoyl, N-phenylcarbamoyl), ureido group (e.g., N-methylureido), acyl group (e.g., acetyl, benzoyl), acylamino group (e.g., acetamido, benzamido), arylsulfonyl group (e.g., benzenesulfonyl), heterocyclic group (a 5- or 6-membered ring containing hetero atoms selected from nitrogen, oxygen and sulfur atoms, e.g., imidazolyl, 1,2,4- triazolyl, thiadiazolyl, oxadiazolyl), acyloxy group (e.g., acetyloxy), nitro group, cyano group, carboxyl group, thiocarbamoyl group (e.g., phenylthiocarbamoyl), sulfamoylamino group (e.g., N-phenylsulfamoylamino), diacylamino group (e.g., diacetylamino), arylideneamino group (e.g., benzylideneamine) or AF group.

$Z_{17}$ represents the following group.

In $Z_{17}$, AF may be connected to the nucleus via any group which can be a divalent group among halogen atoms, an alkoxycarbonyl group, aryloxycarbonyl group, alkanesulfonyl group, sulfamoyl group, carbamoyl group, acyl group, diacylamino group, arylsulfonyl group, heterocyclic group, nitro group, cyano group, carboxyl group and sulfonamido group. Specific examples of these groups include those represented by $Z_{13}$ to $Z_{16}$.

In formulae (D-7), (D-8), (D-9) and (D-10), when $Z_{11}$, $Z_{12}$, $Z_{13}$, $Z_{14}$, $Z_{15}$, $Z_{16}$ or $Z_{17}$ contains an alkyl group, the alkyl group may be a $C_{1-16}$, preferably $C_{1-8}$, substituted or unsubstituted, straight-chain or branched-chain, cyclic, saturated or unsaturated alkyl group. When $Z_{11}$, $Z_{12}$, $Z_{13}$, $Z_{14}$, $Z_{15}$, $Z_{16}$ or $Z_{17}$ contains an aryl group, the aryl group is a $C_{6-10}$, preferably substituted or unsubstituted phenyl group.

In formula (D-9), $Z_{15}$ and $Z_{16}$ may be divalent groups which are connected to each other to form a ring, e.g., benzene ring.

In formula (D-10), $Z_{15}$ and $Z_{17}$ may be divalent groups which are connected to each other to form a ring, e.g., a benzothiazolidene group.

(D-11)

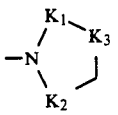

(D-12)

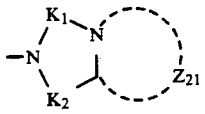

(D-13)

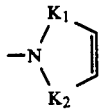

(D-14)

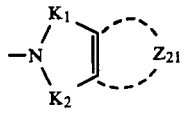

wherein $Z_{21}$ represents an atomic group necessary for forming a saturated or unsaturated 6- membered ring; $K_1$ and $K_2$ each represents an electrophilic group, e.g.,

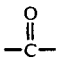

or $-SO_2-$; and $K_3$ represents $-N-R_{d3}$ (in which $R_{d3}$ represents an alkyl group, preferably containing 6 or fewer carbon atoms).

(D-15)

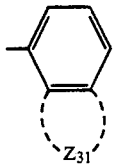

wherein in formulae (P-1) to (P-5), h is 0.

(D-16)

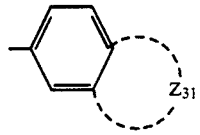

wherein in formulae (P-1) to (P-5), h is 0; and $Z_{31}$ represents an atomic group necessary for forming a 5- or 6-membered lactone ring or a 5-membered imide ring.

Specific examples of PUG represented by formula [II] include 1-(3-phenoxycarbonylphenyl)-5-mercaptotetrazole, 1-(4-phenoxycarbonylphenyl)-5-mercaptotetrazole, 1-(3-maleinimidephenyl)-5 - mercaptotetrazole , 5 -(phenoxycarbonyl)benzotriazole, 5-(p-cyanophenoxy-carbonyl)benzotriazole, 2-phenoxycarbonylmethylthio-5-mercapto-1,3,4-thiadiazole, 5-nitro-3-phenoxy-carbonylindazole, 5-phenoxycarbonyl-2-mercaptobenzimidazole, 5-(2,3-dichloropropyloxycarbonyl) benzotriazole, 5-benzyloxycarbonylbenzotriazole, 5-(butylcarbamoylmethoxy-carbonyl)benzotriazole, 5-(butoxycarbonylmethoxycarbonyl) benzotriazole, 1-(4-benzoyloxyphenyl)-5-mercaptotetrazole, 5-(2-methanesulfonylethoxycarbonyl)-2-mercaptobenzothiazole, 1-{4-(2-chloroethoxycarbonyl}phenyl) -2-mercaptoimidazole, 2-[3-{thiophene-2-ilcarbonyl} propyl]thio-5-mercapto-1,3,4-thiazole, 5-cinnamoylaminobenzotriazole, 1-(3-vinylcarbonylphenyl)-5-mercaptotetrazole, 5- succinimidemethyl-benzotriazole, 2-{4-succinimidephenyl}-5-mercapto-1,3,4-oxadiazole, 3-{4-benzo-1,2-isothiazole-3-oxo-1,1-dioxy-2-il)phenyl}-5-mercapto-4-methyl-1,2,4-triazole, and 6-phenoxycarbonyl-2-mercaptobenzoxazole.

Examples of PUG which is a diffusible or nondiffusible dye include compounds described in *High Function Photochemicals—Structural Function and Application View*, CMC, 1985, p 197–211. Specific examples of such compounds include arylidene dye, styryl dye, butadiene dye, oxonol dye, cyanine dye, merocyanine dye, hemicyanine dye, stilbene dye, chalkone dye, coumarin dye, azo dye, azomethine dye, azopyrazolone dye, indoaniline dye, indophenol dye, anthraquinone dye, triarylmethane dye, diarylmethane dye, alizarin dye, nitro dye, quinoline dye, indigo dye, and phthalocyanine dye. In addition, leuco derivatives of these dyes, dyes whose absorption wavelength have been temporarily shifted, absorbent precursors such as tetrazolium salts may be used. Furthermore, these dyes may form appropriate metals and chelating dyes. These dyes are further described in U.S. Pat. Nos. 3,880,658, 3,931,144, 3,932,380, 3,932,381, and 3,942,987. Special examples of these dyes are as follows, but the present invention is not to be construed as being limited thereto.
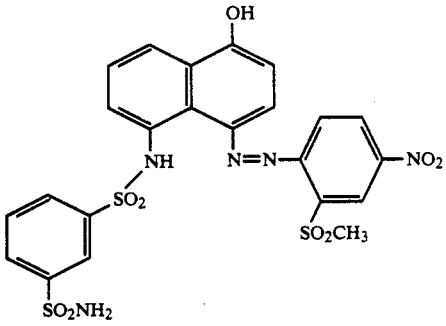
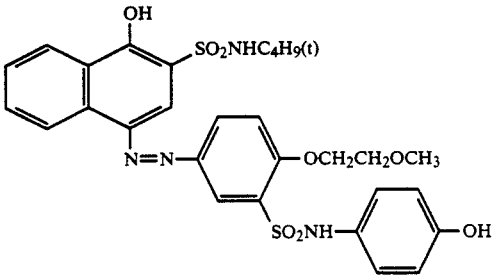
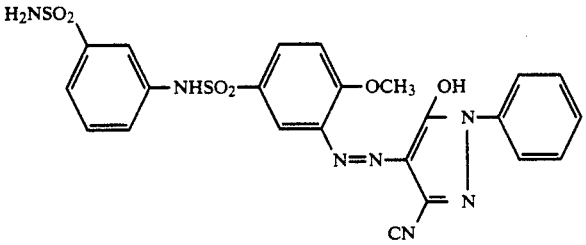
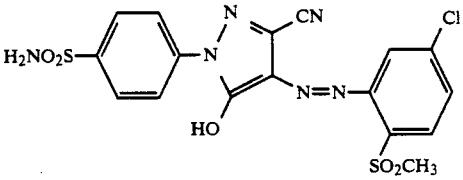
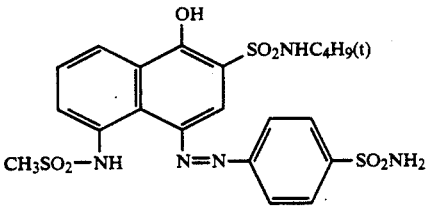
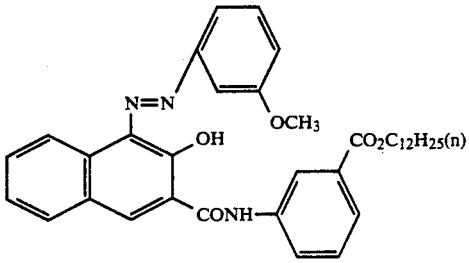

-continued
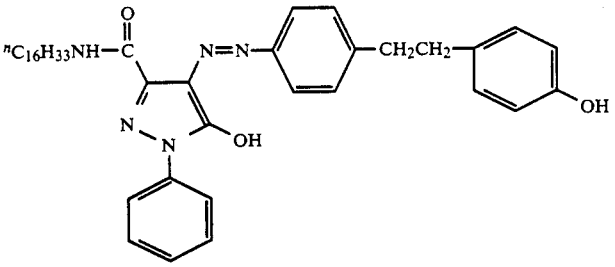
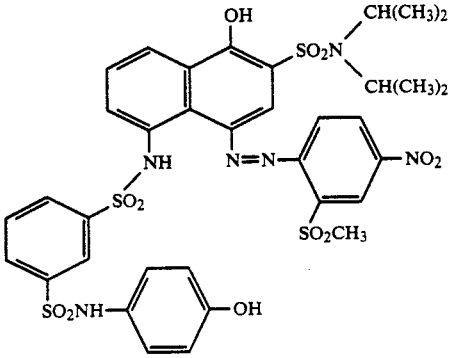
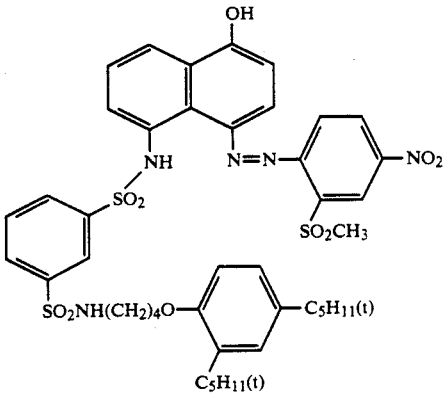
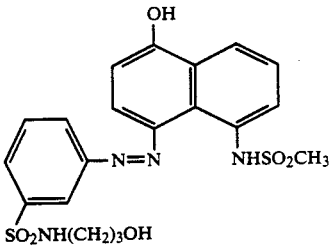
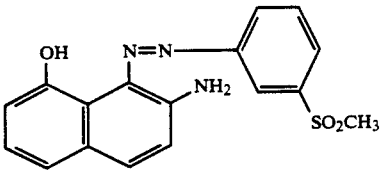
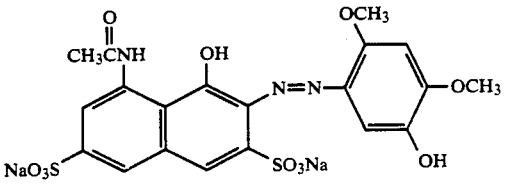

-continued
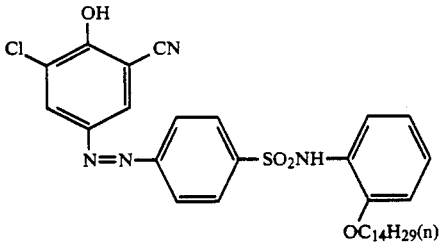
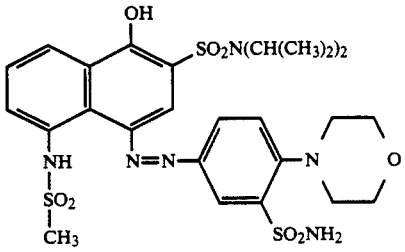
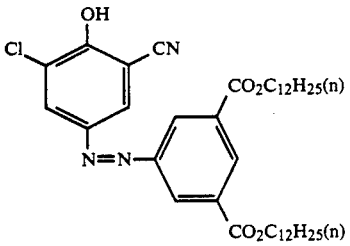
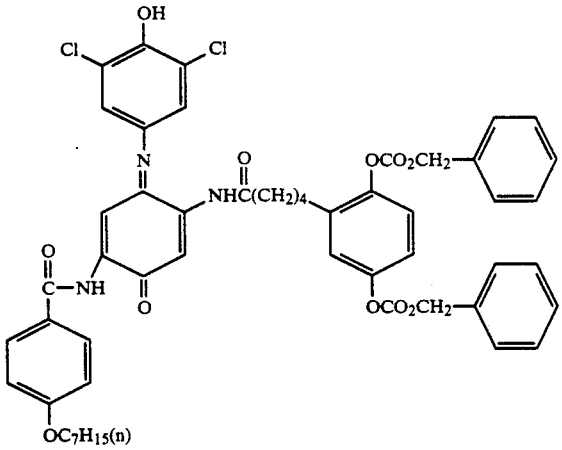
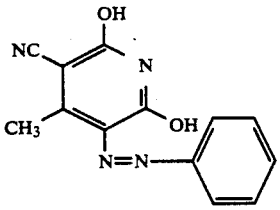
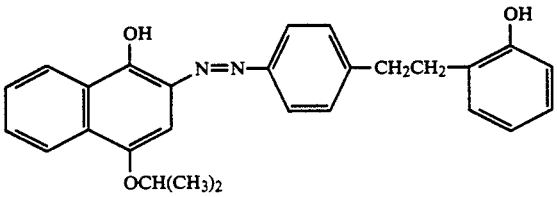

-continued
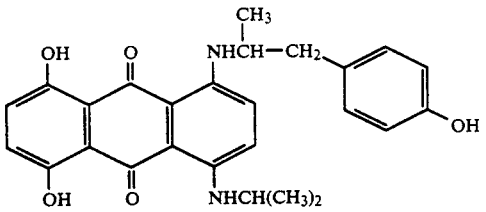
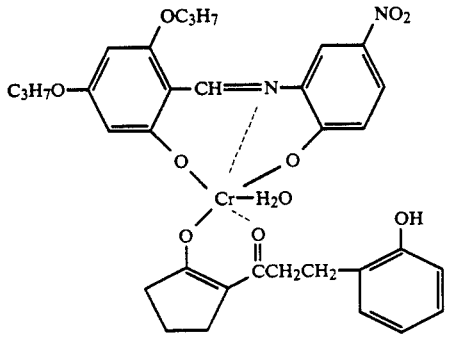
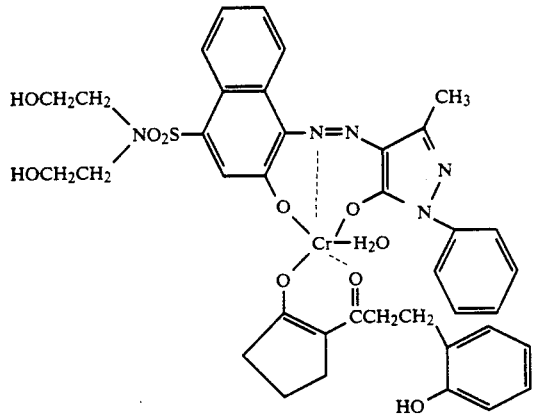
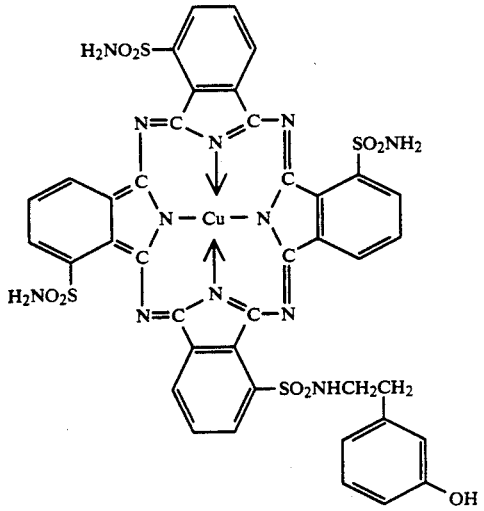

-continued
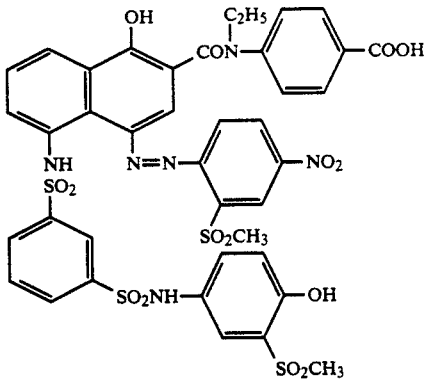
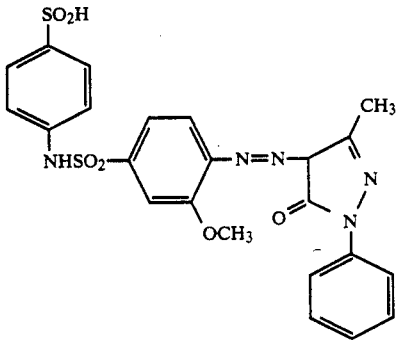
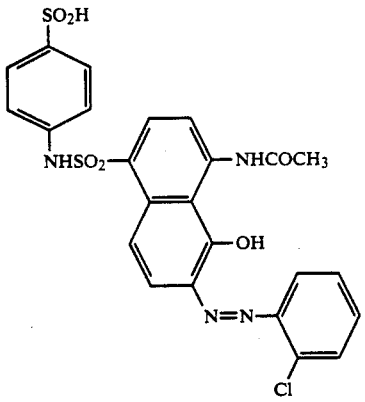
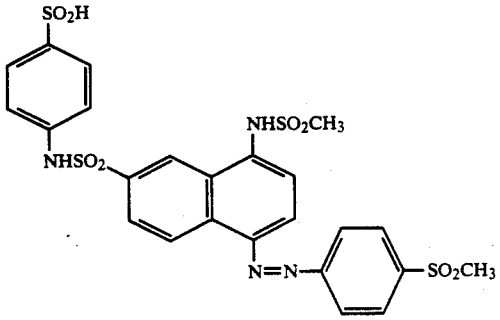

-continued
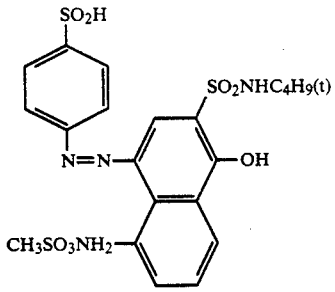
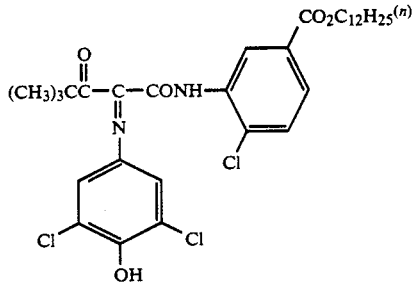
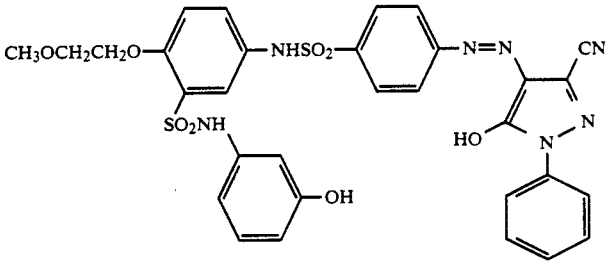
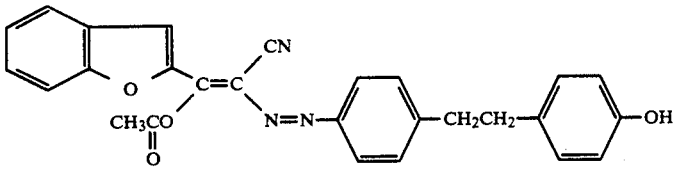
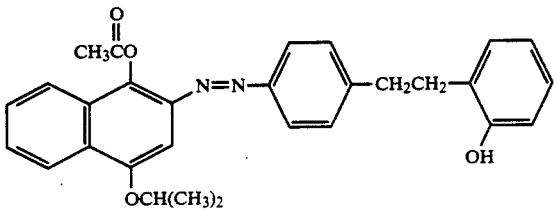

-continued
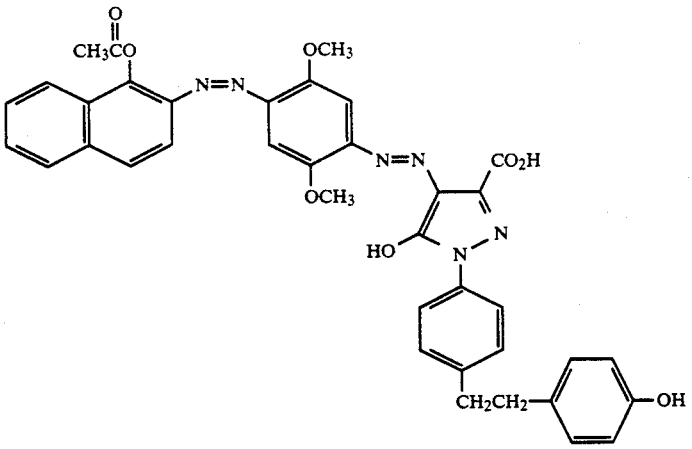
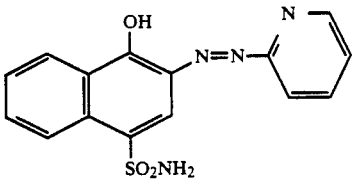
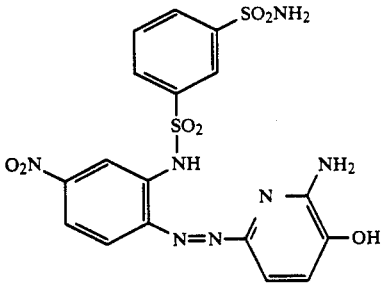
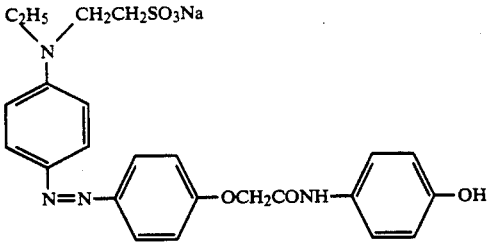
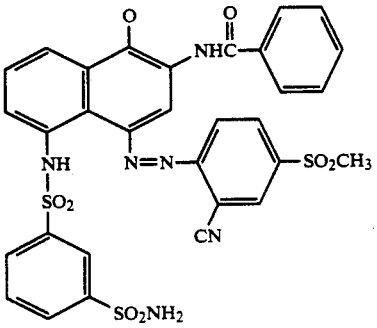

-continued
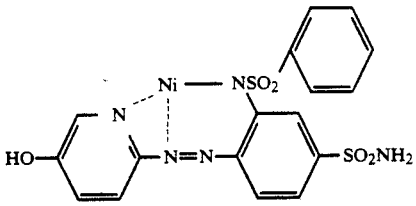
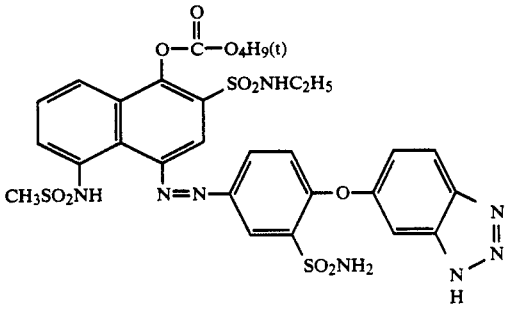
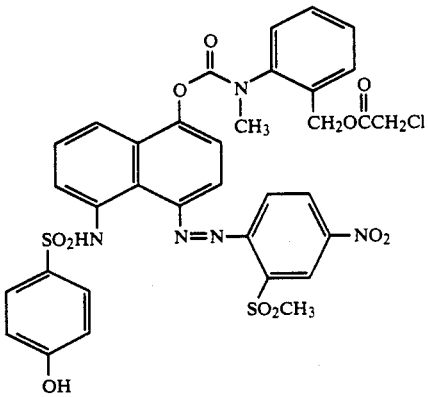
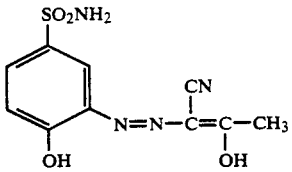
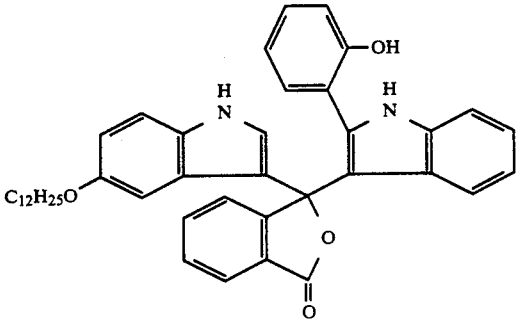

-continued

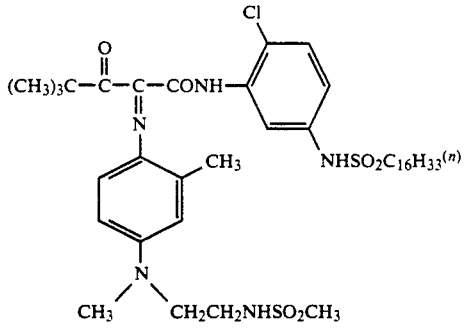

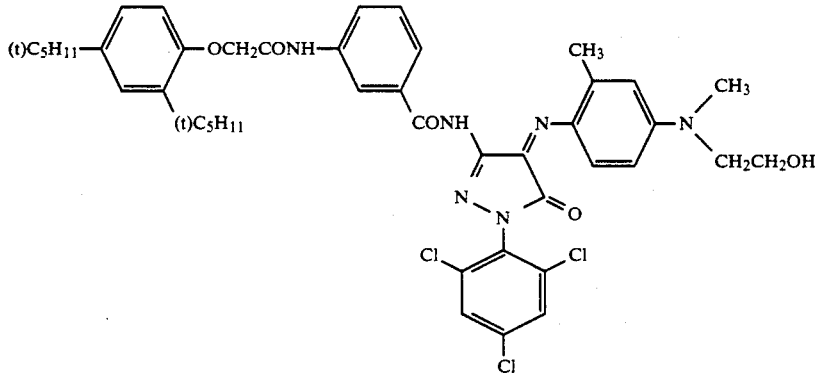

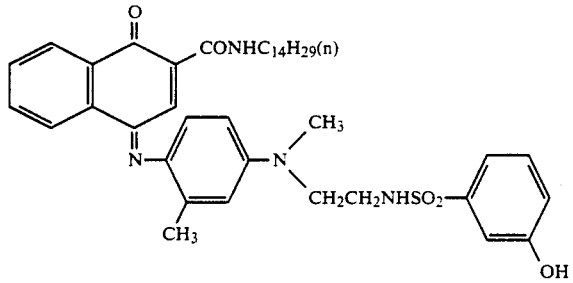

Examples of PUG which is a development accelerator include a group represented by the general formula [III]:

$$(*)(*)(*)\text{-}(L_1\text{—}L_2)_k\text{-}A \qquad [III]$$

wherein the mark (*)(*)(*) indicates the position at which the group PUG is bonded to Time.

L represents a group which can be further eliminated from Time which has been eliminated during development. $L_2$ represents a divalent connecting group. The subscript k is 0 or 1. A represents a group which substantially exhibits a fogging effect on a silver halide emulsion in a developing solution.

Preferred examples of $L_1$ include an aryloxy group, heterocyclic oxy group, arylthio group, alkylthio group, heterocyclic thio group, and azolyl group.

Specific examples of $L_1$ are as follows, but the present invention is not construed as being limited thereto.

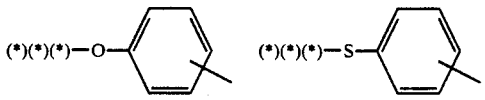

-continued

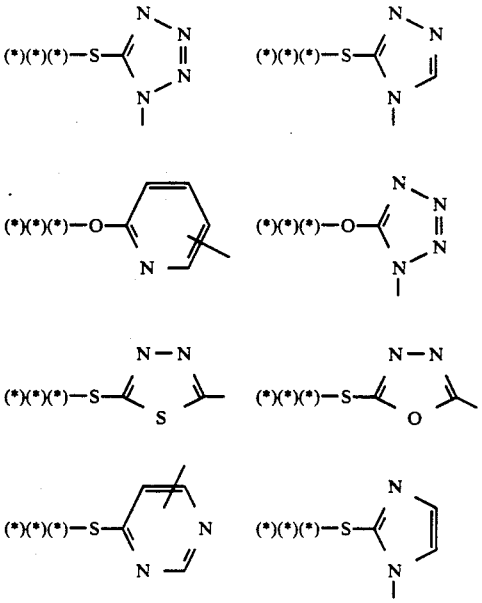

(*)(*)(*)—S—$(CH_2)_2$—, (*)(*)(*)—S—$(CH_2)_4$—,

-continued

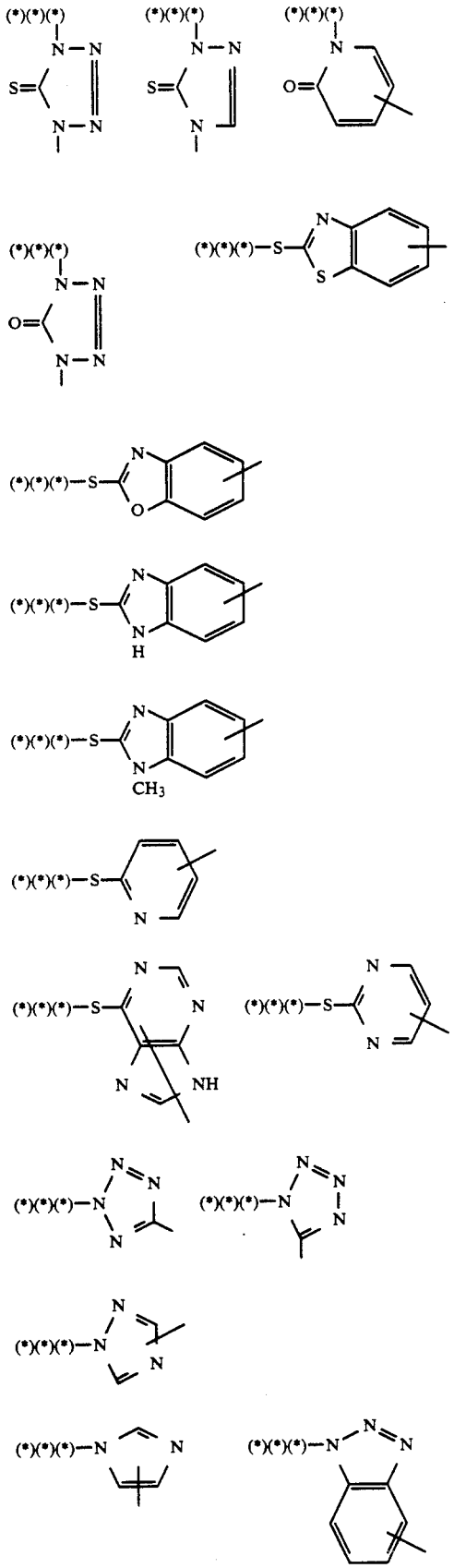

-continued

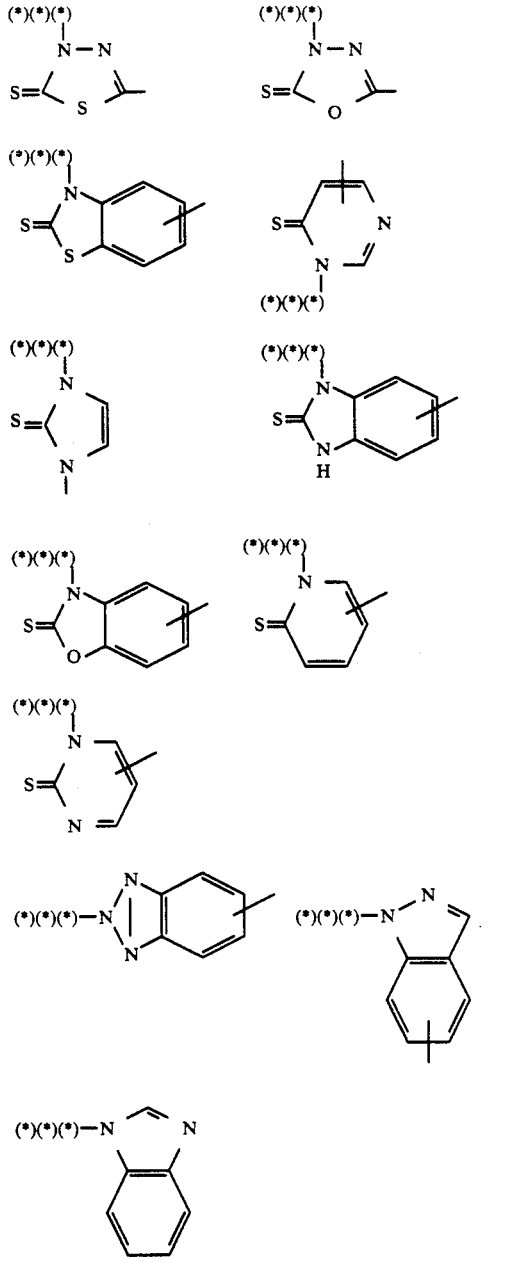

Examples of $L_2$ include alkylene, alkenylene, arylene, and divalent heterocyclic groups, —O—, —S—, an imino group, —COO-13 , —CONH—, —NHCONH—, —NHCOO—, —$SO_2$NH—, —CO—, —$SO_2$—, —SO—, —NH$SO_2$NH—, and combination thereof.

Specific examples of A include reducing groups (e.g., group containing a partial structure of hydrazine, hydrazide, hydrazone, hydroxylamine, polyamine, enamine, hydroquinone, catechol, p-aminophenol, o-aminophenol, aldehyde or acetylene), groups which can act on silver halide during development to form a developable silver sulfide nucleus (e.g., groups containing a partial structure of thiourea, thioamide, thiocarbamate, dithiocarbamate, thiohydantoin, or rhodanine), and quaternary salts (e.g., pyridinium salts).

Particularly preferred groups represented by A are groups represented by formula [IV]:

$$\text{—}(L_{00})_{l_4}\text{—}\underset{A_1}{N}\text{—}\underset{A_2}{N}\text{—}G\text{—}R_{00} \qquad [IV]$$

wherein $A_1$ and $A_2$ each represents a hydrogen atom or one of $A_1$ and $A_2$ represents a hydrogen atom and the other represents a sulfinic acid residue or $$\text{—}(\underset{\underset{O}{\|}}{C})_n\text{—}R_{00}^1$$

(in which $R_{00}^1$ represents an alkyl group, alkenyl group, aryl group, alkoxy group or aryloxy group; and n represents an integer 1 or 2); $R_{00}$ represents a hydrogen atom, an alkyl group, aryl group, alkoxy group, aryloxy group, amino group, alkoxycarbonyl group, aryloxycarbonyl group, carbamoyl group, azo group or heterocyclic group; G represents a carbonyl group, sulfonyl group, sulfoxy group, $$\text{—}\underset{\underset{R_{00}^2}{|}}{\overset{\overset{O}{\|}}{P}}\text{—}$$

(wherein $R_{00}^2$ represents an alkoxy group, preferably having 1 to 20 carbon atoms, or aryloxy group preferably having 6 to 20 carbon atoms) or iminomethylene group; $L_{00}$ represents an arylene group or divalent heterocyclic group; and $l_4$ is 0 or 1.

Specific examples of PUG represented by the general formula [III] are as follows, where mark (*)(*)(*) indicates the position at which the group PUG is bonded to Time. It should be, however, noted that the present invention is not to be construed as being limited to these specific examples.

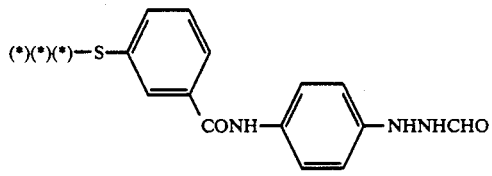

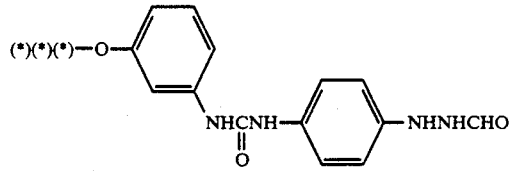

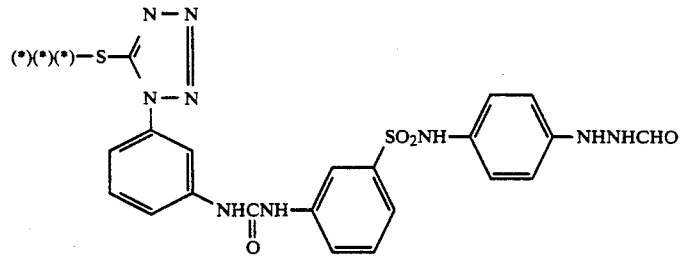

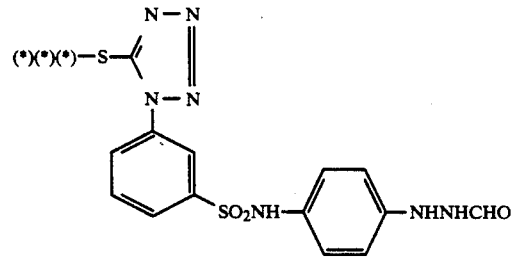

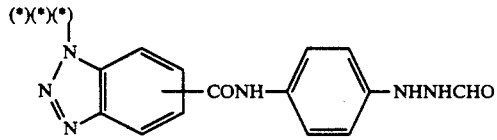

-continued
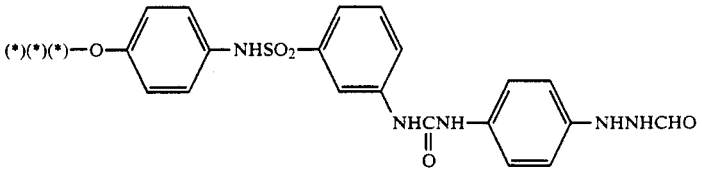
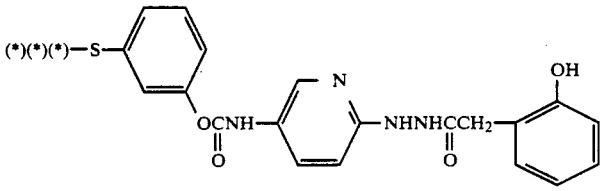
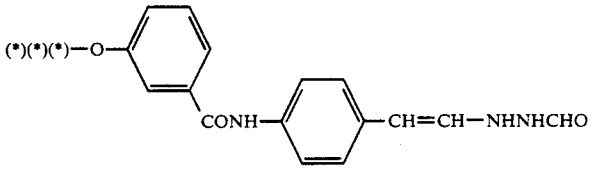
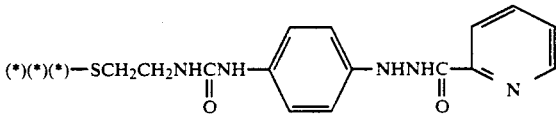
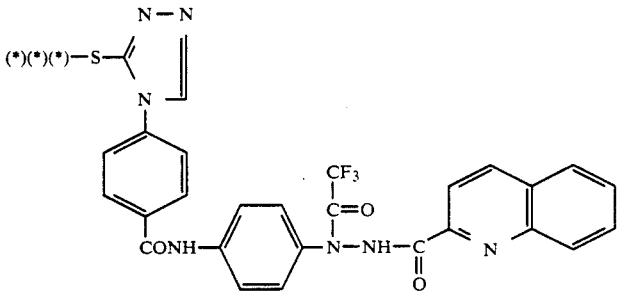
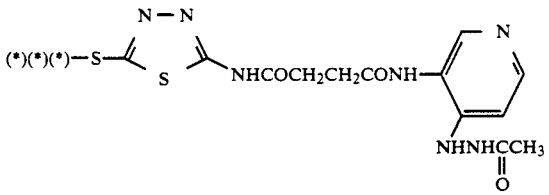
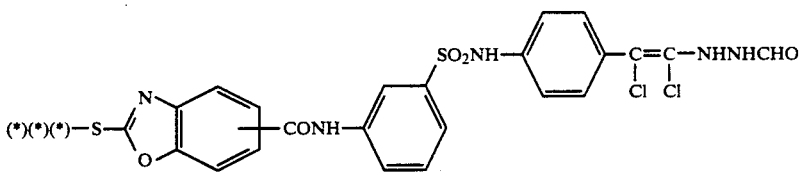
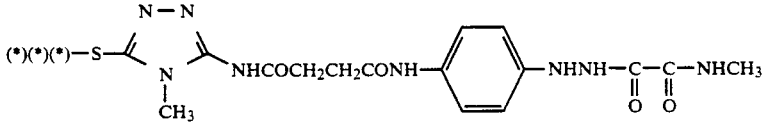

-continued

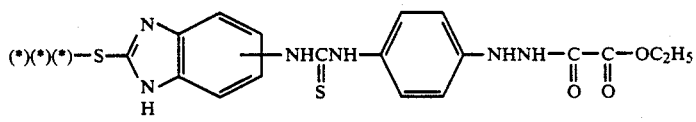

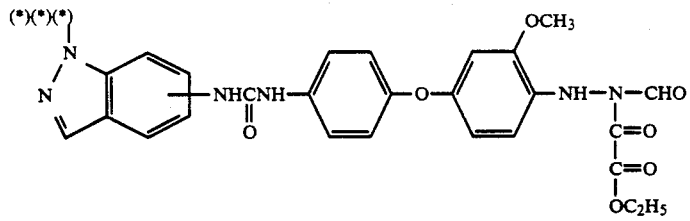

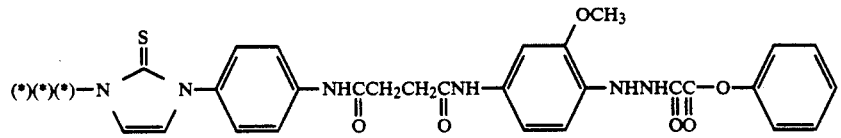

In addition to the above described examples, examples of PUG which is a fogging agent include eliminatable groups which are released from couplers as described in JP-A-59-170,840.

Examples of PUG which is a silver halide solvent include mesoionic compounds as described in JP-A-60-163042, and U.S. Pat. Nos. 4,003,910 and 4,378,424, and mercaptoazoles or azolethiones containing an amino group as substituent as described in JP-A-57-202531. Specific examples of such silver halide solvents include those described in JP-A-61-230135. Other examples of PUG are disclosed in JP-A-60-71768 and U.S. Pat. No. 4,248,962.

V represents a carbonyl group, sulfonyl group, sulfoxy group,

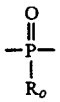

(wherein $R_0$ represents an alkoxy group or aryloxy group as defined for $R_{00}$[2]), iminomethylene group, thiocarbonyl group or

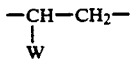

(in which W represents an electrophilic group).

As W there is preferably used a group having a Hammett's $\sigma_{para}$ value of more than 0.3. Examples of group W include a cyano group, nitro group, $C_{1-30}$ substituted or unsubstituted carbamoyl group (e.g., methylcarbamoyl, ethylcarbamoyl, 4-methoxyphenylcarbamoyl, N-methyl-N-octadecylcarbamoyl, 3-(2,4-di-t-pentylphenoxy)propylcarbamoyl, pyrrolidinocarbonyl, hexadecylcarbamoyl, di-n-octylcarbamoyl), $C_{1-30}$ substituted or unsubstituted sulfamoyl group (e.g., methylsulfamoyl, diethylsulfamoyl, 3-(2,4-di-t-pentylphenoxy)-propylcarbamoyl, phenylsulfamoyl, pyrrolidinosulfonyl, morpholinosulfonyl), $C_{1-30}$ substituted or unsubstituted alkoxycarbonyl group (e.g., methoxycarbonyl, ethoxycarbonyl, phenoxycarbonyl, 2-methoxyethoxycarbonyl, hexadecyloxycarbonyl, $C_{1-30}$ substituted or, unsubstituted sulfonyl group (e.g., methanesulfonyl, 1 4-methylphenylsulfonyl, dodecylsulfonyl), $C_{1-30}$ substituted or unsubstituted acyl group (e.g., acetyl, hexanoyl, benzoyl, 4-chlorobenzoyl), trifluoromethyl group, carboxyl group, and $C_{1-30}$ substituted or unsubstituted heterocyclic group residue (e.g., benzoxazol-2-yl, 5,5-dimethyl-2-oxazolin-2-yl). Particularly preferred among these groups are a carbamoyl group, an alkoxycarbonyl group, and a sulfamoyl group.

A preferred example of V is a carbonyl group.

R in formula (I) represents a hydrogen atom, an aliphatic group, aromatic group or

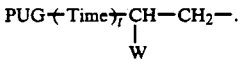

The aliphatic group represented by R is a straight-chain, branched or cyclic alkyl, alkenyl or alkynyl group, preferably having 1 to 20 carbon atoms, and more preferably 1 to 10 carbon atoms.

The aromatic group represented by R is a monocyclic or bicyclic aryl group, e.g., phenyl or naphthyl, preferably having 6 to 20 carbon atoms, and more preferably 6 to 10 carbon atoms.

R may be substituted by the following substituents which may be further substituted by other substituents. Examples of these substituents include an alkyl group, aralkyl group, alkenyl group, alkynyl group, alkoxy group, aryl group, substituted amino group, acylamino group, sulfonylamino group, ureido group, urethane group, aryloxy group, sulfamoyl group, carbamoyl group, aryl group, alkylthio group, arylthio group, sulfonyl group, sulfinyl group, hydroxy group, halogen atom, cyano group, sulfo group, carboxyl group, aryloxycarbonyl group, acyl group, alkoxycarbonyl group, acyloxy group, carbonamido group, sulfonamido group, nitro group, alkylthio group, and arylthio group.

These groups may be connected to each other to form a ring if possible.

Preferred examples of R include a hydrogen atom, an alkyl group and aryl group, and particularly a hydrogen atom.

The mechanism of the release of PUG from the compound of the general formula (I) is unknown. Without being bound in any way by theory, it is considered likely that the reaction mechanism is as described in

*Journal of Organic Chemistry*, vol. 30, p 1203, 1965 and JP-A-61-213847. In accordance with the suggested reaction mechanism, when the present compound undergoes oxidation of the redox nucleus, it increases the reactivity of the functional group V with a nucleophilic reagent as the redox nucleus turns from electron donating to electrophilic. As a result, V is directly attacked by a nucleophilic species, followed by cleavage of bonds or an intramolecular ring-opening reaction which causes cleavage of bonds, causing the release of PUG.

This mechanism is represented by Scheme I. Scheme I:

Scheme I:

$$PUG\text{-}(Time)_t\text{-}\overset{R}{\overset{|}{N}}\text{-}O\text{-}X \xrightarrow{\text{Oxidation}}$$

-continued

Scheme I:

$$PUG\text{-}(Time)_t\text{-}V\text{-}\underset{\oplus}{\overset{R}{\overset{|}{N}}}{=}O \xrightarrow{\text{Nucleophilic Agent (Nu)}}$$

$$PUG\text{-}(Time)_t^{\ominus} + \underset{\oplus}{\overset{R}{\overset{|}{Nu}}}\text{-}V\text{-}N{=}O$$

(If R = H, $PUG\text{-}(Time)_t\text{-}V\text{-}N{=}O$ $$PUG\text{-}(Time)_t^{\ominus} \longrightarrow (Time)_t + PUG^{\ominus}$$

Specific examples of the present compound will be shown hereafter, but the present invention is not to be construed as being limited thereto.

1.

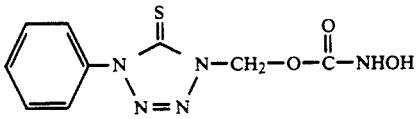

2.

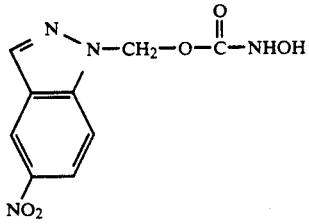

3.

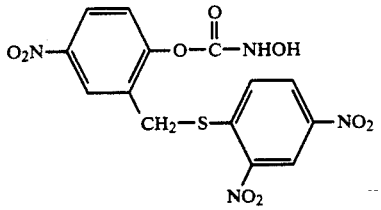

4.

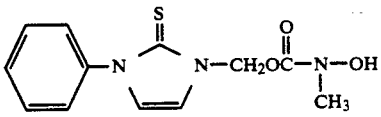

5.

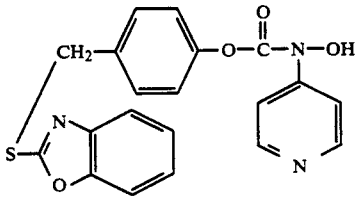

-continued
6.
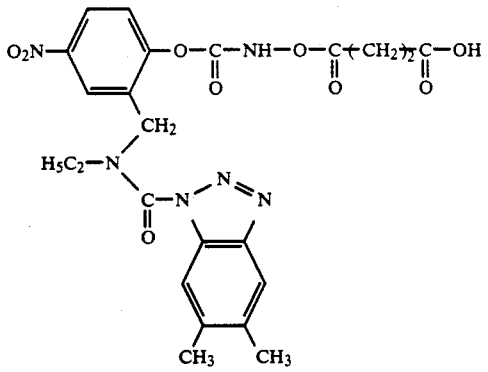
7.
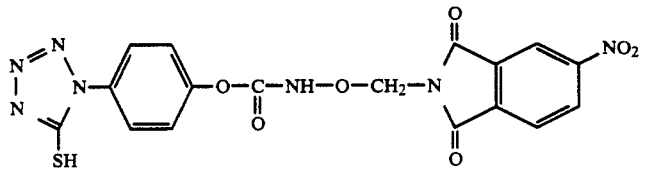
8.
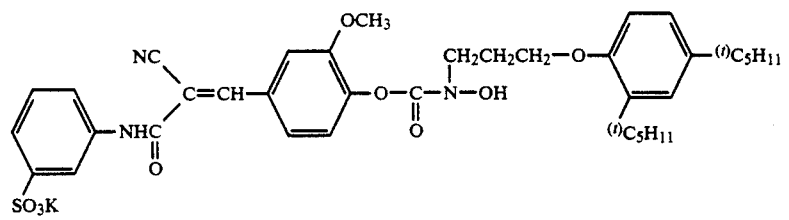
9.
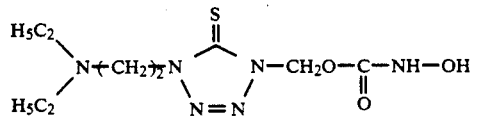
10.
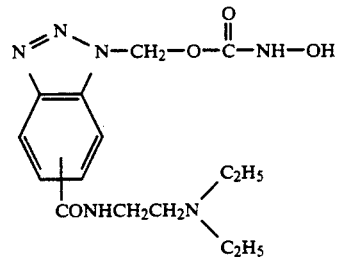
11.
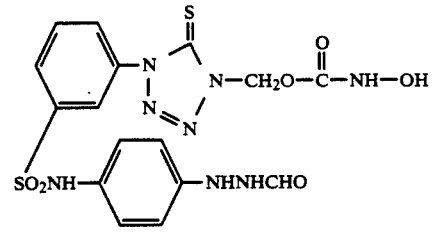
12.
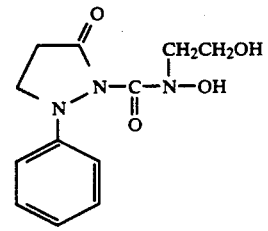

-continued
13.
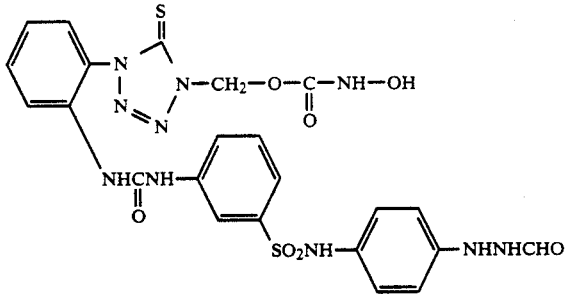
14.
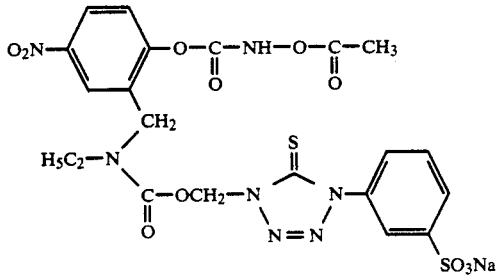
15.
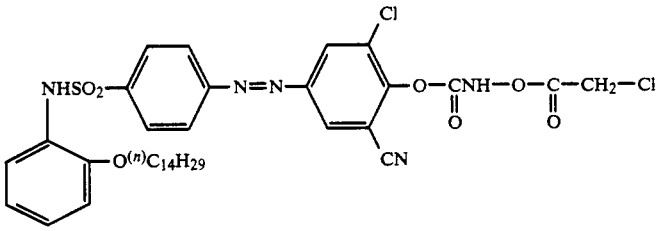
16.
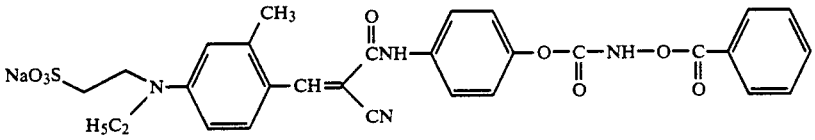
17.
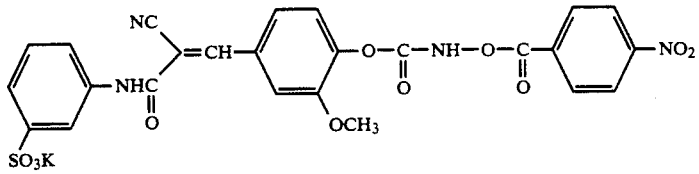
18.
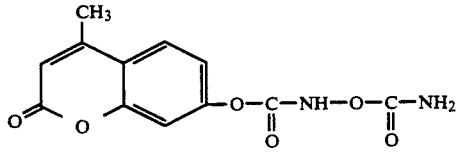
19.
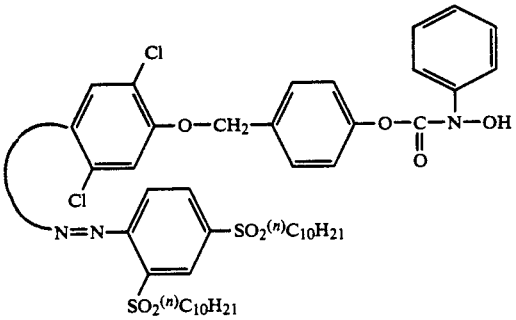

-continued
20.
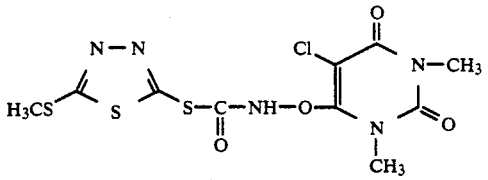
21.
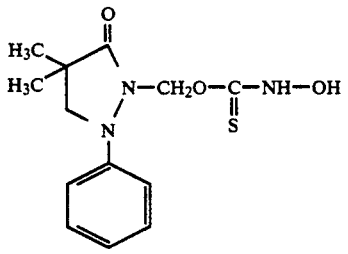
22.
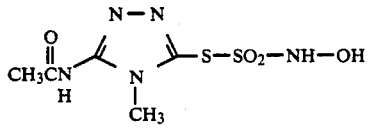
23.
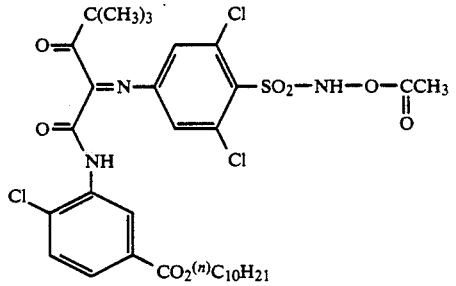
24.
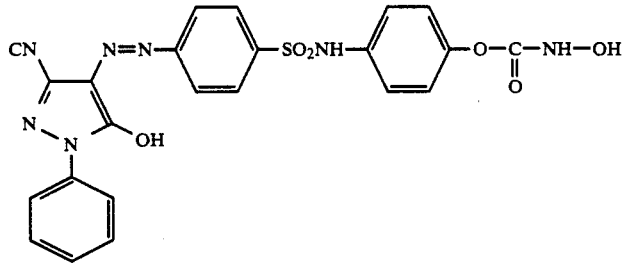
25.
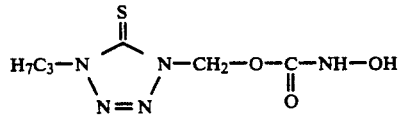
26.
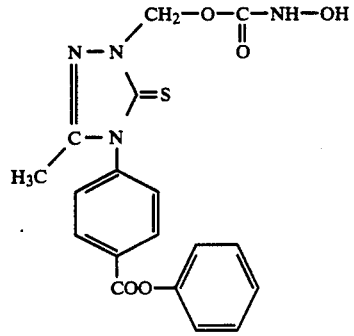

-continued
27.
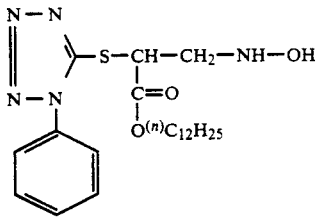
28.
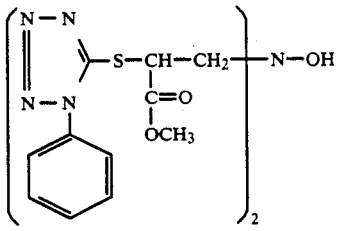
29.
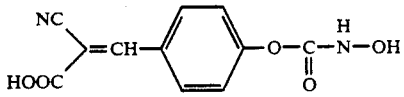
30.
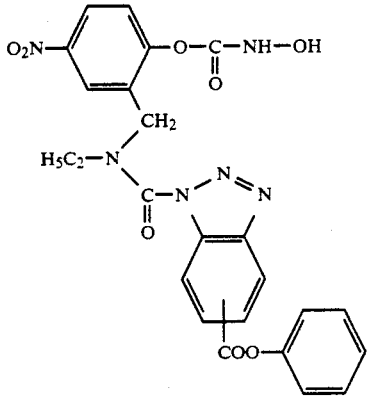
31.
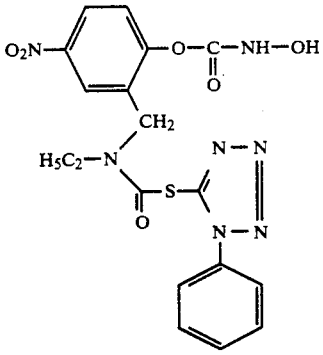
32.
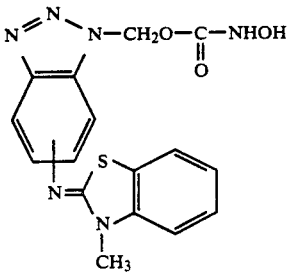

-continued
33.
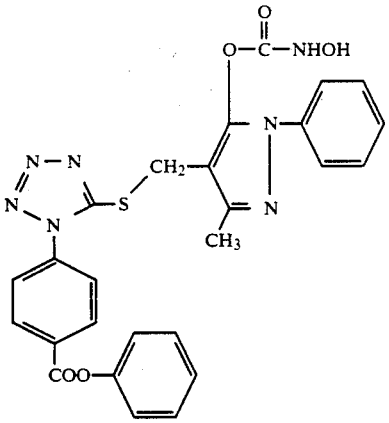
34.
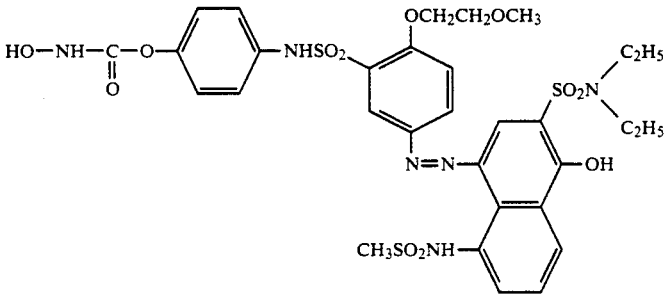
35.
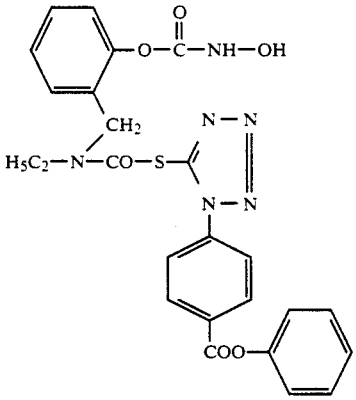
36.
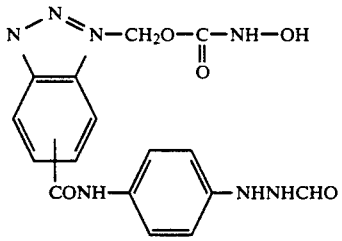
37.
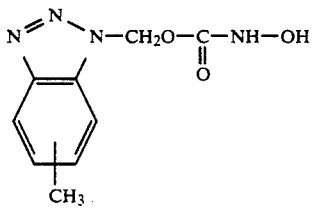

-continued
38.
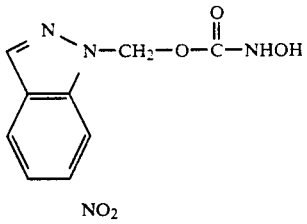
39.
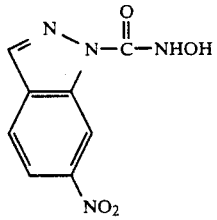
40.
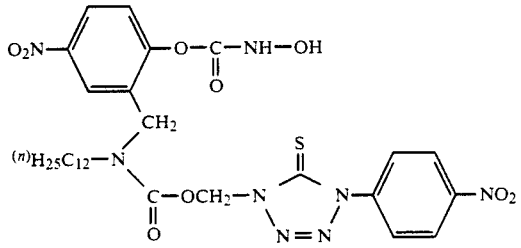
41.
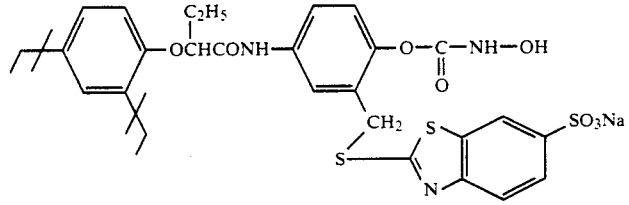
42.
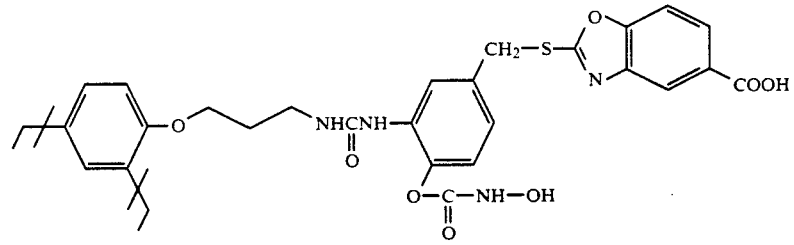
43.
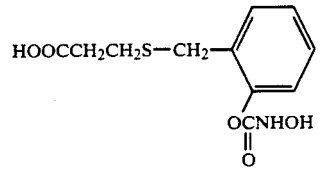
44.
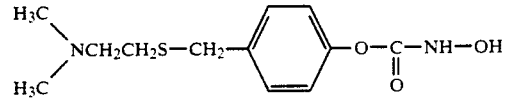

-continued

45.

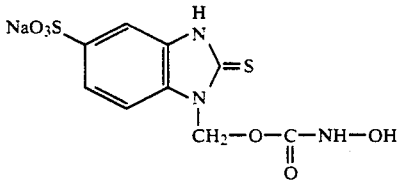

46.

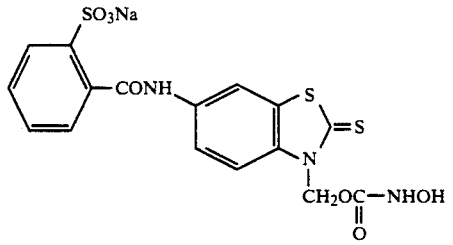

47.

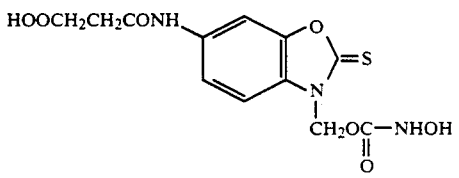

48.

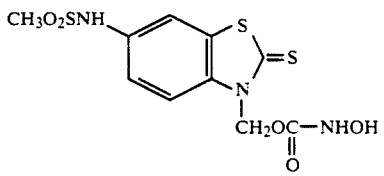

49.

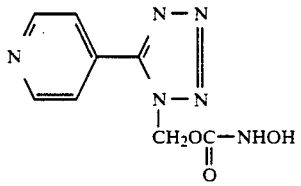

Specific examples of the synthesis of the present compound will be described hereafter.

SYNTHESIS EXAMPLE 1

Synthesis of Compound 1

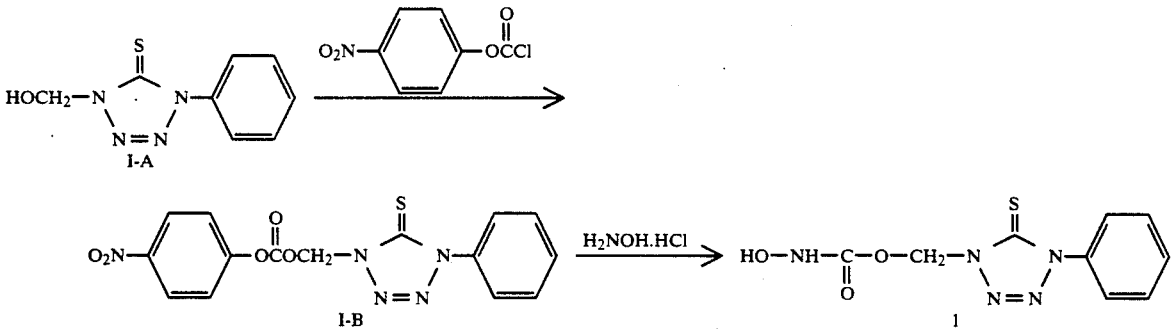

(1-(1): Synthesis of Compound 1-B 22.2 g of 4-nitrophenyl chlorocarbonate was dissolved in 30 ml of acetonitrile. A solution of 20.8 g of -hydroxymethyl-4-phenyl-2-tetrazoline-5-thione (1-A) in 200 ml of acetonitrile was added dropwise to the solution. 16.2 ml of pyridine was added dropwise to the solution. The reaction solution was then allowed to undergo reaction at room temperature over 5 hours. The reaction solution was then extracted with a mixture of dilute hydrochloric acid and ethyl acetate. The resulting organic phase was separated out. The organic phase was dried with magnesium sulfate anhydride, and then recrystallized from a mixture of ethyl acetate and n-hexane to obtain 30.1 g of a white solid (1-B). (Yield: 80.7 %)

1-(2): Synthesis of Compound 1

7.46 g of Compound 1-B obtained in 1-(1) and 2.3 g of hydroxylamine hydrochloride were added to 50 ml of acetonitrile. 4.4 ml of N-methylmorpholine is added dropwise to the mixture. The mixture was stirred at room temperature over 50 minutes. The solution was extracted with a mixture of dilute hydrochloric acid and ethyl acetate. The resulting organic phase was then separated out. The organic phase was dried with magnesium sulfate anhydride, and then distilled off under reduced pressure. The resulting coarse product was purified by a silca gel column chromatography (eluent 1/9 (by volume) mixture of methanol and chloroform). The purified product was then recrystallized from a mixture of ethyl acetate and n-hexane to obtain 3.2 g of a white solid. (Yield: 59.9 %)

SYNTHESIS EXAMPLE 2

Synthesis of Compound 2

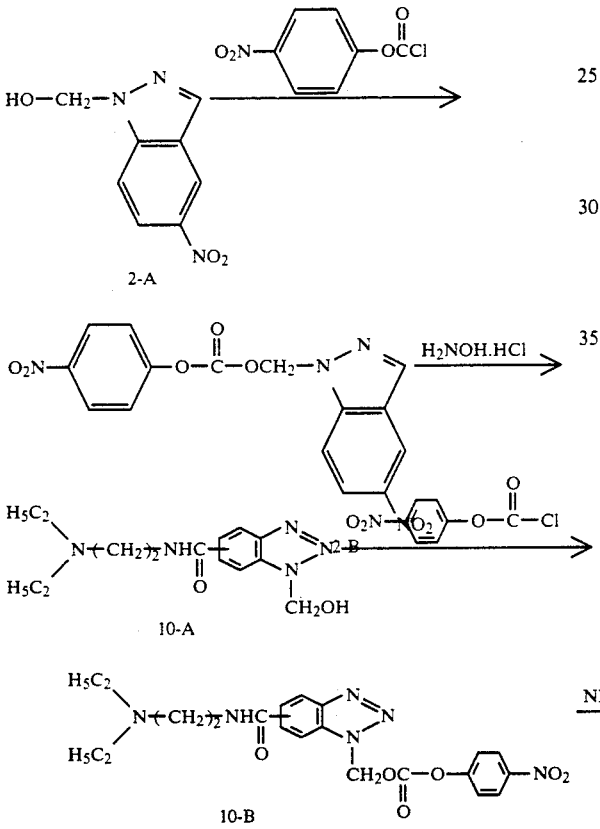

-continued

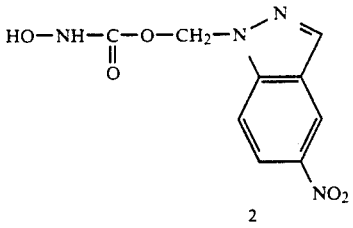

2-(1): Synthesis of Compound 2-B 22.2 g of 4-nitrophenyl chlorocarbonate was dissolved in 30 ml of acetonitrile. A solution of 19.3 g of 1 hydroxymethyl 5 nitroindazole (2-A) in 190:ml of acetonitrile was added dropwise to the solution. 16.2 ml of pyridine was added dropwise to the solution. The reaction solution was then reacted at room temperature over 4 hours. The reaction solution was then extracted with a mixture of dilute hydrochloric acid and ethyl acetate. The resulting organic phase was separated out. The organic phase was dried with magnesium sulfate anhydride, and then recrystallized from a mixture of ethyl acetate and n-hexane to obtain 29.0 g of a white solid (2-B). (Yield: 81.0 %)

2-(2): Synthesis of Compound 2

7.16 g of Compound 2-B obtained in 2-(1) and 2.3 g of hydroxylamine hydrochloride were added to 50 ml of acetonitrile. 4.4 ml of N-methylmorpholine was then added dropwise to the mixture. The mixture was then stirred at room temperature over 1 hour. The solution was purified in the manner as in 1-(2) to obtain 3.4 g of a white solid. (Yield: 67.5%)

SYNTHESIS EXAMPLE 3

Synthesis of Compound 10

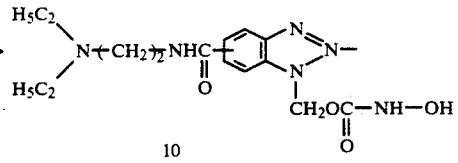

3-(1): Synthesis of Compound 10-B 22.2 g of 4-nitrophenyl chlorocarbonate, 29.1 g of Compound 10-A, 16.2 ml of pyridine and 200 ml of acetonitrile were subjected to the same synthesis reaction and purification as in 1-(1) to obtain 32.8 g of a white solid 10-B. (Yield: 71.9%)

3-(b 2): Synthesis of Compound 10

9.12 g of Compound 3-B obtained in 3-(1) and 2.3 g of hydroxylamine hydrochloride were added to 70 ml of acetonitrile. 4.4 ml of N-methylmorpholine was added dropwise to the mixture. The mixture was then stirred at room temperature over 1 hour. The product was then purified in the same manner as in 1-(2) to obtain 3.60 g of a white solid. (Yield: 51.4%)

SYNTHESIS EXAMPLE 4

Synthesis of Compound 27

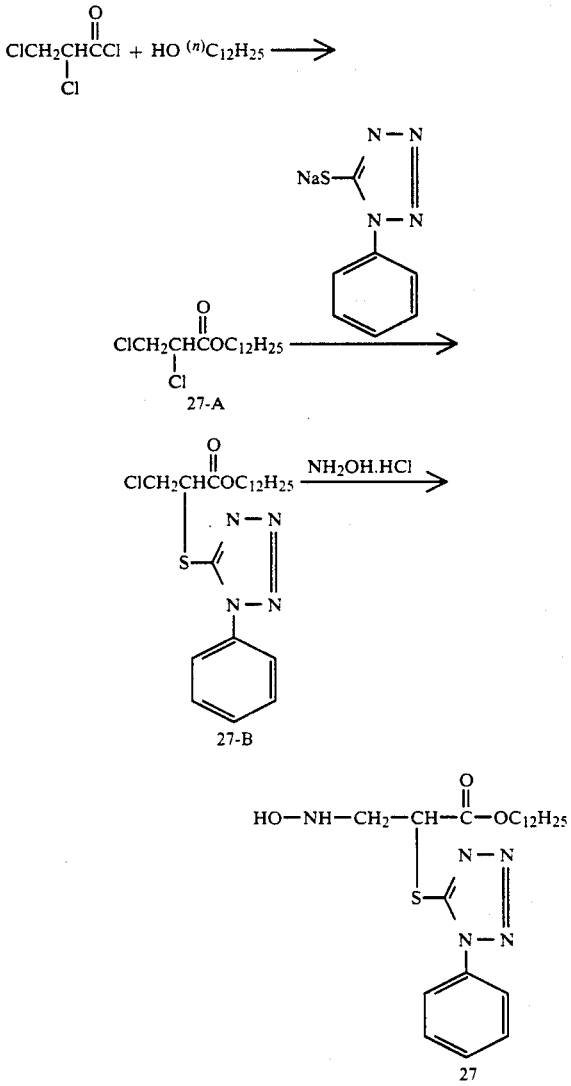

4-(1): Synthesis of Compound 27-A

A solution of 18.6 g of 1-dodecanol and 12.1 g of N,N-dimethylaniline in 60 ml of tetrahydrofuran was added dropwise to a solution of 15.7 g of 2,3-dichloropropionyl chloride in 30 ml of tetrahydrofuran while the latter was cooled to a temperature of 5° C. or lower. The mixture was stirred at room temperature over 14 hours, and then concentrated under reduced pressure to obtain 26.5 g of an oily material (27-A). (Yield: 87.8%)

4-(2): Synthesis of Compound 27-B 20 g of sodium 1-phenyl-1-H-tetrazole-5-thiolate was dissolved in 400 ml of acetone. 26.5 g of Compound 27-A obtained in 4-(1) was added dropwise to the solution with stirring. The solution was then refluxed in an atmosphere of nitrogen over 3 days, and cooled to room temperature. The solution was then extracted with a mixture of ethyl acetate and saturated brine. The resulting organic phase was then separated out. The organic phase was dried with magnesium sulfate anhydride. The solvent was then distilled off to obtain 28.1 g of an oily material (27-B]. (Yield: 73.0 %)

4-(3): Synthesis of Compound 27

3.85 g of Compound 27-B obtained in 4-(2), 6.95 g of hydroxylamine hydrochloride and 3.90 g of N,N-diisopropylethylamine were dissolved in 100 ml of tetrahydrofuran. The solution was then refluxed with stirring over 10 hours. The solvent was distilled off. The product was then purified through a silica gel column chromatography (eluent: 1/9 (by volume) mixture of methanol and chloroform) to obtain 2.38 g of an oily material 27. (Yield: 53.0 %)

The present compound of formula [I]undergoes cross oxidation when subjected to redox reaction with an oxidation product of a developing agent or auxiliary developing agent which occurs imagewise during development. By directly reducing a silver salt, the compound of formula [I] undegoes oxidation, imagewise releasing a photographically useful substance. The present compound is eventually converted to a colorless oxidation product.

The present compound can release imagewise a photographically useful group efficiently, and rapidly. Therefore, the present compound has wide application. For example, if the present compound releases a development inhibitor, it exhibits a DIR effect, i.e., imagewise inhibition of development, improvement in graininess of images, softening of tone of images, improvement in sharpness of images, and improvement in color reproducibility. If the present compound releases a diffusible or nondiffusible dye, it can also form color images. The present compound of formula [I] has remarkably high activity and thus acts with superior efficiency to conventional compounds of related function.

The present compound can be incorporated in either or both of a silver halide emulsion layer and a hydrophilic colloidal layer provided above or beneath the emulsion layer. When the present compound of formula [I] is used for the above described various purposes, it is necessary to select a proper eliminatable group PUG depending on the purpose The amount of the present compound of formula [I] incorporated depends on the type of the photographic light-sensitive material and the properties of PUG thus selected. In general, the amount of the present compound to be incorporated is preferably in the range of from about $1\times10^{-7}$ to about $1\times10^{-3}$ mol per mol of silver halide.

For example, if PUG is a development inhibitor, the present compound is preferably used in a range of from about $1\times10^{-7}$ to about $1\times10^{-1}$ mol, particularly $1\times10^{-6}$ to $5\times10^{-2}$ mol per mol of silver halide. If PUG is a development accelerator, the amount of the present compound to be incorporated is preferably in the same range as for the development inhibitor. If PUG is a dye and is used for image formation, the present compound is preferably used in a range of from about $1\times10^{-3}$ to about 10 mol, particularly $1\times10^{-2}$ to 4 mol per mol of silver halide.

The incorporation of materials in the silver halide emulsion layer and/or other hydrophilic colloid layers can be accomplished by commonly used methods. Water-soluble compounds may be incorporated in an aqueous solution of gelatin in the form of an aqueous solution. Compounds insoluble or difficultly soluble in water may be mixed with an aqueous solution of gelatin in the form of a solution in a solvent compatible with water, or may be incorporated in these layers by the methods described in U.S. Pat. No. 2,322,027. For example, compounds insoluble or difficultly soluble in water may be dispersed in a hydrophilic colloid in the form of a solution in phthalic alkylester (e.g., dibutyl phthalate, dioctyl phthalate), ester phosphate (e.g., diphenyl phosphate, triphenyl phosphate, tricresyl phosphate, dioctyl butyl phosphate), ester citrate (e.g., tributyl acetylcitrate), ester benzoate (e.g., octyl benzoate), alkylamide (e.g., diethyllaurylamide), ester aliphate (e.g., dibutoxyethyl succinate, diethyl azerate), ester trimesate (e.g., tributyl trimesate), or an organic solvent having a boiling point of about 30° to 150° C. such as a lower alkyl acetate (e.g., ethyl acetate, butyl acetate), ethyl propionate, secondary butyl alcohol, methyl isobutyl ketone, β-ethoxyethyl acetate, and methylcellosolve acetate. These high boiling organic solvents and low boiling organic solvens may be used in admixture.

The present compound of formula [I] may be used in the form of an emulsion dispersion in combination with a reducing substance such as hydroquinone and its derivatives, catechol and its derivatives, aminophenol and its derivatives, and ascorbic acid and its derivatives.

The light-sensitive silver halide to be contained in the photographic emulsion layer in the photographic light-sensitive material of the present invention may be any of silver bromide, silver iodobromide, silver iodochlorobromide, silver chlorobromide, and silver chloride.

The mean grain size of silver halide grains in the photographic emulsion (calculated in terms of mean value of the diameters of the projected area in the case of spherical or near spherical grains, or mean value of the side lengths of projected area in the case of cubic grains) is not specifically limited but is preferably 3 μm or less.

The distribution of grain sizes may be narrow ("monodisperse") or wide.

Silver halide grains in the photographic emulsions may be regular grains having a regular crystal form such as a cubic form, an octahedral form, a tetradecahedral form, and a rhomdodecahedral form, or those having an irregular crystal form such as a spherical form, and a tabular form, or those having a combination of these crystal forms. Mixtures of grains having various crystal forms may also be used.

An emulsion in which supertabular silver halide grains having a diameter of five or more times its thickness account for 50% or more of the total silver halide grains in terms of projected area may be used. The details are described in JP-A-58-127921 and JP-A-58-113927.

The silver halide grains used in the present invention may have different phases in the inside and surface layers. The silver halide grains also may be of the type which form latent images mainly on the surface thereof or the type which forms latent images mainly inside thereof.

The photographic emulsion to be used in the present invention can be prepared according to the prossess described in P. Glafkides, *Chimie et Physique Photographique,* (Paul Montel, 1967), G. F. Duffin, *Photographic Emulsion Chemistry,* Focal Press (1966), and V. L. Zelikman et al., *Making and Coating Photographic Emulsion,* (Focal Press, 1964). In more detail, the emulsion can be prepared by any of the acid process, the neutral process, and the ammonia process. The reaction of soluble silver salts and soluble halides can be carried out by any of a single jet process, a double jet process, or a combination thereof.

A method in which grains are formed in the presence of excess silver ions ("reverse mixing method") may be used. Further, a controlled double jet process, in which the pAg value of a liquid phase in which silver halide grains are formed is maintained constant, may also be used.

According to the controlled double jet process, a silver halide emulsion having a regular crystal form and an almost uniform grain size can be obtained.

Two or more different silver halide emulsions which have been separately prepared can be used in admixture.

During silver halide grain formation or physical ripening, a cadmium salt, a zinc salt, a lead salt, a thallium salt, an iridium salt or a complex thereof, a rhodium salt or a complex thereof, or an iron salt or a complex thereof may be present in the system.

The silver halide emulsion may be or may not be chemically sensitized. The chemical sensitization of the silver halide emulsion can be accomplished by any suitable methods as described in H. Frieser, *Die Grundlagen der Photographischen Prosesse mit Silberhalogeniden,* (Akademische Verlagsgesellschaft, 1968), p.675-734.

In particular, a sulfur sensitization process using a sulfur-containing compound capable of reacting with active gelatin or silver (e.g., thiosulfate, thiourea, mercapto compound, rhodanine), reduction sensitization process using a reducing substance (e.g., stannous salt, amine, hydrazine derivative, formamidinesulfinic acid, silane compound), or noble metal sensitization process using a noble metal compound (e.g., a gold complex, complex of the group VIII metals such as Pt, Ir, Pd) may be used, singly or in combination.

The photographic emulsion used in the present invention may contain various compounds for the purpose of inhibiting fog during the preparation, preservation or photographic processing of the light-sensitive material for stabilizing the photographic properties thereof. Examples of such compounds which may be incorporated in the photographic emulsion include many known fog inhibitors or stabilizers, such as azoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), mercaptopyrimidines, mercaptotriazines, thioketo compounds, e.g., oxazolinethione, azaindenes, e.g., triazaindenes, tetraazaindenes (particularly 4-hydroxy-substituted (1,3,3a,7)tetraazaindenes), pentaazaindenes, benzenesulfonic acid, benzenesulfinic acid, and benzenesulfonate.

The photographic emulsion layer or other hydrophilic colloid layers in the light-sensitive material prepared according to the present invention may contain any conventional surface active agents for the purpose of facilitating coating and emulsion dispersion, inhibiting electric charging and adhesion, improving smoothness and photographic properties (e.g., acceleration of development, higher contrast, sensitization) or like purposes.

Examples of such surface active agents nonionic surface active agents such as saponin (steroid series), alkylene oxide derivatives (e.g., polyethylene glycol, polyethylene glycol/polypropylene glycol condensate, polyethylene glycol alkel ether or polyethylene glycol alkylaryl ether, polyethylene glycol ester, polyethylene glycol sorbitan ester, polyalkylene glycol alkylamine or amide, polyethylene oxide addition product of silicone), glycidol derivatives (e.g., polyglyceride alkenylsuccinate, alkylphenol polyglyceride), aliphatic ester of polyvalent alcohol, or alkylester of saccharide, anionic surface active agents containing acid groups such as a carboxyl group, sulfo group, phospho group, ester sulfate group or ester phosphate group (e.g., alkylcarboxylate, alkylsulfonate, alkylbenzenesulfonate, alkylnaphthaleneslfonate, alkylsulfuric ester, alkylphosphoric ester, N-acyl-N-alkyltaurine, sulfosuccinic ester, sulfoalkyl polyoxyethylenealkyphenylether, polyoxyethylenealkylphosphoric ester); amphoteric surface active agents such as amino acids, aminoalkylsulfonic acid, aminoalkylsulfuric or phosphoric ester, alkylbetaine and amine oxide; and cationic surface active agents such as an alkylamine salt, aliphatic or aromatic quaternary ammonium salt, heterocyclic quaternary ammonium salt (e.g., pyridinium, imidazolium), and aliphatic or heterocyclic group-containing phosphonium or sulfonium salt.

The photographic emulsion layer in the present photographic light-sensitive material may contain polyalkylene oxide or its ether compound, thiomorpholine, quaternary ammonium salt, urethane derivatives, urea derivatives, imidazole derivatives, 3-pyrazolidone or the like for the purpose of improving sensitivity or contrast or accelerating development.

The photographic emulsion layer or other hydrophilic colloid layers of the photographic light-sensitive material to be used in the present invention may contain a dispersion of a synthetic polymer insoluble or difficultly soluble in water for the purpose of improving dimensional stability. Examples of such a synthetic polymer include alkyl(meth)acrylate, alkoxyalkyl(meth)acrylate, glycidyl(meth)acrylate, (meth)acrylamide, vinylester (e.g., vinyl acetate), singly or in combination, and a polymer containing as monomer component combinations of these compounds with acrylic acid, methacrylic acid, $\alpha,\beta$-unsaturated dicarboxylic acid, hydroxylalkyl(meth)acrylate, sulfoalkyl(meth)acrylate, styrenesulfonic acid.

The photographic emulsion used in the present invention may be subjected to spectral sensitization with a methine dye or the like. Examples of such a dye include cyanine dye, merocyanine dye, composite cyanine dye, composite merocyanine dye, holopolar cyanine dye, hemicyanine dye, styryl dye and hemioxonol dye. Particularly preferred among these dyes are cyanine dye, merocyanine dye and composite merocyanine dye. Any of nuclei which are commonly used as basic heterocyclic nuclei for cyanine dye can be applied to these dyes. Examples of suitable nuclei which can be applied to these dyes include a pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nuclei obtained by fusion of alicyclic hydrocarbon rings to these nuclei or nuclei obtained by fusion of aromatic hydrocarbon rings to these groups, e.g., indolenine nucleus, benzindolenine nucleus, an indole nucleus, berzoxazole nucleus, naphthoxazole nucleus, benzothiazole nucleus, naphthothiazole nucleus, benzoselenazole nucleus, benzimidazole nucleus and quinoline nucleus. These nuclei may be applied to carbon atoms in the dyes.

Examples of suitable nuclei which can be applied to a merocyanine dye or composite merocyanine dye include those having a ketomethylene structure such as pyrazoline-5-one nucleus, thiohydantoin nucleus, 2-thiooxazoline-2,4-dione nucleus, thiazoline-2,4-dione nucleus, and rhodanine nucleus.

The photographic emulsion layer in the photographic light-sensitive material according to the present invention may additionally contain a color-forming coupler, i.e., a compound capable of undergoing coupling with an oxidation product of an aromatic primary amine developing agent (e.g., phenylenediamine derivative, aminophenol derivative) during color development. Examples of magenta couplers include a 5-pyrazolone coupler, pyrazolobenzimidazole coupler, cyanoacetyl coumaron coupler, and open-chain acylacetonitrile coupler. Examples of yellow couplers include acylacetamide coupler (e.g., benzoylacetanilide, pivaloylacetanilide). Examples of cyan couplers include naphthol coupler and phenol coupler. These couplers are preferably nondiffusible couplers containing a hydrophobic group called ballast group in the molecule or polymerized couplers. These couplers may be either two-equivalent or four-equivalent with respect to silver ion. Colored couplers which exhibit an effect of color correction or couplers which release a development inhibitor or accelerator upon development "DIR coupler" or "DAR coupler") may be incorporated in the photographic light-sensitive material.

Besides DIR couplers, colorless DIR coupling compounds which undergo a coupling reaction to give a colorless product and release a development inhibitor may be incorporated in the photographic light-sensitive material.

Besides DIR couplers, compounds which release a development inhibitor upon development may be incorporated in the photographic light-sensitive material.

In order to produce the properties required by the photographic light-sensitive material, two or more kinds of such couplers may be incorporated in the same layer or the same kind of coupler may be incorporated in two or more different layers.

The photographic emulsion layer or other hydrophilic colloid layers in the present photographic light-sensitive material may contain an inorganic or organic film hardener such as chromium salts (e.g., chrome alum, chromium acetate), aldehydes (e.g., formaldehyde, glyoxal, glutaraldehyde), N-methylol compounds (e.g., dimethylol urea, methylol dimethyl hydantoin), dioxan derivatives (e.g., 2,3-dihydroxydioxan), active vinyl compounds (e.g., 1,3,5-triacroyl-hexahydro-s-triazine, 1,3-vinylsulfonyl-2-propanol), active halogen compounds (e.g., 2,4-dichloro-6-hydroxy-s-triazine), and mucohalogenic acids (e.g., mucochloric acid, mucophenoxychloric acid), singly or in combination.

As a suitable binder or protective colloid for the emulsion layer or hydrophilic colloid layers (e.g., protective layer, intermediate layer) in the present light-sensitive material there may be advantageously used gelatin. Other hydrophilic colloids may be used. Examples of such hydrophilic colloids which can be used in the present invention include proteins such as gelatin derivatives, graft polymer of gelatin with other high molecular compounds, albumin, and casein, saccharide derivation such as hydroxyethyl cellulose, carboxymethyl cellulose, cellulose ester sulfate, sodium alginate, and starch derivatives, monopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular compounds. Besides these compounds, lime-treated gelatin, acid-treated gelatin, and enzyme-treated gelatin may be used.

The present silver halide photographic material can contain other various additives such as a brightening agent, dye, desensitizer, coating aid, anstatic agent, plasticizer, lubricant, matting agent, development accelerator, mordant, ultraviolet absorber, discoloration inhibitor, and color fog inhibitor.

Such additives include those described in *Research Disclosure* No. 17643, 1978, p 22–31.

The photographic processing of the silver halide photographic material can be accomplished by any known methods such as wet processing or heat development.

As the processing solution for wet processing there can be used any known processing solutions. The processing temperature can be normally selected between 18° C. and 50° C. but may be lower than 18° C. or higher than 50° C. Development processing for the formation of silver images (black-and-white photographic processing) or color photographic processing including development processing for the formation of dye images can be used.

The developing solution used for black-and-white processing can contain any known developing agent such as dihydroxybenzenes (e.g., hydroquinone), 3-pyrazolidones (e.g., 1-phenyl-3-pyrazolidone), aminphenols (e.g., N-methyl-p-aminophenol),1-phenyl-3-pyrazolines, ascorbic acid, and heterocyclic compounds obtained by condensation of 1,2,3,4-tetrahydroquinoline ring and indolene ring as described in U.S. Pat. No. 4,067,872, singly or in combination. In general, the developing solution additionally contains known preservatives, alkali agents, pH buffers, and fog inhibitors. The developing solution may optionally further contain a dissolution aid, toner, development inhibitor, surface active agent, anti-foaming agent, water hardener, film hardener, or thicknening agent.

As a fixing solution there can be used any composition commonly used as a fixing solution. As a fixing agent there can be used thiosulfate or thiocyanate. Other examples of fixing agents which can be used include organic sulfur compounds which are known to have a fixing effect. The fixing solution may contain a water-soluble aluminum salt as a film hardener.

The formation of dye images can be accomplished by any commonly used methods. Examples of such methods include the negative-positive printing process as described in *Journal of the Society of Motion Picture and Television Engineers,* vol. 61, 1953, p 667–701; a color reversal process including development with a developing solution containing a black-and-white developing agent to form a negative silver image, uniform exposure to light at least once or other suitable fogging processing, and subsequent color development to obtain a positive dye image; and a silver dye bleaching process including exposure of a photographic emulsion layer containing a dye to light, development of the photographic emulsion layer to form a silver image, and bleaching of the dye with the silver image as a bleaching catalyst.

The color developing solution normally is an alkaline aqueous solution containing a color developing agent. Such color developing agents include any known primary aromatic amine developing agent such as phenylenediamines (e.g., 4-amino-N,N-diethylaniline, 3-methyl-4-amino-N,N-diethylaniline, 4-amino-N-ethyl-4-amino-N-ethyl-N-β-hydroxyethylaniline, 3-methyl-4-amino-N-ethyl-N-β-methanesulfonamideethylaniline, 4-amino-N-methyl-N-ethyl-N-β-methoxyethylaniline).

Other examples of color developing agents which can be used include those described in L. F. A. Mason, *Photographic Processing Chemistry,* (Focal Press, 1966), p. 226–229, U.S. Pat. Nos. 2,193,015 and 2,592,364, and JP-A-48-64933.

The color developing solution may additionally contain a pH buffer such as a sulfite of an alkaline metal, carbonate, borate and phosphate; a development inhibitor such as bromide, iodide and an organic fog inhibitor; a fog inhibitor. The color developing solution may optionally contain a water hardener, a preservative such as hydroxylamine, an organic solvent such as benzyl alcohol or diethylene glycol, a development accelerator such as polyethylene glycol, a quaternary ammonium salt or amine, a dye-forming coupler, a competing coupler, a fogging agent such as sodium boron hydride, an auxiliary developing agent such as 1-phenyl-3-pyrazolidone, a thickening agent, a polycarboxylic chelating agent as described in U.S. Pat. No. 4,083,723, and an oxidation inhibitor as described in West German Patent Application (OLS) No. 2,622,950.

The photographic emulsion layer which has been color-developed is normally subjected to bleaching. The bleaching may be effected simultaneously with (blix) or separately of fixation. Suitable bleaching agents include a compound of polyvalent metal such as iron (III), cobalt (III), chromium (VI), or copper (II), peroxide, quinone, or a nitroso compound. Typical examples of bleaching agents which can be used in the present invention include ferricyanides, bichromates, organic complexes of iron (III) or cobalt (III) with aminopolycarboxylic acids such as ethylenediaminetetraacetic acid, nitrilotriacetic acid, and 1,3-diamino-2-propanetetraacetic acid, organic acid such as citric acid, tartaric acid, or malic acid, persulfates, bromates, permanganates, and nitrosophenol. Among these compounds, potassium ferricyanide, iron (III) sodium ethylenediaminetetraacetate, and iron (III) ammonium ethylenediaminetetraacetate are preferably used. Complexes of iron (III) with ethylenediaminetetraacetic acid are also useful both for bleaching solution and blix solution.

The bleaching or blix solution may contain various additives besides bleach accelerators as described in U.S. Pat. Nos. 3,042,520 and 3,241,966, and JP-B-45-8506 and JP-B-45-8836, and thiol compounds as described in JP-A-53-65732.

The compound of formula [I] can be applied to various silver halide photographic materials. Examples of specific applications are set forth below, but the present invention is not to be construed as being limited thereto.

(1) The compound can be effectively used to improve the quality of silver halide photographic materials for a photomechanical process containing a silver bromochloride or silver bromochloroiodide emulsion layer (preferably monodisperse) containing at least 60% silver chloride and 0 to 5% silver iodide and polyalkylene oxides. For example, if PUG [I] is a development inhibitor, it provides an improvement in halftone gradation without deteriorating halftone quality. If PUG is a development accelerator, it is effective for the improvement in sensitivity and halftone quality. In these cases, the present compound is preferably used in an amount of from about $1\times10^{-7}$ to $1\times10^{-1}$ mol, particularly $1\times10^{-6}$ to $1\times10^{-2}$ mol per mol of silver halide.

The polyalkylene oxide compound used in these cases may be incorporated in either or both of the silver halide photographic material and the developing solution.

Examples of such a polyalkylene oxide compound include $C_{2-4}$ alkylene oxides, e.g. ethylene oxide, propylene-1,2-oxide, butylene-1,2-oxide. Preferred examples of polyalkylene oxide compounds include condensates of polyalkylene oxide consisting of at least 10 units of ethylene oxide with a compound containing at least one active hydrogen atom such as water, aliphatic alcohol, aromatic alcohol, aliphatic acid, organic amine and hexitol derivatives, and block copolymers of two or more polyalkylene oxides. Specific examples of polyalkylene oxide compounds which can be used include polyalkylene glycols, polyalkylene glycol alkyl ethers, polyalkylene glycol aryl ethers, polyalkylene glycol (alkylaryl) esters, polyalkylene glycol esters, polyalkylene glycol aliphatic amides, polyalkylene glycol amines, polyalkylene glycol block copolymers, and polyalkylene glycol graft polymers.

These polyalkylene oxide compounds preferably have a molecular weight of 500 to 10,000.

Specific examples of polyalkylene oxide compounds which can be preferably used in the present invention are as follows:

Examples of polyalkylene oxide compounds

1. $HO(CH_2CH_2O)_9H$
2. $C_{12}H_{25}O(CH_2CH_2O)_{15}H$
3. $C_8H_{17}CH{=}CHC_8H_{16}O(CH_2CH_2O)_{15}H$

4. 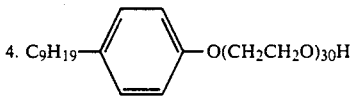

5. $C_{11}H_{23}COO(CHhd\ 2CH_2CH_2O)_{80}H$
6. $C_{11}H_{23}CONH(CH_2CH_2O)_{15}H$

7. 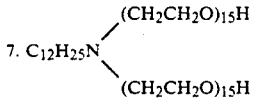

8. $C_{14}H_{29}N(CH_2)(CH_2CH_2O)_{24}H$

9. $H(CH_2CH_2O)_a(\underset{\underset{CH_3}{|}}{CH}CH_2O)_b(CH_2CH_2O)_cH$ $a+b+c=50$
$b:a+c=10:9$ These polyalkylene oxide compounds can be used in combination.

The above described polyalkylene oxide incorporated in a silver halide photographic material in an amount of $5\times10^{-4}$ to 5 g, preferably $1\times10^{-3}$ to 1 g per mol of silver halide. The above described polyalkylene oxide compound can also be incorporated in a developing solution in an amount of 0.1 to 10 g per liter of the developing solution (2) The present compound of the general formula [I] can be effectively used to improve halftone gradation of photographic light-sensitive materials having a monodisperse silver halide emulsion layer which can form an ultrahigh contrast negative image with a stable developing solution when acted on by a hydrazine derivative as described in U.S. Pat. Nos. 4,224,401, 4,168,977, 4,241,164, 4,311,781, 4,272,606, 4,221,857, 4,243,739, 4,272,614, and 4,269,929, without deteriorating halftone quality. The stable developing solution contains sulfite ion as preservative in an amount of 0.15 mol/liter and has a pH of 10.0 to 12.3. This developing solution can contain a large amount of a preservative and is more stable than an ordinary lith developing solution (containing only an extremely small amount of sulfite ion). This developing solution has a low pH value and is thus less subject to air oxidation and is more stable than a developing solution for high contrast image formation system as described in U.S. Pat. No. 2,419,975 (pH=12.8). In this case, the compound of formula [I] containing a development inhibitor as PUG is preferably used in an amount of $1\times10^{-5}$ to $8\times10^{-2}$ mol, particularly $1\times10^{-4}$ to $5\times10^{-2}$ mol per mol of silver halide.

The hydrazine derivative used in this case is represented by formula [V]:

$$Y_5-\underset{\underset{A_{51}}{|}}{N}-\underset{\underset{A_{52}}{|}}{N}-G_{50}-R_{50} \qquad [V]$$

wherein $Y_5$ represents an aliphatic group or aromatic group; $R_{50}$ represents a hydrogen atom, an alkyl group, aryl group, alkoxy group, aryloxy group, amino group, hydrazino group, carbamoyl group or oxycarbonyl group; $G_{50}$ represents a carbonyl group, sulfonyl group, sufoxy group, $$-\overset{\overset{O}{\|}}{\underset{\underset{R_{50}}{|}}{P}}-$$

group or iminomethylene group; and $A_{51}$ and $A_{52}$ each represents a hydrogen atom or one of $A_{51}$ and $A_{52}$ represents a hydrogen atom and the other represents a substituted or unsubstituted alkylsulfonyl group, substituted or unsubstituted arylsulfonyl group or substituted or unsubstituted acyl group.

In formula [V], the aliphatic group represented by $Y_5$ is preferably a $C_{1-30}$, particularly $C_{1-20}$, straight-chain, branched or cyclic alkyl group. In this case, the branched alkyl group may be cyclized such that a saturated heterocyclic group containing one or more hetero atoms is formed. This alkyl group may contain substituents such as aryl group, alkoxy group, sulfoxy group, sulfonamido group, and carbonamido group.

In formula [V], the aromatic group represented by $Y_5$ is a monocyclic or bicyclic aryl group or unsaturated heterocyclic group. In this case, the unsaturated heterocyclic group may be condensed with a monocyclic or bicyclic aryl group to form a heteroaryl group.

Examples of such an unsaturated heterocyclic group include a benzene ring, naphthalene ring, pyridine ring, pyrimidine ring, imidazole ring, pyrazole ring, quinoline ring, isoquinoline ring, benzimidazole ring, thiazole ring, and benzothiazole ring. Particuarly preferred among these rings are those containing a benzene ring.

Particularly preferred among the groups represented by $Y_5$ is an aryl group.

The aryl group or unsaturated heterocyclic group represented by $Y_5$ may be substituted by substituents. Typical examples of such substituents include an alkyl group, aralkyl group, alkenyl group, alkynyl group, alkoxy group, aryl group, substituted amino group, acylamino group, sulfonylamino group, ureido group, urethane group, aryloxy group, sulfamoyl group, carbamoyl group, alkylthio group, arylthic group, sulfonyl group, sulfinyl group, hydroxy group, halogen atom, cyano group, sulfo group, alkyloxycarbonyl group, aryloxycarbonyl group, acyl group, alkoxycarbonyl group, acyloxy group, carbonamido group, sulfonamido group, carboxyl group, amide phosphate group, diacylamino group, and imido group. Preferred examples of substituents include a straight-chain, branched or cyclic alkyl group (preferably $C_{1-20}$), aralkyl group (monocyclic or bicyclic aralkyl group, preferably containing 1 to 3 carbon atoms in the alkyl portion), alkoxy group preferably $C_{1-20}$), substituted amino group (preferably am amino group substituted by a $C_{1-20}$ alkyl group), acylamino group (preferably $C_{2-30}$), sulfonamido group (preferably $C_{1-30}$), ureido group (preferably $C_{1-30}$), and amidophosphate group (preferably $C_{1-30}$).

In formula [V], the alkyl group represented by $R_{50}$ is preferably a $C_{1-4}$ alkyl group which may contain substituents such as a halogen atom, cyano group, carboxyl group, sulfo group, alkoxy group, phenyl group, or sulfonyl group.

The aryl group represented by $R_{50}$ is preferably a monocyclic or bicyclic aryl group. Examples of such an aryl group include those containing benzene rings. This aryl group may be substituted by halogen atoms, alkyl groups, cyano groups, carboxyl groups, sulfo groups, or sulfonyl groups.

The alkoxy group represented by $R_{50}$ is preferably a $C_{1-8}$ alkoxy group which may be substituted by halogen atoms, or aryl groups.

The aryloxy group represented by $R_{50}$ is preferably a monocyclic aryloxy group which may be substituted by halogen atoms.

The amino group represented by $R_{50}$ is preferably an unsubstituted amino group, $C_{1-10}$ alkylamino group or arylamino group which may be substituted by amino groups, halogen atoms, cyano groups, nitro groups, or carboxyl groups.

The hydrazino group represented by $R_{50}$ is preferably an unsubstituted hydrazino group, $C_{1-10}$ alkylhydrazino group or arylhydrazino group which may be substituted by alkyl groups, halogen atoms, cyano groups, nitro groups, amino groups, carbonamido groups, or sulfonamido groups.

The carbamoyl group represented by $R_{50}$ is preferably an unsubstituted carbamoyl group, $C_{1-10}$ alkylcarbamoyl group or arylcarbamoyl group which may be substituted by alkyl groups, halogen atoms, cyano groups, or carboxyl groups.

The oxycarbonyl group represented by $R_{50}$ is preferably a $C_{1-10}$ alkoxycarbonyl group or aryloxycarbonyl group which may be substituted by alkyl groups, halogen atoms, cyano groups, or nitro groups.

When $G_{50}$ is a carbonyl group, preferred groups represented by $R_{50}$ are a hydrogen atom, an alkyl group (e.g., methyl, trifluoromethyl, 3-hydroxypropyl, 3-methanesulfonamidepropyl, phenylsulfonylmethyl), aralkyl group (e.g., o-hydroxybenzyl), aryl group (e.g., phenyl, 3,5-dichlorophenyl, o-methanesulfonamidophenyl, and 4-methanesulfonylphenyl). Particularly preferred among these groups is a hydrogen atom.

When $G_{50}$ is a sulfonyl group, preferred groups represented by $R_{50}$ are an alkyl group (e.g., methyl), aralkyl group (e.g., o-hydroxyphenylmethyl), aryl group (e.g., phenyl), and substituted amino group (e.g., dimethylamino).

When $G_{50}$ is a sulfoxy group, preferred groups represented by $R_{50}$ are a cyanobenzyl group and methylthiobenzyl group. When $G_{50}$ is a

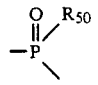

group, preferred groups represented by $R_{50}$ are a methoxy group, ethoxy group, butoxy group, phenoxy group, and phenyl group. Particularly preferred among these groups is a phenoxy group.

When $G_{50}$ is an N-substituted or unsubstituted iminomethylene group, preferred groups represented by $R_{50}$ are a methyl group, ethyl group, and substituted or unsubstituted phenyl group.

Substituents for $R_{50}$ include those set forth for $Y_5$.

The most preferred group represented by $G_{50}$ in formula [V] is a carbonyl group.

$R_{50}$ may be such that the $—G_{50}—R_{50}$ portion is separated from the rest of the molecule to trigger a cyclization reaction producing a cyclic structure a $—G_{50}—R_{50}$ group. Particularly, $R_{50}$ include the groups represented by formula (a):

$$—R_{51}—Z_{51} \quad \text{(a)}$$

wherein $Z_{51}$ represents a group capable of nucleophilic attack on $G_{50}$ to allow $—G_{50}'R_{51}—Z_{51}$ to be separated from the rest of the molecule; and $R_{51}$ represents a group obtained by excluding a hydrogen atom from $R_{50}$, with the proviso that $G_{50}$, $R_{51}$ and $Z_{51}$ can together form a cyclic structure when $Z_{51}$ nucleophilically attacks $G_{50}$.

In particular, $Z_{51}$ is a group which can easily undergo a nucleophilic reaction with $G_{50}$ to allow a $Y_5—N=N$ group to be separated from $G_{50}$ when the hydrazine compound of formula (V) undergoes oxidation or the like to produce the following reaction intermediate product:

$$Y_5—N=N—G_{50}—R_{51}—Z_{51}$$

Specific examples of such a $Z_{51}$ group include a functional group which directly reacts with $G_{50}$, such as —OH, —SH, $—NHR_{52}$ (in which $R_{52}$ represents a hydrogen atom, an alkyl group, aryl group, $—COR_{53}$ or $—SO_2R_{53}$; and $R_{50}$ represents a hydrogen atom, an alkyl group, aryl group or heterocyclic group) or —COOH (wherein —OH, —SH, $—NHR_{52}$ and —COOH may be temporarily protected such that they are produced upon hydrolysis of an alkali) and a functional group which reacts with a nucleophilic agent such as a hydroxyl group or sulfite ion to become reactive with $G_{50}$, such as

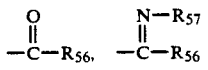

(wherein $R_{56}$ and $R_{57}$ each represents a hydrogen atom, an alkyl group, alkenyl group, aryl group or heterocyclic group).

The ring formed by $G_{50}$, $R_{51}$ and $Z_{51}$ is preferably a 5- or 6-membered ring.

Preferred groups represented by formula (a) are groups represented by formulae (b) and (c):

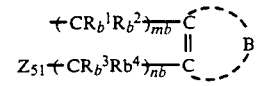

(b)

wherein $R_b^1$ to $R_b^4$ may be the same or different and each represents a hydrogen atom, an alkyl group (preferably $C_{1-12}$), alkenyl group (preferably $C_{2-12}$) or aryl group (preferably $C_{6-12}$); B represents an atomic group necessary for the formation of a 5- or 6-membered ring; and mb and nb each represents an integer 0 or 1, with the proviso that (nb+mb) is 1 or 2.

Examples of the 5- or 6-membered ring formed by B include a cyclohexene ring, cycloheptene ring, benzene ring, naphthalene ring, pyridine ring and quinoline ring.

$Z_{51}$ is as defined in formula (a).

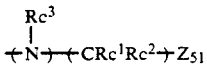

(c)

wherein $Rc^1$ and $Rc^2$ may be the same or different and each represents a hydrogen atom, an alkyl group, alkenyl group, aryl group or halogen atom; $Rc^3$ represents a hydrogen atom, an alkyl group, alkenyl group or aryl group; pc is 0 or 1; and qc is 1 to 4, with the proviso that $Rc^1$, $Rc^2$ and $Rc^3$ may be connected to each other to form a ring as long as $Z_{51}$ has a structure capable of making an intramolecular nucleophilic attack on $G_{50}$.

$Rc^1$ and $Rc^2$ each is preferably a hydrogen atom, halogen atom or alkyl group. $Rc^3$ is preferably an alkyl group or aryl group.

The subscript qc is preferably 1 to 3. When qc is 1, pc is 0 or 1. When qc is 2, pc is 0 or 1. Where qc is 3, pc is 0 or 1. When qc is 2 or 3, $Rc^1$ and $Rc^2$ may be the same or different.

$Z_{51}$ is as defined in formula (a).

$A_{51}$ and $A_{52}$ each represents a hydrogen atom, an alkylsulfonyl or arylsulfonyl group containing 20 or fewer carbon atoms (preferably a phenylsulfonyl group or phenylsulfonyl group which is substituted such that the sum of Hammett's substituent constants is −0.5 or more), an acyl group containing 20 or fewer carbon atoms (preferably a benzoyl group or a benzoyl group which is substituted such that the sum of Hammett's substituent constants is −0.5 or more) or a straight-chain, branched or cyclic unsubstituted or substituted aliphatic acyl group (examples of substituents include a halogen atom, ether group, sulfonamido group, carbonamido group, hydroxyl group, carboxyl group, and sulfonic acid group).

Most preferred among the groups represented by $A_{51}$ and $A_{52}$ is a hydrogen atom.

$Y_5$ and $R_{50}$ in formula (V) may contain a ballast group or polymer chain commonly used in immobile photographic additives such couplers. The ballast group is a group containing 8 or more carbon atoms and relatively inert in photographic properties. This ballast group can be selected from an alkyl group, alkoxy group, phenyl group, alkylphenyl group, phenoxy group, and alkylphenoxy group.

$Y_5$ or $R_{50}$ in formula (V) may contain a group which accelerates adsorption to the surface of silver halide grains. Examples of such an adsorption group include a thiourea group, heterocyclic thioamide group, mercaptoheterocyclic group, and triazole group as described in U.S. Pat. Nos. 4,385,108, and 4,459,347, JP-A-59-195233, JP-A-59-200231,JP-A-59-201045, JP-A-59-201046, JP-A-59-201047, JP-A-59-201048, JP-A-59-201049, JP-A-61-170733, JP-A-61-270744, and JP-A-62-948, and Japanese Patent Application Nos. 62-67508, 62-67501, and 62-67510.

Specific examples of the compound represented by the general formula (V) are as follows, but the present invention is not to be construed as being limited thereto.

V-1

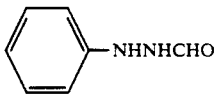

V-2

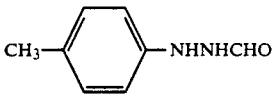

V-3

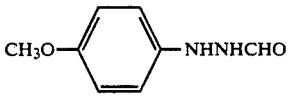

V-4

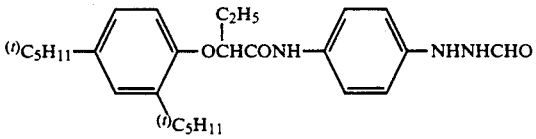

V-5

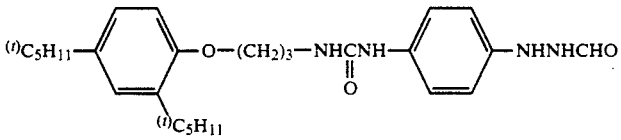

-continued
V-6
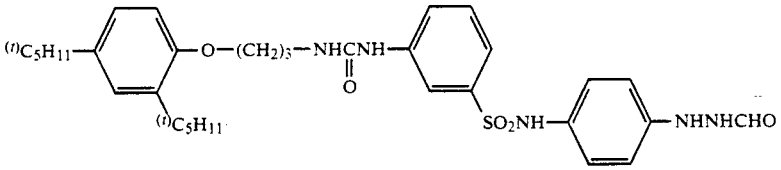
V-7
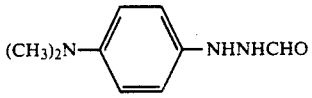
V-8
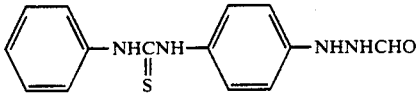
V-9
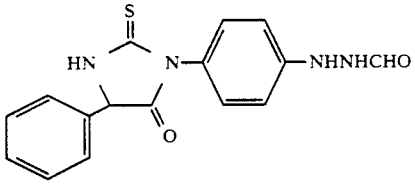
V-10
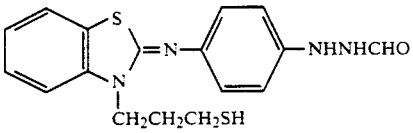
V-11
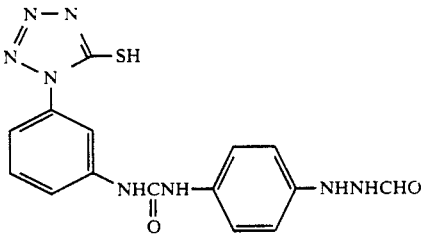
V-12
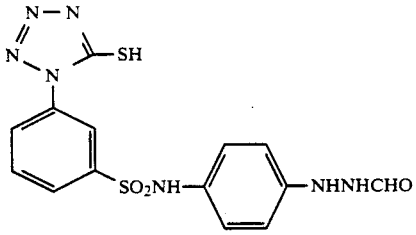
V-13
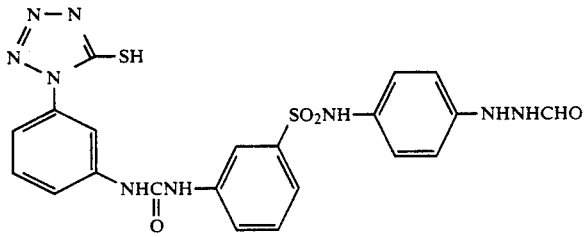

-continued
V-14
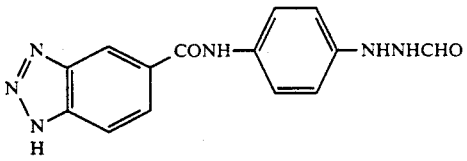
V-15
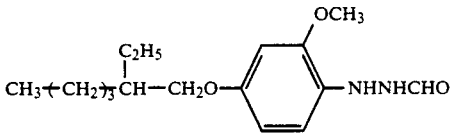
V-16
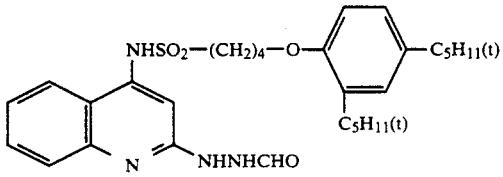
V-17
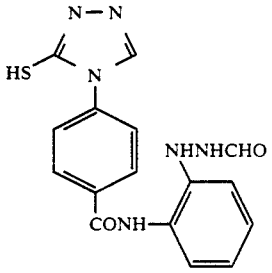
V-18
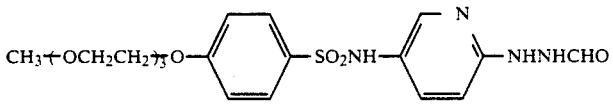
V-19
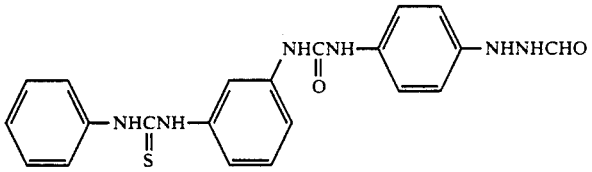
V-20
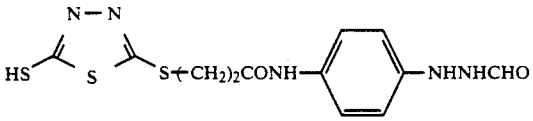
V-21
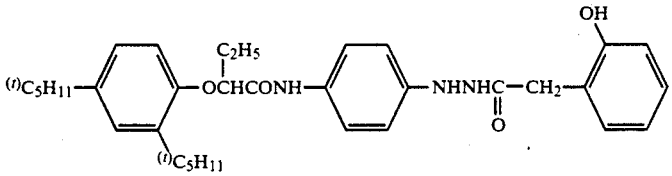
V-22
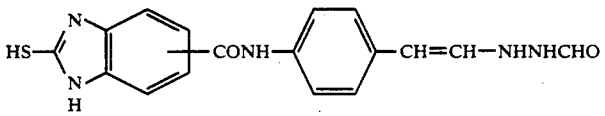
V-23
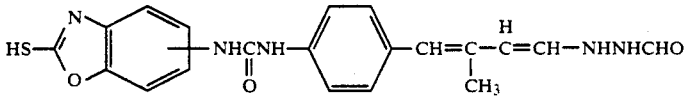

-continued
V-24
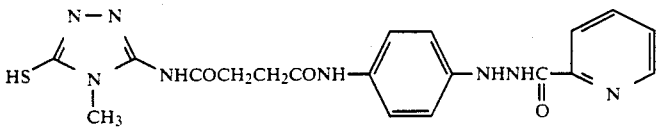
V-25
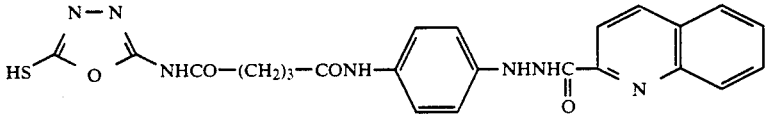
V-26
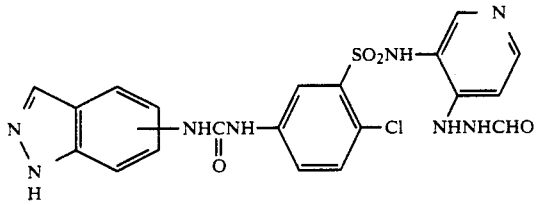
V-27
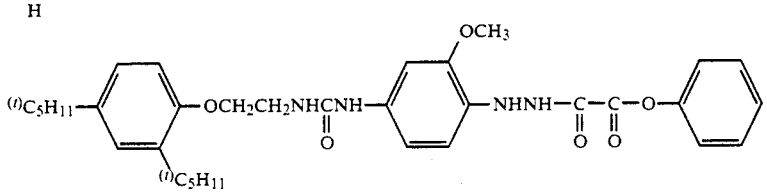
V-28
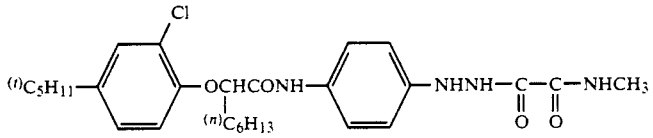
V-29
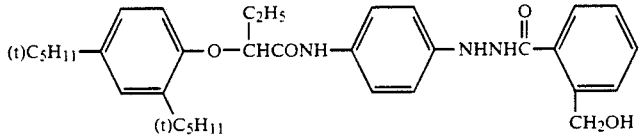
V-30
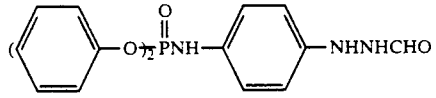
V-31
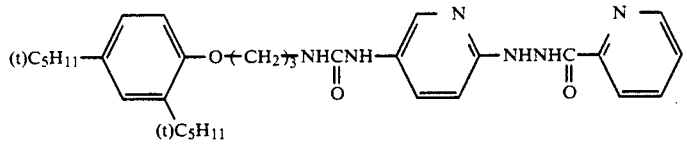
V-32
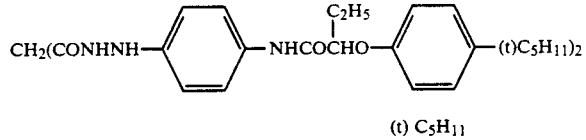
V-33
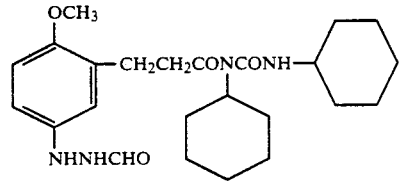

-continued
V-34
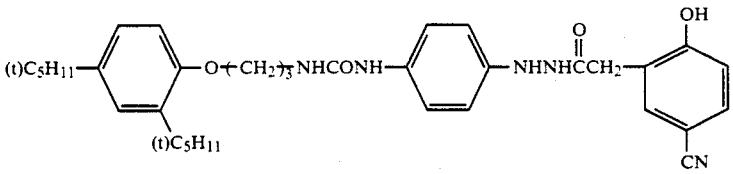
V-35
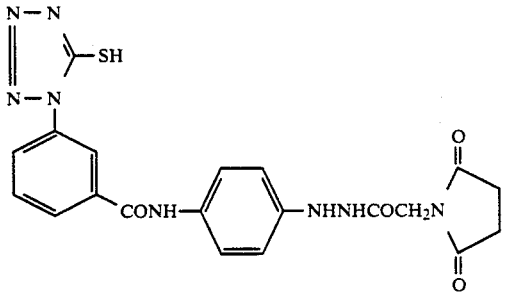
V-36
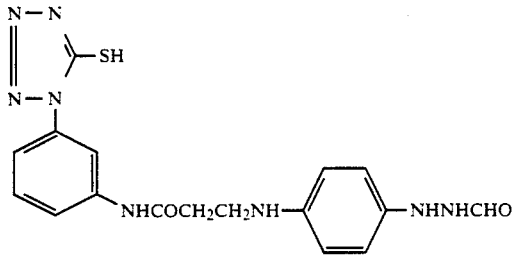
V-37
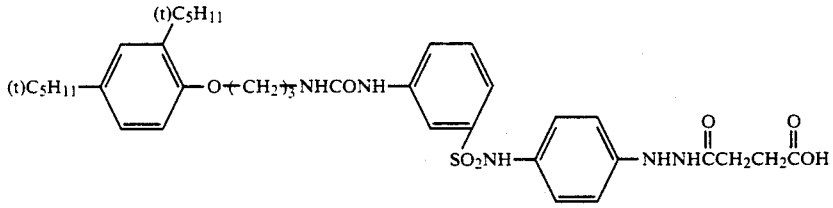
V-38
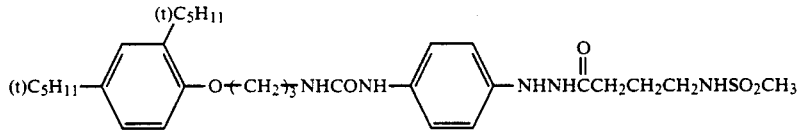
V-39
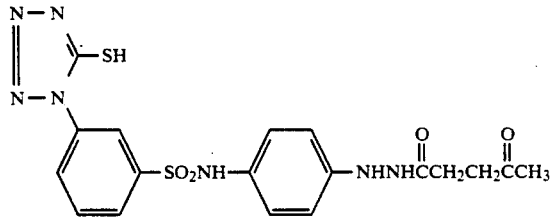
V-40
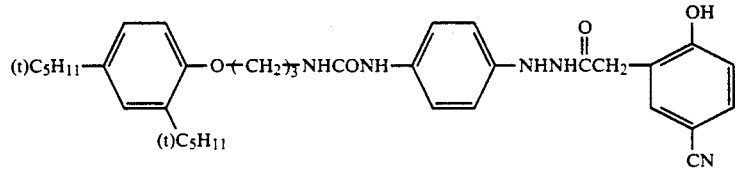

-continued

V-41

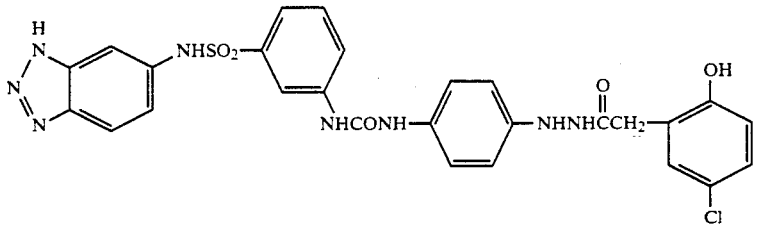

V-42

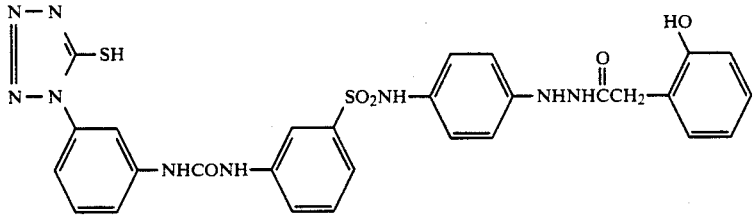

V-43

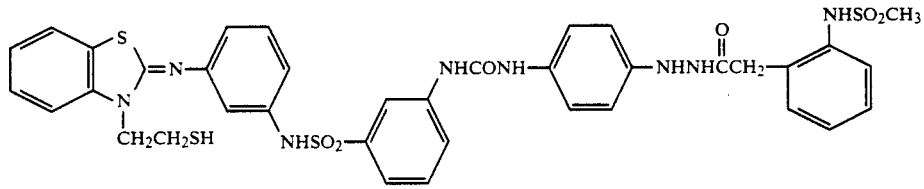

Other examples of the compound of formula (V) which can be used in the present invention include those described in Research Disclosure Item No. 23516, November 1983, p 346, and patents cited therein, U.S. Pat. Nos. 4,080,207, 4,269,929, 4,276,364, 4,278,748, 4,385,108, 4,459,347, 4,560,638, 4,478,928, 4,686,167, and 4,816,373, British Patent 2,011,391B, JP-A-60-179734, JP-A-62-270948, JP-A-63-29751, JP-A-61-170733, JP-A-61-270744, JP-A-62-948, JP-A-62-178246, JP-A-63-234244, JP-A-63-234245,JP-A-63-234246,JP-A-63-294552,JP-A-63-306438, JP-A-64-86134, JP-A-64-90439, JP-A-1-100530, JP-A-1-105235, JP-A-1-105941, JP-A-1-105942, JP-A-1-105943, EP 217310, 301799, and 311009, and Japanese Patent Application Nos.61-175234, 61-251482, 61- 268249, 61-276283, 62-67528, 62-67509, 62-67510, 62-58513, 62-130819, 62-143467, 62-166117, 62-166117, 62-247478, 63-105682, 63-114118, 63-110051, 63-114119, 63-116239, 63-147339, 63-179760, 63-229163, 1-18377, 1-18378, 1-18379, 1-15755, 1-16814, 1-40792, 1-42615, and 1-42616.

In the present invention, when the compound represented by formula [V] is incorporated in a photographic light-sensitive material, it is preferably incorporated in a silver halide emulsion layer but may be incorporated in other light-insensitive hydrophilic colloid layers (e.g., protective layer, intermediate layer, filter layer, antihalation layer). In particular, if the compound used is water-soluble, it may be incorporated in a hydrophilic colloid solution in the form of an aqueous solution. If the compound to be used is difficultly water-soluble, it may be incorporated in a hydrophilic colloid solution in the form of a solution in an organic solvent miscible with water such as alcohol, ester, or ketone. The incorporation of the compound of formula [V] in the silver halide emulsion layer may be effected at any time between the beginning of chemical ripening and the coating, preferably between the end of chemical ripening and before coating. In particular, the present compound is preferably incorporated in a coating solution prepared for coating.

The amount of the compound of formula [V] incorporated in the photographic light-sensitive material is selected depending on grain diameter, halogen composition and the chemical sensitization process for the silver halide emulsion, the relationship between the layer in which the compound is incorporated and the silver halide emulsion layer, and the type of fog inhibiting compound. Those skilled in the art can easily select the amount of such a compound to be incorporated. The amount of the compound represented by formula (V) is normally in the range of $1\times10^{-6}$ to $1\times10^{-1}$ mol, particularly $10^{-5}$ to $4\times10^{-2}$ mol per mol of silver halide.

(3) The present compound of formula [I] can be applied to a multilayer multicolor photographic material having at least two different spectral sensitivities on a support for the purpose of improving graininess, sharpness and color reproducibility and increasing sensitivity. A multilayer natural color photographic material normally has at least one red-sensitive emulsion layer, one green-sensitive emulsion layer and one blue-sensitive emulsion layer on a support. The order of arrangement of these layers can be optionally selected as necessary. In a preferred order, a red-sensitive emulsion layer, a green-sensitive emulsion layer and a blue-sensitive emulsion layer are arranged in this order form the support. In another preferred order, a blue-sensitive emulsion layer, a red-sensitive emulsion layer and a green-sensitive emulsion layer are arranged in this order from the support. Each of these emulsion layers may consist of two or more emulsion layers having different sensitivities. A light-insensitive layer may be present interposed between two or more emulsion layers having the same sensitivity. In general, the red-sensitive emulsion layer contain a cyan-forming coupler, the green-sensitive emulsion layer contains a magenta-forming coupler and the blue-sensitive emulsion layer contains a yellow-forming coupler. A different combination can be optionally used.

The compound represented by formula (I) can be used in combination with a coupler. In particular, the present compound can be incorporated in the same emulsion layer with the coupler or incorporated in an auxiliary photographic layer such as an intermediate layer in the form of an independent emulsion dispersion.

The compound of formula (I) is preferably used in an amount of 0.1 to 50 mol %, preferably 0.3 to 15 mol % based on the amount of coupler in each light-sensitive material such as a yellow coupler for a blue-sensitive emulsion layer, a magenta coupler for a green-sensitive emulsion layer or a cyan coupler for a red-sensitive emulsion layer in a color light-sensitive material. The compound of formula (I) is also preferably used in an amount of from about $1\times10^{-5}$ to $8\times10^{-2}$ mol, particularly $1\times10^{-4}$ to $5\times10^{-2}$ mol per mol of silver halide in the layer in which it is incorporated.

(4) The compound of formula [I] is effective for the improvement of photographic properties, e.g., sharpness, of a black-and-white photographic light-sensitive material having on one side or both sides of a support a silver bromoiodide or silver bromochloroiodide emulsion layer containing 0 to 50 mol % of silver chloride and 15 mol % or less of silver iodide, particularly an X-ray-sensitive material. In this case, the amount of the compound of formula [I] used is preferably in the range of from about $1\times10^{-6}$ to $1\times10^{-1}$ mol, particularly $1\times10^{-5}$ to $5\times10^{-2}$ mol per mol of silver halide.

(5) The compound of formula [I] can be advantageously used in a color diffusion transfer process as a highly active and efficient dye-donating substance.

The compound of formula [I] can also be applied to photographic light-sensitive materials for various usages, such as light-sensitive materials for exposure by electron beams, high resolution black-and-white light-sensitive materials, diffusion transfer black-and-white light-sensitive materials, color X-ray light-sensitive materials, and heat-developable light-sensitive materials (including color light-sensitive materials).

The present invention is now further described in greater detail with reference to the following examples, but the present invention is not to be construed as being limited thereto. Unless otherwise indicated, all parts, percents and ratios are by weight.

The preparation of emulsions and the composition of processing solutions used in Examples 1 to 3 is collectively described below.

Preparation of Emulsion (A)

An aqueous solution of silver nitrate and an aqueous solution of potassium iodide and potassium bromide were simultaneously added to an aqueous solution of gelatin which had been kept at a temperature of 50° C. in a double jet process while the pAg thereof was kept at 7.5 to prepare a highly monodisperse silver bromoiodide emulsion. The silver bromoiodide grains thus obtained were cubic and had a mean grain size of 0.26 μm and a silver iodide content of 2 mol %.

The emulsion was then washed with water in a usual manner to remove soluble salts. The emulsion was then subjected to chemical sensitization with sodium thiosulfate.

Preparation of Emulsion (B)

A monodisperse silver bromochloride emulsion was prepared in the same manner as in Emulsion (A) except that the admixture of an aqueous solution of silver nitrate and an aqueous solution of silver halide was effected at a temperature of 60° C. in the presence of potassium hexachloroiridiumate (III) in an amount of $4\times10^{-7}$ mol per mol of silver. The emulsion thus prepared was then washed with water and subjected to chemical sensitization in the same manner as in Emulsion (A). The silver bromochloride grains thus prepared were cubic and had a mean grain size of 0.28 μm and a silver chloride content of 30 mol %.

Preparation of Emulsion (C)

An aqueous solution of silver nitrate and an aqueous solution of silver halide were simultaneously added to an aqueous solution of gelatin which had been kept at a temperature of 50° C. in a double jet process while the pAg thereof was kept at 7.8 to prepare a monodisperse silver bromochloride emulsion. The emulsion was then subjected to sedimentation and washed with water in a usual manner to remove soluble salts. The emulsion was then subjected to chemical sensitization with sodium thiosulfate in the same manner as in Emulsion (A). The silver bromochloride grains thus obtained were cubic and had a mean grain size of 0.30 μm and a silver bromide content of 30 mol %.

Preparation of Emulsion (D)

A monodisperse silver bromochloride emulsion (mean grain size: 0.30 μm; silver bromide: 30 mol %) was prepared in the same manner as Emulsion (C) except that the admixture of an aqueous solution of silver nitrate and an aqueous solution of silver halide was effected in the presence of rhodium ammonium chloride in an amount of $5\times10^{-6}$ mol per mol of silver to form silver bromochloride grains. The emulsion thus prepared was then washed with water in the same manner as in Emulsion (C) and subjected to chemical sensitization with sodium thiosulfate and potassium chloroaurate.

| Composition of Developing Solution (E) | |
|---|---|
| Hydroquinone | 40.0 g |
| 4,4-Dimethyl-1-phenyl-3-pyrazolidone | 0.4 g |
| Sodium sulfite anhydride | 75.0 g |
| Sodium hydrogencarbonate | 7.0 g |
| Disodium ethylenediaminetetraacetate | 1.0 g |
| Potassium bromide | 6.0 g |
| 5-Methyl-benzotriazole | 0.6 g |
| Water to make | 1 liter |
| pH adjusted with potassium hydroxide to | 12.0 |
| **Composition of Developing Solution (F)** | |
| Hydroquinone | 40.0 g |
| 4,4-Dimethyl-1-phenyl-3-pyrazolidone | 0.4 g |
| Sodium hydroxide | 13.0 g |
| Sodium sulfite anhydride | 90.0 g |
| Tribasic potassium phosphate | 74.0 g |
| Disodium ethylenediaminetetraacetate | 1.0 g |
| Potassium bromide | 6.0 g |
| 5-Methylbenzotriazole | 0.6 g |
| 1-Diethylamino-2,3-dihydroxypropane | 17.0 g |
| Water to make | 1 liter |
| pH adjusted with potassium hydroxide to | 11.4 |

EXAMPLE 1

4-Hydroxy-6-methyl-1,3,3a,7-tetrazaindene, a dispersion of polyethyl acrylate, polyethylene glycol (mean molecular weight: 1,000), 1,3-bisvinylsulfonyl-2- propanol, Sensitizing Dye (a) and Compound V-5 of formula [V] were added to Emulsion (D). The compounds of formula [I] shown in Table 1 were then added to the mixture. The emulsion was then coated on a polyethyleneterephthalate film in such an amount that the coated silver amount and coated gelatin amount were 3.50 g/m$^2$ and 2.00 g/m$^2$, respectively. At the same time, an aqueous solution containing gelatin as a main component and as coating aids a surface active agent and thickening agent was coated on the remote side of the support in such an amount that the coated gelatin amount was 1.10 g/m$^2$ to prepare Specimens 101 to 112. Specimens 113 to 117 were prepared in the same manner as described above except that the compounds of formula [I] were replaced by Comparative Compounds (b) to (g), respectively.

The film specimens thus prepared were exposed to light through an optical wedge for sensitometry and Gray Scanner Negative Contact Screen No. 2-150L (Dainippon Screen Mfg., Co., Ltd.), developed with Developing Solution (E) at a temperature of 38°0 C. for 30 seconds, fixed, washed with water, and then dried.

The results are set forth in Table 1.

Sensitizing Dye (a)

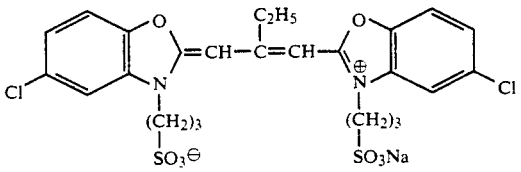

Comparative Compound (b)

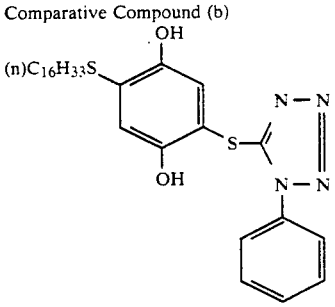

Comparative Compound (c)

-continued

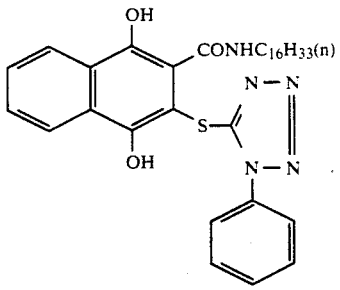

Comparative Compound (d)

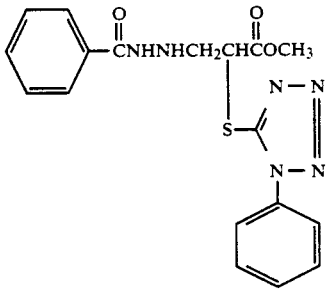

Comparative Compound (e)

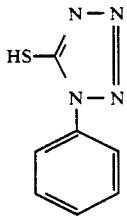

Comparative Compound (f)

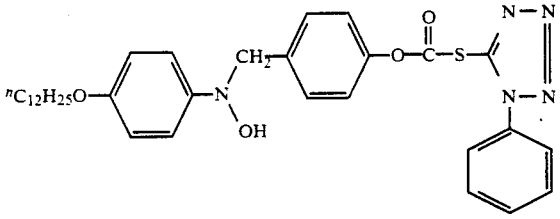

TABLE 1

| Specimen | Emulsion | Compound of Formula (V) | Processing Solution | Compound of Formula (I) Structure | Compound of Formula (I) Added Amount | Results Halftone Quality | Results Halftone Gradation | Remarks |
|---|---|---|---|---|---|---|---|---|
| 101 | D | V-5 | E | — | — | 4 | 1.19 | Present Invention |
| 102 | " | " | " | 1 | 4.0 × 10$^{-3}$ mol/mol-Ag | 5 | 1.28 | Present Invention |
| 103 | " | " | " | 2 | " | 5 | 1.26 | Present Invention |
| 104 | " | " | " | 4 | 3.0 × 10$^{-3}$ mol/mol-Ag | 4.5 | 1.44 | Present Invention |
| 105 | " | " | " | 5 | 3.0 × 10$^{-3}$ mol/mol-Ag | 4.5 | 1.38 | Present Invention |
| 106 | " | " | " | 6 | 4.0 × 10$^{-3}$ mol/mol-Ag | 4.5 | 1.36 | Present Invention |
| 107 | " | " | " | 7 | " | 4.5 | 1.30 | Present Invention |
| 108 | " | " | " | 14 | 3.0 × 10$^{-3}$ mol/mol-Ag | 5 | 1.33 | Present Invention |
| 109 | " | " | " | 27 | 4.0 × 10$^{-3}$ mol/mol-Ag | 4.5 | 1.27 | Present Invention |
| 110 | " | " | " | 28 | 3.0 × 10$^{-3}$ mol/mol-Ag | 4.5 | 1.41 | Present Invention |

TABLE 1-continued

| Specimen | Emulsion | Compound of Formula (V) | Processing Solution | Compound of Formula (I) Structure | Compound of Formula (I) Added Amount | Results Halftone Quality | Results Halftone Gradation | Remarks |
|---|---|---|---|---|---|---|---|---|
| 111 | " | " | " | 30 | $4.0 \times 10^{-3}$ mol/mol-Ag | 5 | 1.32 | Present Invention |
| 112 | " | " | " | 31 | $3.0 \times 10^{-3}$ mol/mol-Ag | 5 | 1.35 | Present Invention |
| 113 | " | " | " | (b) | $4.0 \times 10^{-3}$ mol/mol-Ag | 4.0 | 1.20 | Comparative |
| 114 | " | " | " | (c) | " | 3.0 | 1.25 | " |
| 115 | " | " | " | (d) | " | 4.0 | 1.20 | " |
| 116 | " | " | " | (e) | " | 3.0 | 1.18 | " |
| 117 | " | " | " | (f) | " | 4.0 | 1.25 | " |

In Table 1, the halftone quality is visually evaluated in 5 steps. Step "5" indicates the best halftone quality, and Step "1" indicates the poorest halftone quality. Step "5" and Step "4" are practicable for halftone original for use in plate making process. Step "4.5" indicates a halftone quality in between "4" and "5".

The halftone gradation is represented by the difference between the log exposure producing 5 % and 95 of blackened area in the halftone image. The greater this value, the softer is the halftone gradation.

As shown in Table 1, the use of the compounds represented by formula [I] made it possible to provide a higher halftone quality and a softer halftone gradation than the use of comparative compounds.

EXAMPLE 2

4-Hydroxy-6-methyl-1,3,3a,7-tetrazaindene, a dispersion of polyethyl acrylate, polyethylene glycol (mean molecular weight: 1,000), 1,3-bisvinylsulfonyl-2-propanol, Sensitizing Dye (a) (set forth in Table 2—1) or Sensitizing Dye (a') (set forth in Table 2—2), Compounds of formula [V] set forth in Tables 2—1 and 2—2, and potassium iodide were added to Emulsion (A). The compounds of formula [I] shown in Tables 2—1 and 2—2 were then added to the mixture. The emulsion was then coated on a polyethyleneterephthalate film in such an amount that the coated silver amount and coated gelatin amount were 3.50 g/m$^2$ and 2 00 g/m$^2$, respectively. At the same time, an aqueous solution containing gelatin as a main component and coating aids such as surface active agent and thickening agent was coated on the remote side of the support in such an amount that the coated gelatin amount was 1.10 g/m$^2$ to prepare Specimens 201 to 209.

The film specimens thus prepared were exposed to light through an optical wedge for sensitometry and Gray Scanner Negative Contact Screen No. 2-150L (Dainippon Screen Mfg., Co., Ltd.), developed with Developing Solution (E) at a temperature of 38° C. for 30 seconds, fixed, washed with water, and then dried.

The results are set forth in Tables 2—1 and 2—2.

Sensitizing Dye (a)

Same as used in Example 1

Sensitizing Dye (a')

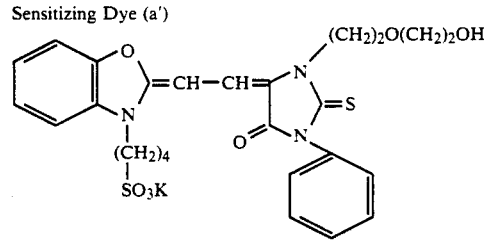

TABLE 2

| Specimen | Emulsion | Compound of Formula (V) | Processing Solution | Compound of Formula (I) Structure | Compound of Formula (I) Added Amount | Results Halftone Quality | Results Halftone Gradation | Remarks |
|---|---|---|---|---|---|---|---|---|
| 201 | A | V-5 | E | — | — | 4 | 1.16 | Comparative |
| 202 | " | " | " | 1 | $4.0 \times 10^{-3}$ mol/mol-Ag | 5 | 1.31 | Present Invention |
| 203 | " | " | " | " | $8.0 \times 10^{-3}$ mol/mol-Ag | 5 | 1.37 | Present Invention |
| 204 | " | " | " | 2 | $2.0 \times 10^{-3}$ mol/mol-Ag | 5 | 1.42 | Present Invention |
| 205 | " | " | " | " | $4.0 \times 10^{-3}$ mol/mol-Ag | 4.5 | 1.44 | Present Invention |
| 206 | " | " | " | 27 | $2.0 \times 10^{-3}$ mol/mol-Ag | 5 | 1.33 | Present Invention |
| 207 | " | " | " | " | $4.0 \times 10^{-3}$ mol/mol-Ag | 4.5 | 1.38 | Present Invention |
| 208 | " | V-11 | " | — | — | 4 | 1.13 | Comparative |
| 209 | " | " | " | 2 | $2.0 \times 10^{-3}$ mol/mol-Ag | 5 | 1.45 | Present Invention |
| 201 | A | V-5 | F | — | — | 4 | 1.11 | Comparative |
| 202 | " | " | " | 1 | $4.0 \times 10^{-3}$ mol/mol-Ag | 5.0 | 1.38 | Present Invention |
| 203 | " | " | " | 2 | $2.0 \times 10^{-3}$ mol/mol-Ag | 5.0 | 1.41 | Present Invention |
| 204 | " | " | " | 24 | " | 5.0 | 1.38 | Present Invention |
| 208 | " | V-11 | " | — | — | 4 | 1.09 | Comparative |
| 209 | " | " | " | 2 | $2.0 \times 10^{-3}$ mol/mol-Ag | 4.5 | 1.42 | Present |

TABLE 2-continued

| Specimen | Emulsion | Compound of Formula (V) | Processing Solution | Compound of Formula (I) Structure | Compound of Formula (I) Added Amount | Results Halftone Quality | Results Halftone Gradation | Remarks |
|---|---|---|---|---|---|---|---|---|
| | | | | | | | | Invention |

As described in Example 1, the value of halftone gradation indicated in Tables 2—1 and 2—2 is represented by the difference between the log exposure giving 5% and 95% blackened area in the halftone image. The greater the value, the softer is the halftone gradation.

As shown in Tables 2—1 and 2—2, the use of the compounds of formula [I] made it possible to obtain a softer halftone gradation than the absence of the present compounds. The comparison between Example 1 and Example 2 shows that the effect of softer halftone gradation giver by the present compounds depends somewhat on the emulsion composition and the type of nucleating agent and processing solution used but is remarkable in either case.

EXAMPLE 3

Specimens 301 to 310 were prepared in the same manner as in Example 1 by using Emulsion (B) or Emulsion (C), Sensitizing Dye (a) and Compound V-5 of the general formula [V]. These specimens were then exposed to light in the same manner as in Example 1, developed with Developing Solution (E) at a temperature of 38° C. for 30 seconds, fixed, washed with water, and dried.

The results are set forth in Table 3.

As shown in Example 1, the value of halftone gradation indicated in Table 3 is represented by the difference between the log exposure giving 5% and 95% of blackened area in the halftone image.

Table 3 shows that the use of the present compounds of the general formula [I] provided remarkably softer halftone gradation regardless of the halogen composition of silver bromochloride emulsion.

film support provided with a subbing layer thereon. The support was prepared by the method described in JP-A-62- 115035.

The coated amount is represented in terms of coated amount of silver.

Specimen 401

| | | |
|---|---|---|
| (1) | Emulsion layer | |
| | Gelatin layer containing: | 1.6 g/m$^2$ |
| | Negative type silver bromoiodide emulsion (silver iodide content: 5 mol %; mean grain size: 0.6 μm) | |
| | Coupler C-0 (described later) | 0.9 g/m$^2$ |
| | Present compound (1) | 0.009 g/m$^2$ |
| | Tricresyl phosphate | 0.6 g/m$^2$ |
| (2) | Protective layer | |
| | Gelatin | 2.5 g/m$^2$ |
| | 2,4-Dichloro-6-hydroxy-s-triazine sodium | 0.13 gm$^2$ |

Specimens 402 to 405

Specimens 402 and 403 were prepared in the same manner as Specimen 401 except that Present Compound (1) was replaced by Present Compounds (2) and (27) in the equimolar amounts, respectively.

Specimens 404 and 405 were prepared in the same manner as in Specimen 401 except that Present Compound (1) was replaced by Comparative Compounds (b) and (c) in the equimolar amounts, respectively.

One group of these specimens was subjected to the forced deterioration condition at a temperature of 45° C. and a relative humidity of 80% over 3 days (Condition B), and another group was not subjected to such a condition (Condition A). The two groups of specimens

TABLE 3

| Specimen | Emulsion | Compound of Formula (V) | Processing Solution | Compound of Formula (I) Structure | Compound of Formula (I) Added Amount | Results Halftone Quality | Results Halftone Gradation | Remarks |
|---|---|---|---|---|---|---|---|---|
| 301 | B | V-5 | E | — | — | 4.0 | 1.20 | Comparative |
| 302 | " | " | " | 1 | $4.0 \times 10^{-3}$ mol/mol-Ag | 5 | 1.36 | Present Invention |
| 303 | " | " | " | 2 | $2.0 \times 10^{-3}$ mol/mol-Ag | 5 | 1.48 | Present Invention |
| 304 | " | " | " | 27 | $4.0 \times 10^{-3}$ mol/mol-Ag | 5 | 1.39 | Present Invention |
| 305 | " | " | " | 31 | $2.0 \times 10^{-3}$ mol/mol-Ag | 5 | 1.49 | Present Invention |
| 306 | " | " | " | — | — | 4.0 | 1.19 | Comparative |
| 307 | " | " | " | 1 | $4.0 \times 10^{-3}$ mol/mol-Ag | 5 | 1.38 | Present Invention |
| 308 | " | " | " | 2 | $2.0 \times 10^{-3}$ mol/mol-Ag | 5 | 1.49 | Present Invention |
| 309 | " | " | " | 27 | $4.0 \times 10^{-3}$ mol/mol-Ag | 5 | 1.27 | Present Invention |
| 310 | " | " | " | 31 | $2.0 \times 10^{-3}$ mol/mol-Ag | 5 | 1.48 | Present Invention |

EXAMPLE 4

In order to evaluate the effectuality of the compounds of this invention, Multilayer Color Light-Sensitive Material Specimen 401 was prepared by coating the following layer compositions on a cellulose triacetate were then imagewise exposed to light for sensitometry, and subjected to the following color development. The specimens thus developed were then measured through a red filter for density. The results of photographic properties are set forth in Table 4. The processing was at a temperature of 38° C. in the following manner.

| | | |
|---|---|---|
| 1. Color Development | 3 min. | 15 sec. |
| 2. Bleach | 6 min. | 30 sec. |
| 3. Rinse | 3 min. | 15 sec. |
| 4. Fixing | 6 min. | 30 sec. |
| 5. Rinse | 3 min. | 15 sec. |
| 6. Stabilization | 3 min. | 15 sec. |

The composition of the processing solutions used in the various steps was as follows.

| | |
|---|---|
| Color Developing Solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-ethyl-N-β-hydroxyethylamino)-2-methylaniline sulfate | 4.5 g |
| Water to make | 1 liter |
| Bleaching Solution | |
| Ammonium bromide | 160.0 g |
| Aqueous ammonia (28%) | 25.0 cc |
| Sodium iron ethylenediaminetetraacetate | 130.0 g |
| Glacial acetic acid | 14.0 cc |
| Water to make | 1 liter |
| Fixing Solution | |
| Sodium tetrapolyphosphate | 2.0 g |
| Sodium sulfite | 4.0 g |
| Ammonium thiosulfate (70%) | 175.0 cc |
| Sodium bisulfite | 4.6 g |
| Water to make | 1 liter |
| Stabilizing Solution | |
| Formalin | 8.0 cc |
| Water to make | 1 liter |

TABLE 4

| | | Condition A | | | Condition B | | |
|---|---|---|---|---|---|---|---|
| Specimen | Compound | Fog | Relative Sensitivity | Gamma | Fog | Relative Sensitivity | Gamma |
| 401 | (1) | 0.07 | 100 | 0.81 | 0.07 | 98 | 0.80 |
| 402 | (2) | 0.07 | 97 | 0.82 | 0.07 | 96 | 0.81 |
| 403 | (27) | 0.07 | 108 | 0.83 | 0.07 | 107 | 0.82 |
| 404 | (b) | 0.07 | 110 | 0.84 | 0.06 | 93 | 0.78 |
| 405 | (c) | 0.07 | 95 | 0.82 | 0.06 | 80 | 0.76 |

Note:
Relative sensitivity: Reciprocal of the exposure giving a density of (fog + 0.2) relative to that of Specimen 401 measured under Condition A as 100. Gamma: Slope of the straight line between the point of a density (fog + 0.2) and the point of a density (fog + 1.2).

Coupler (C-0)

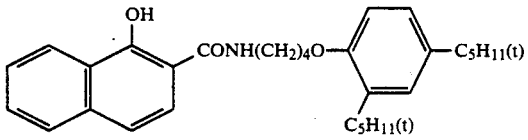

Table 4 shows that Specimens 401 to 403 containing the present compounds were little changed in photographic properties between and after forced deterioration, as compared to the specimens containing comparative compounds.

EXAMPLE 5

Multilayer Color Light-Sensitive Material 501 was prepared by coating the following layer compositions on a transparent triacetyl cellulose film support which had been prepared by a solvent casting process.

| | |
|---|---|
| **1st Layer: Antihalation Layer** | |
| Gelatin layer containing: | |
| Black colloidal silver | 0.15 g/m$^2$ |
| Ultraviolet absorbent U-1 | 0.08 g/m$^2$ |
| Ultraviolet absorbent U-2 | 0.12 g/m$^2$ |
| **2nd Layer: Intermediate Layer** | |
| Gelatin layer containing: | |
| 2,5-Di-t-pentadecyl hydroquinone | 0.18 g/m$^2$ |
| Coupler C-1 | 0.11 g/m$^2$ |
| **3rd Layer: 1st Red-Sensitive Emulsion Layer** | |
| Gelatin layer containing: | |
| Silver bromoiodide (silver iodide: 4 mol %; mean grain size: 0.4 μm) | 1.2 g/m$^2$ |
| Sensitizing dye I | 1.4 × 10$^{-4}$ mol per mol of silver |
| Sensitizing dye II | 0.4 × 10$^{-4}$ mol per mol of silver |
| Sensitizing dye III | 5.6 × 10$^{-4}$ mol per mol of silver |
| Sensitizing dye IV | 4.0 × 10$^{-4}$ mol per mol of silver |
| Coupler C-2 | 0.45 g/m$^2$ |
| Coupler C-3 | 0.025 g/m$^2$ |
| Coupler C-4 | 0.025 g/m$^2$ |
| **4th Layer: 2nd Red-Sensitive Emulsion Layer** | |
| Gelatin layer containing: | |
| Silver bromoiodide emulsion (silver iodide content: 8 mol %; mean grain size: 0.8 μm) | 1.0 g/m$^2$ |
| Sensitizing dye I | 5.2 × 10$^{-5}$ mol per mol of silver |
| Sensitizing dye II | 1.5 × 10$^{-5}$ mol per mol of silver |
| Sensitizing dye III | 2.1 × 10$^{-4}$ mol per mol of silver |
| Sensitizing dye IV | 1.5 × 10$^{-5}$ mol per mol of silver |
| Coupler C-2 | 0.050 g/m$^2$ |
| Coupler C-5 | 0.070 g/m$^2$ |
| Coupler C-3 | 0.035 g/m$^2$ |
| **5th Layer: Intermediate Layer** | |
| Gelatin layer containing: | |
| 2,5-Di-1-pentadecyl hydroquinone | 0.08 g/m$^2$ |
| **6th Layer: 1st Green-Sensitive Emulsion Layer** | |
| Gelatin layer containing: | |
| Silver bromoiodide (silver iodide content: 4 mol %; mean grain size: 0.4 μm) | 0.80 g/m$^2$ |
| Sensitizing dye V | 4.0 × 10$^{-4}$ mol per mol of silver |
| Sensitizing dye VI | 3.0 × 10$^{-5}$ mol per mol of silver |
| Sensitizing dye VII | 1.0 × 10$^{-4}$ mol per mol of silver |
| Coupler C-6 | 0.45 g/m$^2$ |
| Coupler C-7 | 0.13 g/m$^2$ |
| Coupler C-8 | 0.02 g/m$^2$ |
| Coupler C-4 | 0.04 g/m$^2$ |
| **7th Layer: 2nd Green-Sensitive Emulsion Layer** | |
| Silver bromoiodide (silver iodide content: 8 mol %; mean grain size: 0.8 μm) | 0.85 g/m$^2$ |
| Sensitizing dye V | 2.7 × 10$^{-4}$ mol |

-continued

| | |
|---|---|
| | per mol of silver |
| Sensitizing dye VI | $1.8 \times 10^{-5}$ mol per mol of silver |
| Sensitizing dye VII | $7.5 \times 10^{-5}$ mol per mol of silver |
| Coupler C-6 | 0.095 g/m$^2$ mol per mol of silver |
| Coupler C-7 | 0.015 g/m$^2$ mol per mol of silver |

8th Layer: Yellow Filter Layer

| | |
|---|---|
| Gelatin containing: | |
| Yellow Colloidal Silver | 0.08 g/m$^2$ |
| 2,5-Di-t-pentadecyl hydroquinone | 0.090 g/m$^2$ |

9th Layer: 1st Blue-Sensitive Emulsion Layer

| | |
|---|---|
| Silver bromoiodide emulsion (silver iodide content: 5 mol %; mean grain size: 0.3 μm) | 0.37 g/m$^2$ |
| Sensitizing dye VIII | $4.4 \times 10^{-4}$ mol per mol of silver |
| Coupler C-9 | 0.71 g/m$^2$ |
| Coupler C-4 | 0.07 g/m$^2$ |

10th Layer: 2nd Blue-Sensitive Emulsion Layer

| | |
|---|---|
| Gelatin layer containing: | |
| Silver Bromoiodide Emulsion (silver iodide content: 7 mol %; mean grain size: 0.9 μm) | 0.55 g/m$^2$ |
| Sensitizing dye VIII | $3.0 \times 10^{-4}$ mol per mol of silver |
| Coupler C-9 | 0.23 g/m$^2$ |

11th Layer: 1st Protective Layer

| | |
|---|---|
| Gelatin layer containing: | |
| Ultraviolet absorbent U-1 | 0.14 g/m$^2$ |
| Ultraviolet absorbent U-2 | 0.22 g/m$^2$ |

12th Layer: 2nd Protective Layer

| | |
|---|---|
| Gelatin layer containing: | |
| Silver bromoiodide emulsion (silver iodide content: 2 mol %; mean grain size: 0.07 μm) | 0.25 g/m$^2$ |
| Polymethacrylate grain (grain diameter: 1.5 μm) | 0.10 g/m$^2$ |

In addition to the above described compositions, Gelatin Hardener H-1 and a surface active agent were coated on each of these layers.

The chemical structure of the compounds used in this example will be set forth below.

U-4

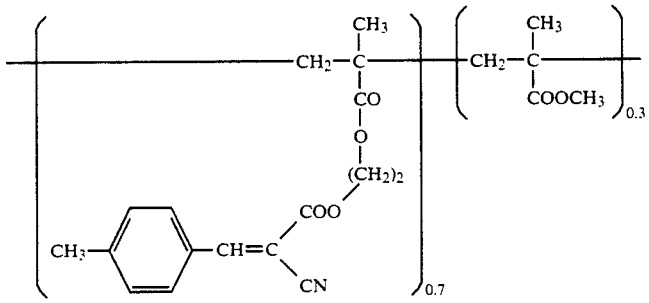

C-1

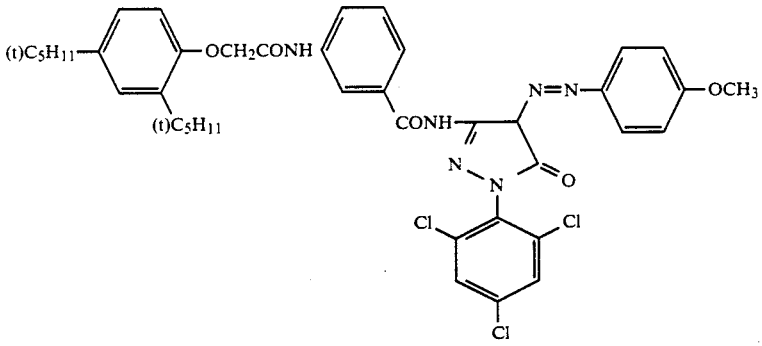

U-2

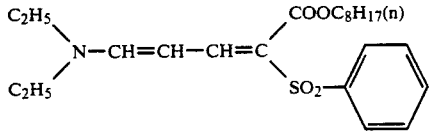

C-2

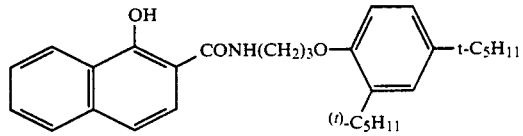

-continued
C-3
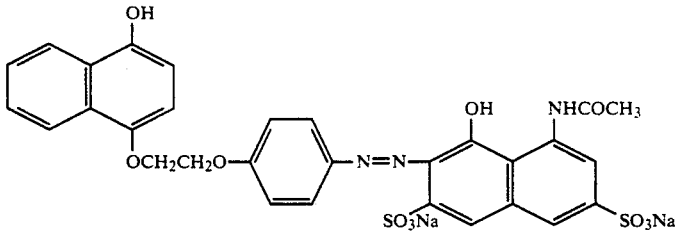
C-4
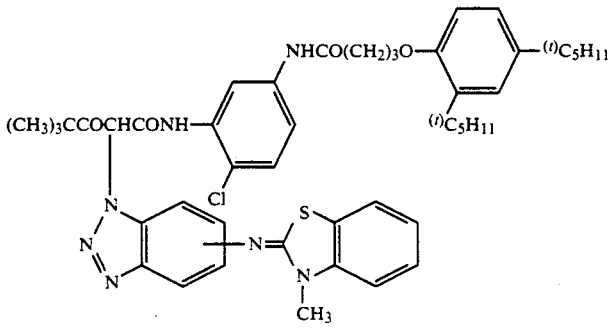
C-5
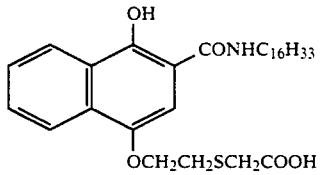
C-6
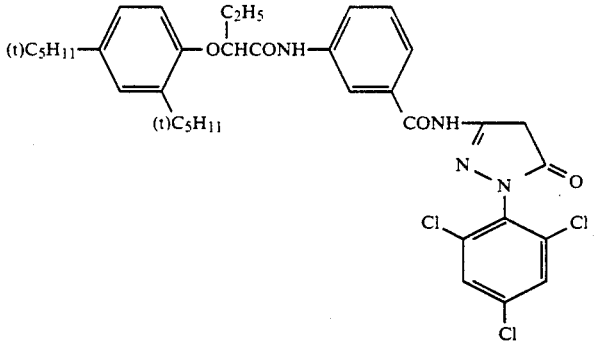
C-7
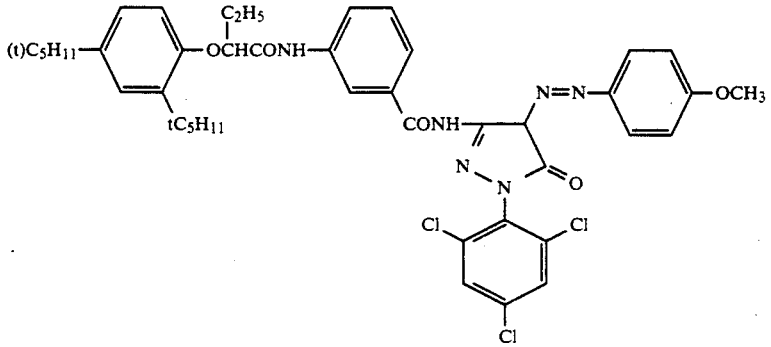

-continued
C-8
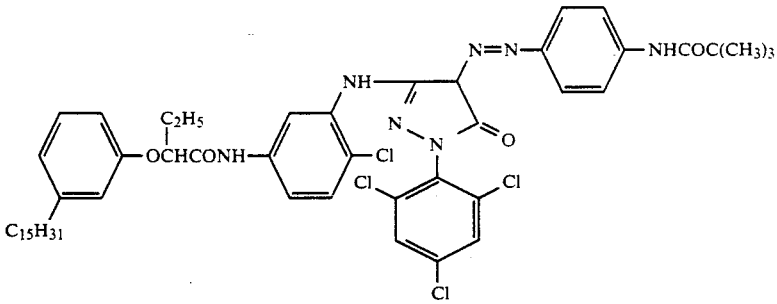
C-9
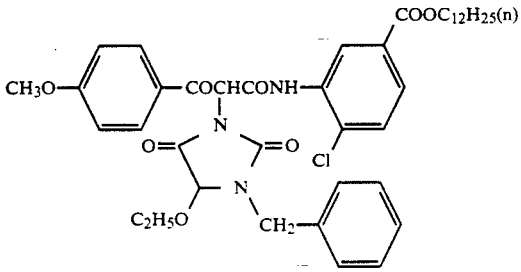
$CH_2{=}CH{-}SO_2{-}CH_2{-}CONH(CH_2)_2NHCO{-}CH_2{-}SO_2{-}CH{=}CH_2$ H-1
Sensitizing Dyes
I
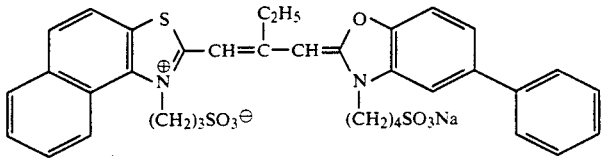
II
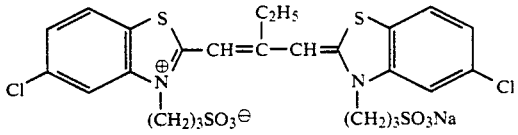
III
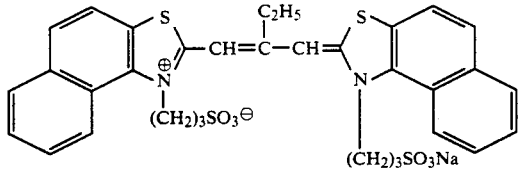
IV
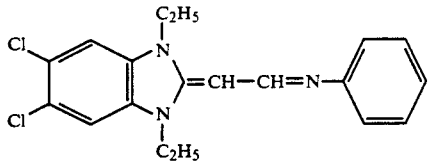
V
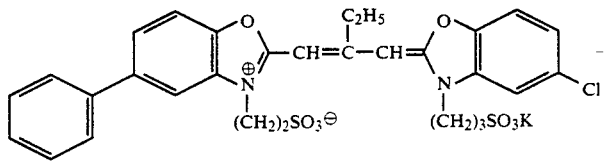

-continued

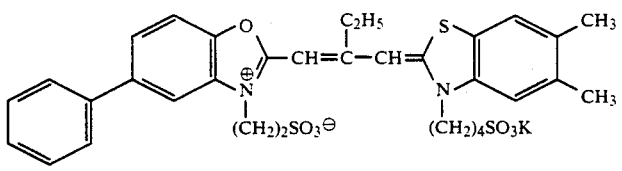

VI

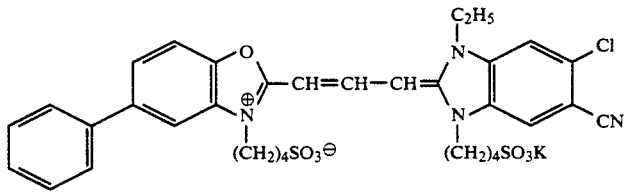

VII

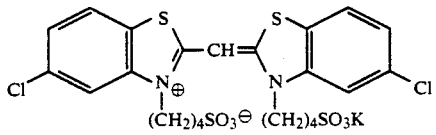

VIII

Specimen 202

Specimen 502 was prepared in the same manner as Specimen 501 except that Coupler C-4 coated in the 6th layer was replaced by Present Compound (32) in an amount of 0.008 g/m$^2$.

The specimens thus prepared were exposed to light for sensitometry, and then subjected to color development in the same manner as in Example 4. The specimens thus developed were measured through a green filter for densitometry to evaluate photographic properties. Another group of the specimens thus prepared were exposed to light through a filter having a stepwise density gradation, subjected to the same color development as described above, and then measured through a green filter for graininess. The graininess measurement was effected by a conventional RMS process. The measurement aperture had a diameter of 48 μm.

The results are set forth in Table 5.

TABLE 5

| Specimen | Relative sensitivity | Gamma | RMS value* |
|---|---|---|---|
| 501 | 100 | 0.71 | 0.013 |
| 502 | 100 | 0.71 | 0.010 |

*Value measured at a density of 1.0

Table 5 shows that Specimen 502 containing the present compound had the same sensitivity and gamma values as Specimen 501 containing a comparative DIR coupler, but had a longer graininess represented by RMS value than Specimen 501.

EXAMPLE 6

Preparation of light-sensitive silver halide:

A silver bromoiodide emulsion (iodine content: 2 mol %) with a mean grain diameter of 1.3 μm was prepared from silver nitrate, potassium bromide and potassium iodide by a commonly used ammonia process. The emulsion was then subjected to chemical sensitization by a gold/sulfur sensitization process with chloroauric acid and sodium thiosulfate. The emulsion was then subjected to cleaning by a sedimentation process. 4-Hydroxy-6-methyl-1,2,3a,7-tetrazaindene as a stabilizer was added to the emulsion to obtain a light-sensitive silver bromoiodide emulsion.

Preparation of Specimens 601 to 627:

Specimens 601 to 627 were prepared by sequentially coating an emulsion obtained by addition of Present Compound of formula [I] or Comparative Compounds (b) and (c) set forth in Table 6 to the light-sensitive silver halide emulsion thus prepared and an aqueous solution of gelatin as a protective layer on both sides of an undercoated polyester base.

The coated amount of these components was the same on both sides of the base. The sum of the coated amount of these components on both sides was 8.0 g/m$^2$. The coated amount of gelatin in the protective layer was 2.6 g/m$^2$. The coated amount of gelatin in the emulsion layer was 5.2 g/m$^2$.

These specimens were exposed by X-rays while being interposed between fluorescent-sensitized papers containing calcium tungstenate and closely contacted with an aluminum rectangular chart as an object such that the density was 1.0. These specimens were developed with the following developing solution at a temperature of 35° C. over 25 seconds, fixed, washed with water, and then dried. These specimens were then measured for CTF by a microphotometer. The results are set forth in Table 6.

| (Preparation of developing solution) | |
|---|---|
| Potassium hydroxide | 29.14 g |
| Glacial acetic acid | 10.96 g |
| Potassium sulfite | 44.20 g |
| Sodium bisulfite | 7.50 g |
| Boric acid | 1.00 g |
| Diethylene glycol | 28.96 g |
| Ethylenediamine tetraacetic acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone | 1.50 g |
| Glutaraldehyde | 4.93 g |
| Sodium metabisulite | 12.60 g |
| Water to make | 1 liter |

Table 6 shows that the photographic light-sensitive materials containing the present compounds exhibited a greater CTF value and an improved sharpness than the comparative specimens without the present compounds. The effects of the present compounds were greater than that of Comparative Compounds (b) and (c).

TABLE 6

| Specimen | Compound (I) Structure | Compound (I) Added Amount (mol/mol-Ag) | CTF 0.5 line/mm | CTF 1 line/mm | Remarks |
|---|---|---|---|---|---|
| 601 | — | — | 0.81 | 0.62 | Control |
| 602 | 1 | $5 \times 10^{-3}$ | 0.88 | 0.71 | Present Invention |
| 603 | " | $10 \times 10^{-3}$ | 0.90 | 0.77 | Present Invention |
| 604 | 2 | $5 \times 10^{-3}$ | 0.87 | 0.72 | Present Invention |
| 605 | " | $10 \times 10^{-3}$ | 0.89 | 0.78 | Present Invention |
| 606 | 4 | $5 \times 10^{-3}$ | 0.88 | 0.73 | Present Invention |
| 607 | " | $10 \times 10^{-3}$ | 0.89 | 0.75 | Present Invention |
| 608 | 6 | $5 \times 10^{-3}$ | 0.90 | 0.74 | Present Invention |
| 609 | " | $10 \times 10^{-3}$ | 0.91 | 0.78 | Present Invention |
| 610 | 27 | $5 \times 10^{-3}$ | 0.83 | 0.68 | Present Invention |
| 611 | " | $10 \times 10^{-3}$ | 0.87 | 0.73 | Present Invention |
| 612 | 30 | $5 \times 10^{-3}$ | 0.86 | 0.73 | Present Invention |
| 613 | " | $10 \times 10^{-3}$ | 0.88 | 0.79 | Present Invention |
| 614 | 31 | $5 \times 10^{-3}$ | 0.87 | 0.72 | Present Invention |
| 615 | " | $10 \times 10^{-3}$ | 0.88 | 0.76 | Present Invention |
| 616 | (b) | $5 \times 10^{-3}$ | 0.82 | 0.64 | Comparative |
| 617 | " | $10 \times 10^{-3}$ | 0.83 | 0.66 | " |
| 618 | (c) | $5 \times 10^{-3}$ | 0.84 | 0.67 | " |
| 619 | " | $10 \times 10^{-3}$ | 0.86 | 0.70 | " |

EXAMPLE 7

A light-sensitive sheet was prepared by sequentially coating the following compositions on a transparent polyester support.

(1) Layer containing 1.1 g/m$^2$ of a yellow dye-releasing redox compound of the following chemical structure, 1.6 g/m$^2$ of tricyclohexyl phosphate and 1.4 g/m$^2$ of gelatin.

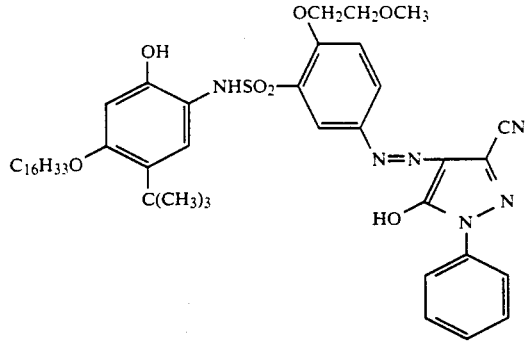

(2) Layer containing a blue-sensitive internal latent image type direct reversal silver bromide (gelatin content: 1.2 g/m$^2$) in an amount of 1.08 g/m$^2$ calculated as silver, a nucleating agent of the following chemical structure in an amount of 0.05 mg/m$^2$ and sodium pentadecylhydroquinonesulfonate in an amount of 0.18 g/m$^2$.

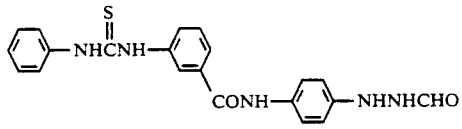

(3) Layer containing 1.0 g/m$^2$ of gelatin.

Thus, Specimen 701 was prepared. Specimen 702 was prepared in the same manner as Specimen 701 except that the redox compound incorporated in Layer (1) was replaced by Compound 24 of the following chemical structure in an amount of 1.1 g/m$^2$.

Compound 24

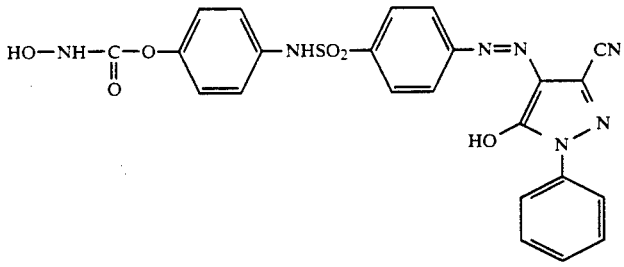

A light-sensitive sheet was prepared by sequentially coating the following compositions on a transparent polyester support.

(4) Layer containing a magenta dye-releasing redox compound of the following chemical structure in an amount of 0.93 g/m$^2$, tricyclohexyl phosphate in an amount of 1.33 g/m$^2$ and gelatin in an amount of 2.0 g/m$^2$.

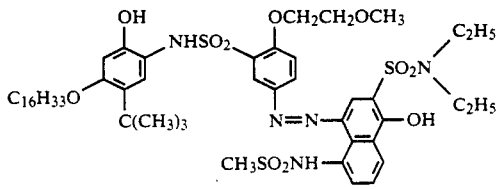

(5) Layer containing a green-sensitive internal latent image type direct reversal silver bromide emulsion (gelatin content: 1.23 g/m$^2$) in an amount of 1.11 g/m$^2$ calculated in terms of silver, the same nucleating agent as used in Layer (2) in an amount of 0.04 mg/m$^2$ and 2-sulfo-5-n-pentadecylhydroquinone sodium salt in an amount of 0.22 g/m$^2$.

(6) Layer containing 1.1 g/m$^2$ of gelatin.

Thus, Specimen 703 was prepared. Specimen 704 was prepared in the same manner as Specimen 703 except that the magenta redox compound incorporated in Layer (4) was replaced by Compound (34) of the following chemical structure in an amount of 0.03 g/m$^2$.

Compound 34

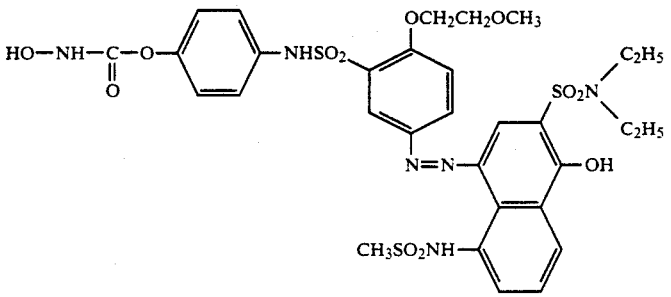

0.8 g of a processing solution of the following composition was packed in a rupturable vessel.

3) Composition of processing composition:

| | |
|---|---|
| 1-Tolyl-4-hydroxymethyl-4-methyl-3-pyrazolidone | 12.0 g |
| Methylhydroquinone | 0.4 g |
| 5-Methylbenzotriazole | 5.0 g |
| Sodium sulfite anhydride | 2.0 g |
| Hydroxyethyl cellulose | 40.0 g |
| Potassium hydroxide | 56.0 g |
| Benzyl alcohol | 1.5 ml |
| Water to make | 1 kg |

An image-receiving sheet was prepared by coating a mordant of the following chemical structure in an amount of 3.0 g/m$^2$ and gelatin in an amount of 3.0 g/m$^2$ on a transparent polyester support.

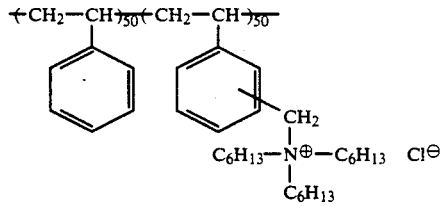

Specimens 701, 702, 703 and 704 were exposed to light. These specimens were laminated with the mordant sheet with the processing solution-containing vessel interposed therebetween. The laminations were then subjected to pressure by a pressing member at temperatures of 15° C. and 25° C. so that the processing solution was spread to a thickness of 80 μm between the sheets. After 5 minutes, the mordant sheet was peeled off the specimens to obtain transfer color images. The results are set forth in Table 7.

TABLE 7

| Specimen | Processing Temperature | Max. Transmittance Density (Dmax) | Min. Transmittance Density (Dmin) | Remarks |
|---|---|---|---|---|
| 701 | 15° C. | 1.64 | 0.05 | Comparative/ yellow density |
| 702 | 15 | 1.89 | 0.06 | Present Invention yellow density |
| 701 | 25 | 1.82 | 0.06 | Comparative/ yellow density |
| 702 | 25 | 2.02 | 0.08 | Present Invention yellow/density |
| 703 | 15 | 1.76 | 0.04 | Comparative/ yellow density |
| 704 | 15 | 1.97 | 0.07 | Present Invention yellow/density |
| 703 | 25 | 1.98 | 0.04 | Comparative/ yellow density |
| 704 | 25 | 2.07 | 0.08 | Present Invention yellow/density |

Table 7 shows that the present compounds released a dye with higher activity and efficiency and thus exhibited a higher maximum density and less change in density with different processing temperatures than comparison compounds.

EXAMPLE 8

Preparation of Specimen 801:

A multilayer color light-sensitive material was prepared by coating the following layer compositions on a cellulose triacetate film support.

1st Layer: Antihalation Layer (AHL)

Gelatin layer containing black colloidal silver

2nd Layer: Intermediate Layer

Gelatin layer containing an emulsion dispersion of 2,5-di-t-octylhydroquinone

3rd Layer: 1st Red-Sensitive Emulsion Layer ($RL_1$)

| | |
|---|---|
| Silver bromoiodide emulsion (silver iodide content: 5 mol %) | 1.79 g/m$^2$ in terms of amount of silver |
| Sensitizing dye I | $6 \times 10^{-5}$ mol per mol of silver |
| Sensitizing dye II | $1.5 \times 10^{-5}$ mol per mol of silver |
| Coupler A | 0.04 mol per mol of silver |
| Coupler C-1 | 0.0015 mol per mol of silver |
| Coupler C-2 | 0.0015 mol per mol of silver |
| Present compound (30) | 0.0006 mol per mol of silver |

4th Layer: 2nd Red-Sensitive Emulsion Layer ($RL_2$)

| | |
|---|---|
| Silver bromoiodide emulsion (silver iodide content: 4 mol %) | 1.4 g/m$^2$ in terms of amount of silver |
| Sensitizing dye I | $3 \times 10^{-5}$ mol per mol of silver |
| Sensitizing dye II | $1.2 \times 10^{-5}$ mol per mol of silver |
| Coupler A | 0.005 mol per mol of silver |
| Coupler C-1 | 0.0008 mol per mol of silver |
| Coupler C-2 | 0.0008 mol per mol of silver |
| Present compound (30) | 0.00006 mol per mol of silver |

5th Layer: Intermediate Layer (ML)

Same as the 2nd layer

6th Layer: 1st Green-Sensitive Emulsion Layer ($GL_1$)

| | |
|---|---|
| Silver bromoiodide emulsion (silver iodide content: 4 mol %) | 1.5 g/m$^2$ *in terms of amount* of silver |
| Sensitizing dye III | $3 \times 10^{-5}$ mol per mol of silver |
| Sensitizing dye IV | $1 \times 10^{-5}$ mol per mol of silver |
| Coupler B | 0.05 mol per mol of silver |
| Coupler M-1 | 0.008 mol per mol of silver |
| Present compound (30) | 0.0015 mol per mol of silver |

7th Layer: 2nd Green-Sensitive Emulsion Layer ($GL_2$)

| | |
|---|---|
| Silver bromoiodide emulsion (silver iodide content: 5 mol %) | 1.6 g/m$^2$ in terms of amount of silver |
| Sensitizing dye III | $2.5 \times 10^{-5}$ mol per mol of silver |
| Sensitizing dye IV | $0.8 \times 10^{-5}$ mol per mol of silver |
| Coupler B | 0.02 mol per mol of silver |
| Coupler M-1 | 0.003 mol per mol of silver |
| Present compound (30) | 0.0003 mol per mol of silver |

8th Layer: Yellow Filter Layer (YEL)

Gelatin layer containing yellow colloidal silver and an emulsion dispersion of 2,5-di-t-octylhydroquinone in an aqueous solution of gelatin 9th Layer: 1st Blue-Sensitive Emulsion Layer ($BL_1$)

| | |
|---|---|
| Silver bromoiodide emulsion (silver iodide content: 6 mol %) | 1.5 g/m$^2$ in terms of amount of silver |
| Coupler Y-1 | 0.25 mol per mol of silver |

10th Layer: 2nd Blue-Sensitive Emulsion Layer ($BL_2$)

| | |
|---|---|
| Silver bromoiodide (silver iodide content: 6 mol %) | 1.1 g/m$^2$ *per mol of silver* |
| Coupler Y-1 | 0.06 mol per mol of silver |

11th Layer: Protective Layer (PL)

Gelatin layer containing poly(methyl methacrylate) grains (grain diameter about 1.5 μm)

In addition to the above described compositions, a gelatin hardener and a surface active agent were incorporated in each of these layers.

Thus, Specimen 801 was prepared.

Specimen 802

Specimen 802 was prepared in the same manner as in Specimen 801 except that Compound (30) was replaced by Compound (35) in an equimolar amount.

Specimen 803:

Specimen 803 was prepared in the same manner as in Specimen 801 except that Compound (30) was replaced by Comparative Compound (b) in an equimolar amount.

Specimen 804:

Specimen 804 was prepared in the same manner as in Specimen 801 except that Compound (30) was replaced by Comparative Compound (g) in an equimolar amount.

The compounds used to prepare these specimens were as follows.

Sensitizing dye I

Anhydro-5,5'-dichloro-3,3'-di-(γ-sulfopropyl)-9-ethylthiacarbocyanine hydroxide pyridinium salt Sensitizing dye II Anhydro-9-ethyl-3,3'-di-(7-sulfopropyl)-4,5,4'. 5'-dibenzothiacarbocyanine hydroxide triethylamine salt Sensitizing dye III Anhydro-9-ethyl-5,5'-dichloro-3,3'-di-(γ-sulfopropyl) oxacarbocyanine sodium salt Sensitizing dye IV Anhydro-5,6,5',6'-tetrachloro-1,1'-diethyl-3,3'-di-{β-[β-(γ-sulfopropoxy)ethoxy]ethylimidazolo-carbocyanine hydroxide sodium salt Coupler A

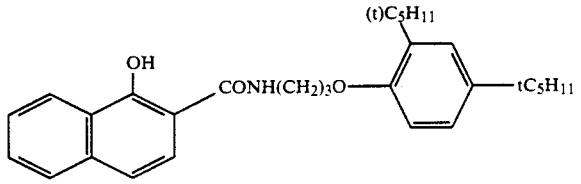

Coupler B

-continued
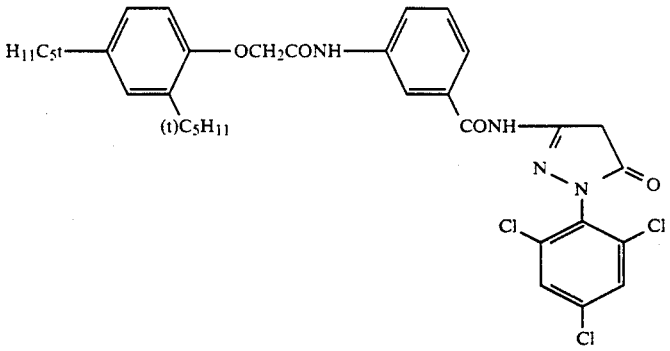
Coupler C-1
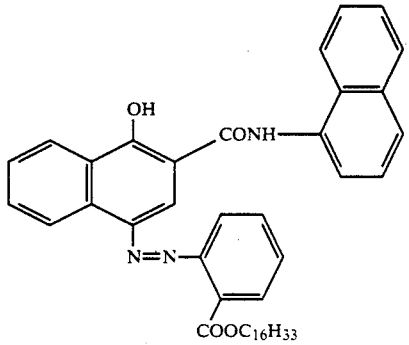
Coupler C-2
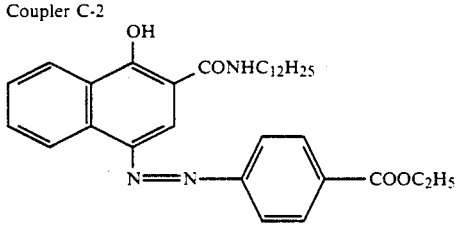
Coupler M-1
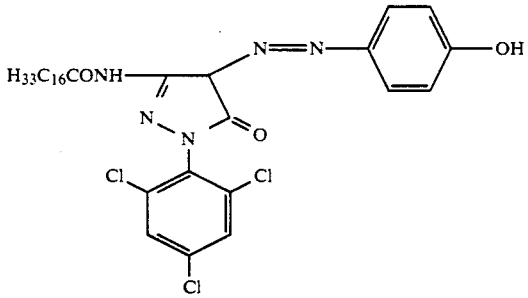
Coupler Y-1
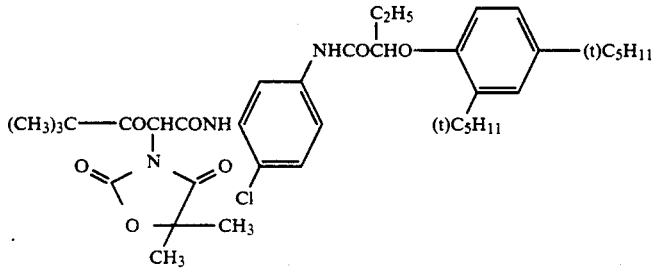
Specimens 801 to 804 thus prepared were then formed into films of 35 mm size. These film specimens were then exposed to light through an optical wedge. 600 m of each film specimen was then subjected to the following development in a 2-liter developing tank.

| | | |
|---|---|---|
| 1. Color Development | 3 min. | 15 sec. |
| 2. Bleach | 6 min. | 30 sec. |
| 3. Rinse | 3 min. | 15 sec. |
| 4. Stabilization | 6 min. | 30 sec. |
| 5. Rinse | 3 min. | 15 sec. |
| 6. Stabilization | 3 min. | 15 sec. |

The composition of the processing solutions used in these steps will be described below.

| | |
|---|---|
| Color Developing Solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 3-(N-ethyl-N-β-hydroxyethylamino)-2-methyl-aniline sulfate | 4.5 g |
| Water to make | 1 liter |
| Bleaching Solution | |
| Ammonium bromide | 160.0 g |
| Aqueous ammonia (28%) | 25.0 ml |
| Sodium iron ethylenediaminetetraacetate | 130 g |
| Glacial acetic acid | 14 ml |
| Water to make | 1 liter |
| Fixing Solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing Solution | |
| Formalin | 8.0 ml |
| Water to make | 1 liter |

The overflow of the developing solution was recycled in the following manner. The recycling of the overflow of the developing solution was effected batchwise. The overflow developing solution was first introduced into an electrodialysis tank where it was then subjected to electrodialysis so that KBr thereof reached 0.7 g/l or less.

In order to compensate for the loss of various components after running, sodium nitrilotriacetate, sodium sulfite, sodium carbonate, potassium bromide, hydroxylamine sulfate and 4-(N-ethyl-N-β-hydroxyethylamino) 2-methyl-aniline sulfate were added to the solution thus electrodialyzed in such amounts that the pH thereof was adjusted to 10.05. The solution thus adjusted was recycled as a replenisher. Table 8 shows the drop in the sensitivity after 10 times of reuse of the overflow solution (1 liter was used each time).

As shown in the results set forth in Table 8, Specimens 801 and 802 exhibited little or no drop in sensitivity while Specimens 803 and 804 exhibited a great drop in sensitivity. The eliminatable groups in Compounds (30) and (35) are dispersed in the color developing solution and then decomposed into photographically harmless compounds when they diffused into the color developing solution. Therefore, unlike other nondecomposition type eliminatable groups, these eliminatable groups were not accumulated in the developing solution, which was recyclable.

TABLE 8

| Specimen | Compound | ΔS (fog + 0.3)* B | G | R | Remarks |
|---|---|---|---|---|---|
| 801 | 30 | +0.03 | ±0 | ±0 | Present Invention |
| 802 | 35 | +0.02 | ±0 | ±0 | " |

TABLE 8-continued

| Specimen | Compound | ΔS (fog + 0.3)* B | G | R | Remarks |
|---|---|---|---|---|---|
| 803 | (b) | −0.21 | −0.13 | −0.06 | Comparative |
| 804 | (g) | −0.16 | −0.07 | +0 | " |

*Represented as log E of the sensitivity loss at (fog + density 0.3).

Comparative Compound (g)

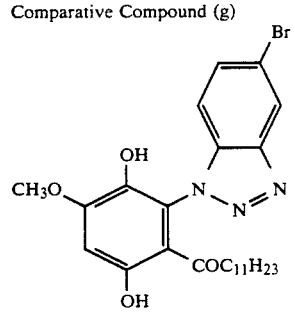

EXAMPLE 9

A silver halide emulsion containing 80 mol % of silver chloride, 19.5 mol % of silver bromide and 0.5 mol % of silver iodide was subjected to gold sensitization and sulfur sensitization in a conventional manner. This emulsion contained gelatin in an amount of 45 % by weight based on the amount of silver halide. 5-[3-(8-Sulfobutyl)-5-chloro-2-oxazolizilideneethylidene]-1-hydroxyethoxyethyl-3-(2-pyridyl)-2-thiohydantoin potassium salt (sensitizing dye), sodium dodecylbenzenesulfonate (surface active agent), and a polymer latex described in Preparation Example 3 in U.S. Pat. No. 3,525,620 were added to the emulsion. 1,2-Bis(vinylsulfonylacetamide)ethane (film hardener) was then added to the emulsion in an amount of 2.6% by weight based on the total amount of dried gelatin (i.e., including the dried gelatin content in a light-insensitive upper layer described later). Furthermore, the present compound set forth in Table 9 was added to the emulsion in the form of a methanol solution to prepare a coating solution for light-sensitive silver halide emulsion layer.

Separately, sodium dodecylbenzenesulfonate (surface active agent) and a polymethylmethacrylate latex having a mean grain size of 3.0 to 4.0 μm (matting agent) were added to a 5% gelatin solution to prepare a coating solution for a light-insensitive upper layer.

The coating solutioin for a light-sensitive silver halide emulsion layer and the coating solution for a light-insensitive upper layer were coated on a polyester terephthalate support in a two-coat simultaneous coating process. The coated amount of silver was 3.0 g/m$^2$, and the dried film thickness of the light-insensitive upper layer was 1.0 μm. Thus, Specimens 901 to 904 were prepared. These specimens were exposed to white tungsten light through a step wedge with a step pitch of 0.1 over 8 seconds.

Halftone images were then formed on another group of these specimens in the following manner. In particular, these specimens were exposed to white tungsten light through a step wedge with a step pitch of 0.1 with a commercially available negative gray contact screen (150 lines/inch) being in close contact therewith over 10 seconds. These specimens were then developed with the following developing solution at a temperature of 38° C. over 20 seconds, and subjected to fixing, rinse and drying in a conventional used manner.

| Composition of Developing Solution | |
|---|---|
| Sodium sulfite | 75 g |
| Sodium hydrogencarbonate | 7 g |
| Hydroquinone | 40 g |
| 1-Phenyl-4,4-dimethyl-3-pyrazolidone | 0.4 g |
| Sodium bromide | 3 g |
| 5-Methylbenzotriazole | 0.8 g |
| Disodium ethylenediaminetetraacetate | 1 g |
| 3-Diethylamino-1,2-propanediol | 20 g |
| Water to make | 1 liter |
| pH | 11.4 |

The results of the evaluation of relative sensitivity, c and halftone quality are set forth in Table 9.

The relative sensitivity is represented by reciprocal of the exposure giving a density of 1.5 relative to that of Specimen 1 as 100.

The halftone quality is visually evaluated in 4 steps. Step "A" is most excellent. Step "B" is of practicably useful quality. Step "C" is quality that falls short of the useful limit. Step "D" is the poorest quality.

TABLE 9

| Specimen No. | Invention Compound No. | Added Amount (per mol-Ag) | Relative Sensitivity | γ | Halftone Quality |
|---|---|---|---|---|---|
| 901 | None | — | 100 | 5 | D |
| 902 | 11 | $5.5 \times 10^{-4}$ mol | 240 | 16 | A |
| 903 | 13 | " | 235 | 15 | A |
| 904 | 36 | " | 180 | 13 | B |

As shown in Table 9, the present compounds provided extremely high sensitivity and hardening of the film, and an extremely excellent halftone quality.

EXAMPLE 10

A silver halide emulsion containing 80 mol % of silver chloride, 19.5 mol % of silver bromide and 0.5 mol % of silver iodide was subjected to gold sensitization and sulfur sensitization in a conventional used manner. This emulsion contained gelatin in an amount of 45% by weight based on the amount of silver halide. 3-Carboxymethyl-5- [2-(3-ethylthiazolinilidene)ethylidene]rhodanine (spectral sensitizer), 4-hydroxy-1,3,3a,7-tetraazaindene (stabilizer), polyoxyethylene nonylphenylether containing 50 ethylene oxide groups, and a polymer latex described in Preparation Example 3 in U.S. Pat. No. 3,525,620 were added to the emulsion. 1,2-Bis(vinylsulfonylacetamide)ethane (film hardener) was then added to the emulsion in an amount of 2.6% by weight based on the total amount of dried gelatin (i.e., including the dried gelatin content in a light-insensitive upper layer described later). Furthermore, the present compound set forth in Table 10 was added to the emulsion in the form of a methanol solution to prepare a coating solution for light-sensitive silver halide emulsion layer.

Separately, sodium dodecylbenzenesulfonate (surface active agent) and a polymethylmethacrylate latex having a mean grain size of 3.0 to 4.0 μm (matting agent) were added to a 5% gelatin solution to prepare a coating solution for a light-insensitive upper layer.

The coating solution for a light-sensitive silver halide emulsion layer and the coating solution for light-insensitive upper layer were coated on a polyester terephthalate support by a two-coat simultaneous coating process. The coated amount of silver was 3.0 g/m$^2$, and the dried film thickness of the light-insensitive upper layer was 1.0 μm. Thus, Specimens 1,001 to 1,008 were prepared.

Halftone images were then formed on these specimens in the following manner. In particular, these specimens were exposed to white tungsten light through a step wedge with a step pitch of 0.1 with a commercially available negative gray contact screen (150 lines/inch) being in close contact therewith over 10 seconds. These specimens were then developed with the following developing solution at a temperature of 27° C. for 100 seconds, and subjected to fixing, rinsing and drying in a conventional used manner.

| Composition of Developing Solution | |
|---|---|
| Sodium carbonate (monohydrate) | 50 g |
| Formaldehyde-hydrogen sulfite addition product | 45 g |
| Potassium bromide | 2 g |
| Hydroquinone | 18 g |
| Sodium sulfite | 2 g |
| 5-Nitroindazole | 3 mg |
| Water to make | 1 liter |

The composition of the comparative compounds set forth in Table 10 was as follows:

Comparative Compound a

1-Phenyl-5-mercaptotetrazole

Comparative Compound b

5-Methylbenzotriazole

Comparative Compound c

2-Methylthio-5-mercapto-1,3,4-thiadiazole

The results of the evaluation of halftone quality and halftone gradation are set forth in Table 10. The halftone quality is visually evaluated in 4 steps. Step "A" is most excellent. Step "B" is of practically useful quality. Step "C" is of a quality that falls short of the useful limit. Step "D" is the poorest quality. The halftone gradation is represented by the difference between the log exposure giving 5% and 95% of blacked area in halftone image. The greater this value, the softer is the halftone gradation.

TABLE 10

| Specimen No. | Compound of Formula [I] Structure | Added Amount | Halftone Quality | Halftone Gradation |
|---|---|---|---|---|
| 1001 | — | — | B | 1.13 |
| 1002 | 1 | $2.6 \times 10^{-4}$ mol/mol-Ag | A | 1.26 |
| 1003 | 20 | " | A | 1.23 |
| 1004 | 37 | " | A | 1.24 |

TABLE 10-continued

| Specimen No. | Compound of Formula [I] Structure | Added Amount | Halftone Quality | Halftone Gradation |
|---|---|---|---|---|
| 1005 | Comparative Compound (a) | $6.5 \times 10^{-5}$ mol/mol-Ag | C | 1.16 |
| 1006 | Comparative Compound (a) | $1.3 \times 10^{-4}$ mol/mol-Ag | D | 1.30 |
| 1007 | Comparative Compound (b) | $6.5 \times 10^{-5}$ mol/mol-Ag | C | 1.15 |
| 1008 | Comparative Compound (b) | $1.3 \times 10^{-4}$ mol/mol-Ag | D | 1.24 |
| 1009 | Comparative Compound (c) | $6.5 \times 10^{-5}$ mol/mol-Ag | C | 1.15 |
| 1010 | Comparative Compound (c) | $1.3 \times 10^{-4}$ mol/mol-Ag | D | 1.23 |

As shown in Table 10, the present compounds provided extremely soft halftone gradation without deteriorating the halftone quality. In particular, the use of Comparative Compounds (a), (b) and (c) provided a halftone gradation at least 0.1 softer than in the absence of these compounds, but provided a poor halftone quality represented by Step "D". The use of the present compounds provided a halftone gradation softer by 0.1 to 0.2 than in the absence of these compounds, and also provided excellent halftone quality represented by Step "A".

EXAMPLE 11

Specimens 1001, 1002 and 1003 as prepared in Example 10 were subjected to exposure and development in the same manner as in Example 10 except that the development was effected at a temperature of 27° C. over 90 seconds, 100 seconds and 110 seconds. The halftone quality was visually evaluated in 5 steps. The results are set forth in Table 11. Step "5" is most excellent. Step "1" is poorest. The practically useful level ranges from Step "3.5" to Step "5".

TABLE 11

| Specimen No. | Compound | % Halftone | Developing Time 9 sec. | 100 sec. | 110 sec. |
|---|---|---|---|---|---|
| 1001 | — | 5 | 3.5 | 4.0 | 4.5 |
| | | 95 | 4.5 | 4.0 | 3.5 |
| 1002 | 1 | 5 | 4.0 | 4.5 | 4.5 |
| | | 95 | 4.5 | 4.5 | 4.0 |
| 1003 | 20 | 5 | 4.0 | 4.5 | 4.5 |
| | | 95 | 4.5 | 4.5 | 4.0 |

As shown in Table 11, the present specimens exhibited a better halftone density quality both at 5% and 95% halftone than the comparative specimen without the present compound. The present specimens also exhibited an excellent halftone quality both at development times shorter and longer than the standard developing time (100 seconds), giving a wide development latitude.

EXAMPLE 12

Specimens 1001, 1002 and 1003 as prepared in Example 10 were exposed to white tungsten light in a plate-making camera with Original (A) having 50-82 m wide white lines on a black background and Original (B) having 50-μm wide black lines on a white background laminated therewith over 10 seconds. These specimens were then developed in the same manner as in Example 10. The results are set forth in Table 12.

TABLE 12

| Specimen No. | Compound | Width of Black lines developed with Original (A) | Width of black lines developed with Original (B) |
|---|---|---|---|
| 1001 | — | 75 μm | 30 μm |
| 1002 | 1 | 70 μm | 37 μm |
| 1003 | 20 | 65 μm | 38 μm |

As shown in Table 12, the present compounds provided an excellent width reproduction of fine lines. This provided a wide exposure latitude when an original on which Ming type characters and Gothic type characters are written is used in a practical plate making process.

EXAMPLE 13

2-Hydroxy-4,6-dichloro-1,3,5-triazine sodium salt as film hardener and polyoxyethylene nonylphenyl ether containing 30 ethylene oxide groups in an amount of $1 \times 10^{-4}$ mol/mol Ag were added to a silver halide emulsion containing 95 mol % of silver chloride, 5 mol % of silver bromide and $1 \times 10^{-4}$ mol/mol Ag of rhodium. The present compounds set forth in Table 10 were added to the emulsion in the form of a methanol solution in the manner shown in Table 10. The emulsions thus prepared were then coated on a polyethylene terephthalate film in an amount of 4.5 g/m$^2$ calculated in terms of silver. The film specimens thus prepared were exposed to light over an orginal having a configuration as set forth in FIG. 1 in U.S. Pat. No. 4,452,882 in a Dainippon Screen Mfg., Co., Ltd. Type P-607 printer. The film specimens thus exposed were developed with the following developing solution at a temperature of 38° C. for 20 seconds, and subjected to fixing, rinse and drying in a conventional manner.

| Composition of Developing Solution | |
|---|---|
| Potassium bromide | 2.0 g |
| Potassium hydroxide | 20.0 g |
| Potassium carbonate | 35.0 g |
| Potassium sulfite | 80.0 g |
| Hydroquinone | 20.0 g |
| Triethylene glycol | 30.0 g |
| Polyethylene glycol (molecular weight: 4,000) | 2.0 g |
| 5-Nitroindazole | 0.1 g |
| Water to make | 1 liter |
| pH | 11.7 |

The results are set forth in Table 13.

TABLE 13

| Specimen No. | Compound of Formula [I] Structure | Compound of Formula [I] Added Amount | Extract Letter Quality |
|---|---|---|---|
| 1301 | — | — | 2 |
| 1302 | 1 | $1.3 \times 10^{-4}$ mol/mol-Ag | 4 |
| 1303 | 20 | " | 5 |

Extract letter quality "5" is a fairly excellent extract letter quality wherein 30-μm wide letters can be reproduced when an exposure is effected such that 50% of halftone area on an original as described in FIG. 1 in U.S. Pat. No. 4,452,882 provides 50% of the halftone area on a reflecting light-sensitive material. On the other hand, extract letter quality "1" is poor letter quality wherein only letters of 150 μm width or more can be reproduced under the same conditions as set forth above. Extract letter qualities "4", "3" and "2" are between "5" and "1" in accordance with an visual evaluation. Extract letter qualities "2" or higher are suitable for practical use.

As shown in Table 13, the present compounds provided an excellent extract letter quality.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, at least one layer of the material comprising a compound represented by formula (I):

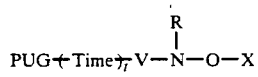

(I)

wherein X represents hydrogen or a group capable of providing hydrogen upon hydrolysis; Time represents a divalent linking group represented by one of formulae (T-1) to (T-10) below, wherein (*) indicates the bond to V in formula (I), and (*)(*) indicates the bond to PUG in formula (I); t is 0 or 1; PUG represents a photographically useful group; when t is 0, PUG represents one of the following photographically useful groups:

(1) a development inhibitor selected from a mercaptotetrazole, a mercaptotriazole, a mercaptoimidazole, a mercaptopyrimidine, a mercaptobenzimidazole, a mercaptobenzothiazole, a mercaptobenzoxazole, a mercaptothiadiazole, a benzotriazole, a benzimidazole, an indazole, and adenine, a guanine, a tetrazole, a tetraazaidene, a triazaindene and a mercaptoaryl, (2) a dye selected from arylidene dye, styryl dye, butadiene dye, oxonol dye, cyanine dye, merocyanine dye, hemicyanine dye, stilbene dye, chalkone dye, coumarin dye, azo dye, azomethine dye, azopyrazolone dye, indoaniline dye, indophenol dye, anthraquinone dye, triarylmethane dye, diarylmethane dye, alizarin dye, nitro dye, quinoline dye, indigo dye, and phthalocyanine dye, (3) a development accelerator represented by the formula (III):

$$[(*)(*)(*)-L_1(L_2)_kA\ (III)](*)(*)(*)-L_1(L_2)_kA$$

wherein the mark (*)(*)(*) indicates the position at which the PUG is bonded to V, wherein $L_1$ represents a group which can be eliminated during development; $L_2$ represents a divalent connecting group; the subscript k is 0 or 1; and A represents a group which substantially exhibits a fogging effect on a silver halide emulsion in a developing solution; and (4) a silver halide solvent selected from mesoionic compounds, and mercaptoazoles and azolethiones which contain an amino group; PUG-(-Time)$_t$ is a group released from an oxidation product of the redox mother nucleus of said compound represented by formula (I); V represents a carbonyl group, a sulfonyl group, a sulfoxy group, an iminomethylene group,

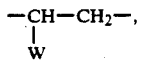

wherein W represents an electrophilic group, or V represents

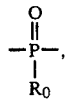

wherein $R_0$ represents an alkoxy group or an aryloxy group; and R represents hydrogen, an aliphatic group, an aromatic group or wherein PUG, t, and W are a defined above and TIME represents a divalent linking group represented by one of formulae (T-1) to (T-10) below, wherein (*) indicates the bond to V in formula (I), and (*)(*) indicates the bond to PUG in formula (I):

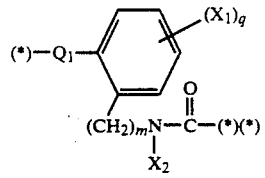

(T-1)

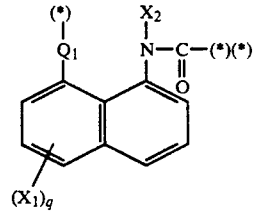

(T-2)

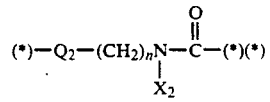

(T-3)

-continued (T-4)

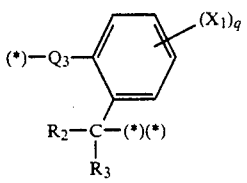

(T-5)

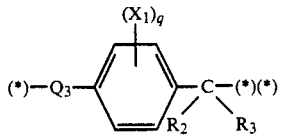

(T-6)

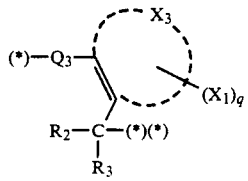

(T-7)

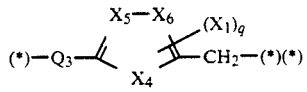

(T-8)

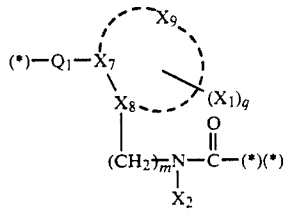

(T-9)

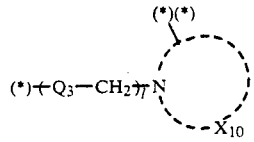

(T-10)

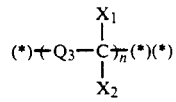

wherein $Q_1$ represents

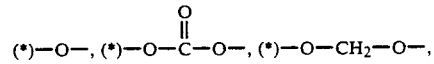

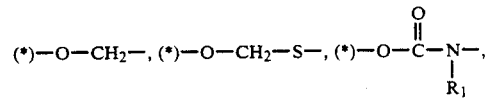

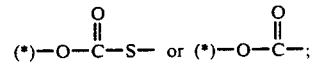

$R_1$ represents hydrogen, an aliphatic group, an aromatic group or a heterocyclic group;

$X_1$ represents hydrogen, an aliphatic group, an aromatic group, a heterocyclic group,

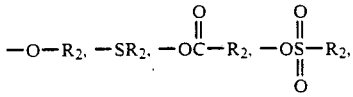

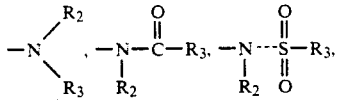

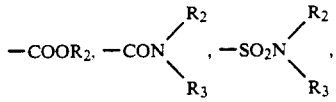

—CO—$R_2$, —SO—$R_2$, a cyano group, a halogen atom, or a nitro group;

$R_2$ and $R_3$ each represents hydrogen, an aliphatic group, an aromatic group or a heterocyclic group;

$X_2$ represents hydrogen, an aliphatic group, an aromatic group or a heterocyclic group;

q is an integer of 1 to 4, and, when q is 2 or more, the plurality of substituents represented by $X_1$ may be the same or different or may be connected to each other to form a ring;

m is 0, 1 or 2;

$Q_2$ represents

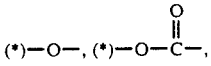

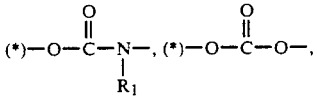

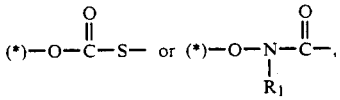

wherein $R_1$ is as defined above, and n is an integer of 1 to 4, $Q_3$ represents

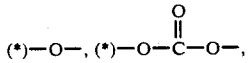

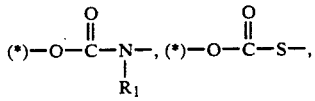

(*)—O—$CH_2$—O— or (*)—O—$CH_2$—S— wherein $R_1$ is as defined above;

$X_3$ represents an atomic group comprising carbon, nitrogen, oxygen or sulfur necessary for forming a 5-membered to 7-membered heterocyclic ring;

$X_4$ represents an atomic group comprising carbon, nitrogen, oxygen or sulfur necessary for forming a 5-membered to 7-membered heterocyclic ring;

$X_5$ and $X_6$ each represents

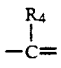

or —N=, wherein $R_4$ represents hydrogen, an aliphatic group or an aromatic group;

$X_7$ and $X_8$ each represents carbon or nitrogen;

$X_9$ represents an atomic group comprising carbon, nitrogen, oxygen or sulfur necessary for forming a 5-membered to 7-membered heterocyclic ring;

$X_{10}$ represents an atomic group comprising carbon, nitrogen, oxygen or sulfur necessary for forming a 5-membered to 7-membered heterocyclic ring; and l is 0 or 1.

2. The silver halide photographic material as claimed in claim 1, wherein said silver halide photographic material is an X-ray material having on one or both sides of said support said light-sensitive silver halide emulsion layer, said silver halide being silver bromoiodide or silver bromochloroiodide containing at most 15 mol% of silver iodide, said compound represented by formula (I) being present in an amount of form $1\times10^{-6}$ to $1\times10^{-1}$ mol per mol of said silver halide.

3. The silver halide photographic material as claimed in claim 1, wherein in formula (T-3) n is 1, 2 or 3; said heterocyclic ring formed by $X_3$ in formula (T-6) is selected from pyrrole, pyrazole, imidazole, triazole, furan, oxazole, thiophene, thiazole, pyridine, pyridazine, pyrimidine, pyrazine, azepine, oxepine, indole, benzofuran and quinoline; said heterocyclic group formed by $X_4$, $X_5$ and $X_6$ in formula (T-7) is selected from pyrrole, imidazole, triazole, furan, oxazole, oxadiazole, thiophene, thiazole, thiadiazole, pyridine, pyridazine, pyrimidine, pyrazine, azepine, oxepine, and isoquinoline; said heterocyclic group formed by $X_7$, $X_8$ and $X_9$ in formula (T-8) is selected from pyrrole, pyrazole, imidazole, triazole, furan, oxazole, thiophene, thiazole, pyridine, pyridazine, pyrimidine, pyrazine, azepine, oxepine, indole, benzofuran, quinoline, pyrrolidine, piperidine, and benzotriazole; said heterocyclic group formed by $X_{10}$ in formula (T-9) is selected from

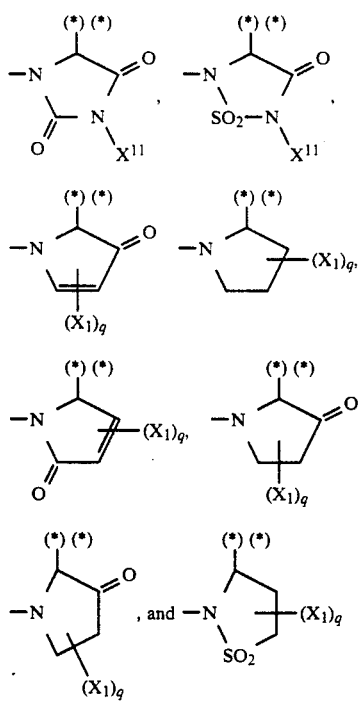

wherein $X_1$ and q each is defined as in formula (T-1); $X_{11}$ represents hydrogen, an aliphatic group, an aromatic group, an acyl group, a sulfonyl group, an alkoxycarbonyl group, a sulfamoyl group, a heterocyclic group or a carbamoyl group; and n in formula (T-10) is 1 or 2.

4. The silver halide photographic material as claimed in claim 1, wherein said silver halide photographic material is a color diffusion dye transfer material and said compound represented by formula (I) is a dye-donating compound.

5. The silver halide photographic material as claimed in claim 1, wherein said development inhibitor represented by PUG or $+\text{Time})_t$—PUG is represented by formula (II):

—AF—CCD (II)

wherein AF is represented by one of formulae (P-1) to (P-5), wherein (*)(*)(*) indicates the bond to Time;

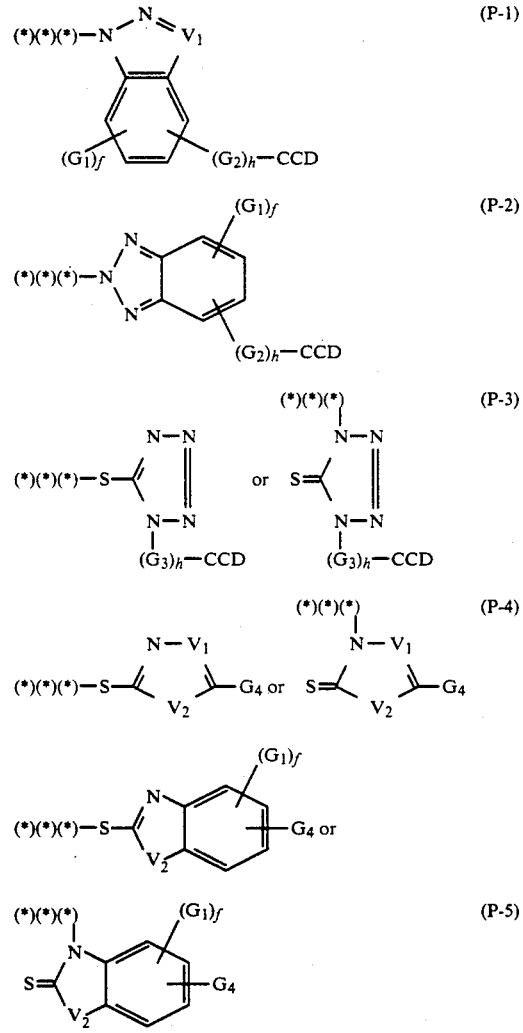

wherein $G_1$ represents hydrogen, a halogen atom, an alkyl group, an acylamino group, an alkoxy group, a sulfonamido group, an aryl group, an alkylthio group, an alkylamino group, an anilino group, an amino group, an alkoxycarbonyl group, an acyloxy group, a nitro group, a cyano group, a sulfonyl group, an aryloxy group, a hydroxyl group, a thioamido group, a carbamoyl group, a sulfamoyl group, a carboxyl group, a ureido group, or an aryloxycarbonyl group; $G_2$ represents a divalent group selected from an alkyl group, an acylamino group, an alkoxy group, a sulfonamido group, an aryl group, an alkylthio group, an alkylamino group, an anilino group, an amino group, an alkoxycarbonyl group, an acyloxy group, a nitro group, a sulfonyl group, an aryloxy group, a thioamido group, a carbamoyl group, a sulfamoyl group, a carboxyl group, a ureido group, or an aryloxycarbonyl group; $G_3$ represents a substituted or unsubstituted alkylene group or a substituted or unsubstituted arylene group; $V_1$ represents nitrogen or a methine group; $V_2$ represents oxygen, sulfur,

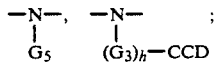

$G_4$ represents hydrogen, a halogen atom, an alkyl group, an acylamino group, an alkoxy group, a sulfonamido group, an aryl group, an alkylthio group, an alkylamino group, an anilino group, an amino group, an alkoxycarbonyl group, an acyloxy group, a nitro group, a cyano group, a sulfonyl group, an aryloxy group, a hydroxyl group, a thioamido group, a carbamoyl group, a sulfamoyl group, a carboxyl group, a ureido group, an aryloxycarbonyl group or $(G_3)_h$—CCD; $G_5$ represents hydrogen, an alkyl group or an aryl group; f is 1 or 2; and h is 0 or 1; provided that in formulae (P-4) and (P-5) at least one group represented by $V_2$ and $G_4$ is a group comprising a —CCD group; and CCD is represented by one of formulae (D-1) to (D-16):

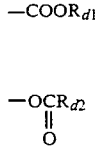

(D-1)

(D-2)

wherein $R_{d1}$ and $R_{d2}$ each represents a substituted or unsubstituted alkyl group, a substituted or unsubstituted aryl group or a substituted or unsubstituted aralkyl group;

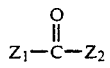

(D-3)

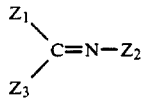

(D-4)

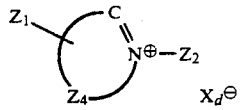

(D-5)

wherein $Z_1$ and $Z_2$ each represents a single bond to AF, hydrogen, an alkylamino group, an alkyl group, an aryl group, an unsubstituted or N-substituted acylamido group, or a 4-membered to 7-membered substituted or unsubstituted heterocyclic group; $Z_3$ represents hydrogen, a halogen atom, an alkyl group, an aryl group, a heterocyclic ring, an alkoxy group, an acyl group, an N-substituted or unsubstituted carbamoyl group, an N-substituted or unsubstituted sulfamoyl group, a sulfonyl group, an alkoxycarbonyl group, an acylamino group, a sulfonamido group, an alkylthio group, or an N-substituted or unsubstituted ureido group; $Z_4$ represents an atomic group necessary for forming a 5-membered or 6-membered unsaturated heterocyclic ring comprising carbon, hydrogen, nitrogen, oxygen or sulfur; $X_d$ represents an organic sulfonic acid anion; an organic carboxylic acid anion, a halogen ion or an inorganic anion;

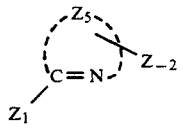

(D-6)

wherein $Z_1$, $Z_2$ and $Z_5$ each is as defined in formula (D-4); and $Z_5$ represents an atomic group necessary for forming a non-aromatic 5-membered to 7-membered ring comprising carbon, oxygen or nitrogen;

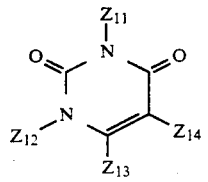

(D-7)

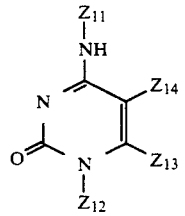

(D-8)

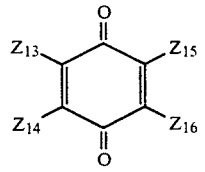

(D-9)

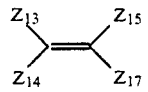

(D-10)

wherein at least one of $Z_{11}$ to $Z_{17}$ represents an AF group or a group comprising an AF group; $Z_{11}$ and $Z_{12}$ each represents hydrogen, an alkyl group, an aryl group or an AF group; $Z_{13}$, $Z_{14}$, $Z_{15}$ and $Z_{16}$ each represents hydrogen, an alkyl group; an aryl group, a halogen atom, an alkoxy group, an aryloxy group, an arylthio group, an alkoxycarbonyl group, an aryloxycarbonyl group, an alkanesulfonyl group, a sulfamoyl group, a carbamoyl group, a ureido group, an acyl group, an acylamino group, an arylsulfonyl group, a heterocyclic group, an acyloxy group, a nitro group, a cyano group, a carboxyl group, a thiocarbamoyl group, a sulfamoylamino group, a diacylamino group, an arylideneamino group or an AF group; and $Z_{17}$ represents a group comprising AF linked by a divalent group selected from an alkoxycarbonyl group, an aryloxycarbonyl group, an alkanesulfonyl group, a diacylamino group, an arylsulfonyl group, a heterocyclic group, a nitro group, a cyano group, a carboxyl group and a sulfonamido group;

(D-11)

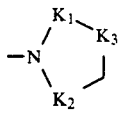

(D-12)

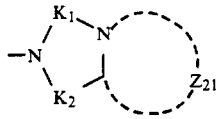

(D-13)

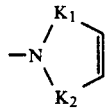

(D-14)

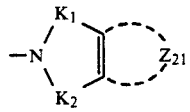

wherein $Z_{21}$ represents an atomic group necessary for forming a saturated or unsaturated 6-membered ring; $K_1$ and $K_2$ each represents an electrophilic group; and $K_3$ represents —N—$R_{d3}$, wherein $R_{d3}$ represents an alkyl group;

(D-15)

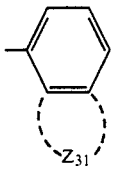

(D-16)

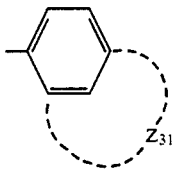

wherein in formulae (P-1) to (P-5), h is 0; and $Z_{31}$ represents an atomic group necessary for forming a 5-membered or 6-membered lactone ring or a 5-membered imide ring.

6. The silver halide photographic material as claimed in claim 5, wherein in formula (D-5) said heterocyclic group formed by $Z_4$ is selected from

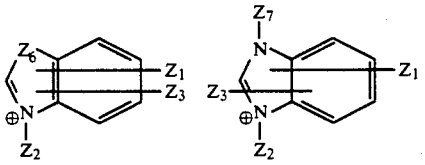

wherein $Z_1$, $Z_2$ and $Z_3$ are each as defined in formula (D-4), $Z_6$ represents oxygen or sulfur; and $Z_7$ represents a single bond to AF, hydrogen, an alkylamino group, an alkyl group, an aryl group, an N-substituted or unsubstituted acylamido group, or a 4-membered to 7-membered substituted or unsubstituted heterocyclic group; and $Z_5$ in formula (D-6) comprises at least one group selected from a substituted or unsubstituted alkylene group, and a substituted or unsubstituted alkenylene group.

7. The silver halide photographic material as claimed in claim 1, wherein PUG represents a diffusible or non-diffusible dye.

8. The silver halide photographic material as claimed in claim 1, wherein PUG represents a development accelerator represented by formula (III):

$$(*)(*)(*)\ L_1\text{-}(L_2)_k\text{-}A \qquad \text{(III)}$$

wherein (*)(*)(*) indicates the bond to Time, $L_1$ represents a group capable of being eliminated from Time upon development; $L_2$ represents a divalent linking group; k is 0 or 1; and A represents a group capable of fogging said silver halide emulsion in a developing solution.

9. The silver halide photographic material as claimed in claim 8, wherein $L_1$ represents an aryloxy group, a heterocyclic oxy group, an arylthio group, an alkylthio group, a heterocyclic thio group, or an azolyl group; $L_2$ represents an alkylene group, an alkenylene group, an arylene group, a divalent heterocyclic group, oxygen, sulfur, an imino group, —COO—, —CONH—, —NHCONH—, —NHCOO—, —$SO_2$NH—, —CO—, —$SO_2$—, —SO—, —NH$SO_2$NH—, or a combination thereof; and A represents a reducing group, a group capable of forming a developable silver sulfide nucleus on silver halide during development; or a quaternary salt.

10. The silver halide photographic material as claimed in claim 9, wherein A is represented by formula (IV):

$$(L_{00})_{l_4}\text{—}\underset{A_1}{N}\text{—}\underset{A_2}{N}\text{—}G\text{—}R_{00} \qquad \text{(IV)}$$

wherein at least one of $A_1$ and $A_2$ represents hydrogen, and the other represents hydrogen, a sulfinic acid group or $$(\underset{\underset{O}{\|}}{C})_n R^1_{00}$$

wherein $R_{00}^1$ represents an alkyl group, an alkenyl group, an aryl group, an alkoxy group or an aryloxy group, and n is 1 or 2; $R_{00}$ represents hydrogen, an alkyl group, an aryl group, an alkoxy group, an aryloxy group, an amino group, an alkoxycarbonyl group, an aryloxycarbonyl group, a carbamoyl group, an azo group or a heterocyclic group; G represents a carbonyl group, a sulfonyl group, a sulfoxy group, an iminomethylene group, or $$\text{—}\overset{\overset{O}{\|}}{\underset{\underset{R^2_{00}}{|}}{P}}\text{—}$$

wherein $R_{00}^2$ represents an alkoxy group or an aryloxy group; $L_{00}$ represents an arylene group or a divalent heterocyclic group; and $l_4$ is 0 or 1.

11. The silver halide photographic material as claimed in claim 1, wherein PUG represents a silver halide solvent.

12. The silver halide photographic material as claimed in claim 1, wherein in formula (I), V represents a carbonyl group.

13. The silver halide photographic material as claimed in claim 1, wherein R in formula (I) represents hydrogen, an alkyl group or an aryl group.

14. The silver halide photographic material as claimed in claim 13, wherein R represents hydrogen.

15. The silver halide photographic material as claimed in claim 1, wherein said compound represented by formula (I) is present in an amount of from $1\times10^{-7}$ to $1\times10^{-3}$ mol per mol of silver halide in said silver halide emulsion layer.

16. The silver halide photographic material as claimed in claim 1, wherein said compound represented by formula (I) is present in an amount of form $1\times10^{-7}$ to $1\times10^{-1}$ mol per mol of silver halide in said silver halide emulsion layer; and wherein PUG or $(Time)_t$ PUG represents a development inhibitor selected from a mercaptotetrazole, a mercaptotriazole, a mercaptoimidazole, a mercaptopyrimidine, a mercaptobenzimidazole, a mercaptobenzothiazole, a mercaptobenzoxazole, a mercaptothiadiazole, a benzotriazole, a benzimidazole, an indazole, an adenine, a quanine, a tetrazole, a tetraazaindene, a triazaindene and a mercaptoaryl.

17. The silver halide photographic material as claimed in claim 1, wherein PUG represents a development accelerator, and said compound represented by formula (I) is present in an amount of from $1\times10^{-7}$ to $1\times10^{-1}$ mol per mol of silver halide in said silver halide emulsion layer.

18. The silver halide photographic material as claimed in claim 1, wherein PUG represents a dye and said compound represented by formula (I) is present in an amount of from $1\times10^{-3}$ to 10 mol per mol of silver halide in said silver halide emulsion layer.

19. The silver halide photographic material as claimed in claim 1, wherein said silver halide photographic material is capable of forming a halftone image; said silver halide is silver bromochloride or silver bromochloroiodide containing at least 60% silver chloride and from 0 to 5% silver iodide; PUG represents a development inhibitor or a development accelerator, and said compound represented by formula (I) is present in an amount of from $1\times10^{-7}$ to $1\times10^{-1}$ mol per mol of said silver halide.

20. The silver halide photographic material as claimed in claim 19, wherein at least one layer of said silver halide photographic material further comprises a polyalkylene oxide having a molecular weight of 500 to 10,000 in an amount of from $5\times10^{-4}$ to 5 per mol of said silver halide.

21. The silver halide photographic material as claimed in claim 1, wherein said silver halide photographic material is capable of forming a high-contrast halftone image; PUG represents a development inhibitor; said compound represented by formula (I) is present in an amount of from $1\times10^{-5}$ to $8\times10^{-2}$ mol per mol of said silver halide; at least one layer of said silver halide photographic material further comprising a hydrazine derivative represented by formula (V):

$$Y_5-\underset{\underset{A_{51}}{|}}{N}-\underset{\underset{A_{52}}{|}}{N}-G_{50}-R_{50} \qquad (V)$$

wherein $Y_5$ represents an aliphatic group or an aromatic group; $R_{50}$ represents hydrogen, an alkyl group, an aryl group, an alkoxy group, an aryloxy group, an amino group, a hydrazino group, a carbamoyl group or an oxycarbonyl group; $G_{50}$ represents a carbonyl group, a sulfonyl group, a sulfoxy group, an iminomethylene group or $$-\overset{\overset{O}{\|}}{\underset{\underset{R_{50}}{|}}{P}}-,$$

wherein $R_{50}$ is as defined above; at least one of $A_{51}$ and $A_{52}$ represents hydrogen and the other represents hydrogen, a substituted or unsubstituted alkylsulfonyl group, a substituted or unsubstituted arylsulfonyl group or a substituted or unsubstituted acyl group.

22. The silver halide photographic material as claimed in claim 21, wherein said compound represented by formula (V) is present in said silver halide emulsion layer in an amount of from $1\times10^{-6}$ to $1\times10^{-1}$ mol per mol of said silver halide.

23. The silver halide photographic material as claimed in claim 1, wherein said silver halide photographic material is a color photographic material comprising at least one silver halide emulsion layer sensitive to red light comprising a cyan dye-forming coupler; at least one silver halide emulsion layer sensitive to green light comprising a magenta dye-forming coupler; and at least one silver halide emulsion layer sensitive to blue light comprising a yellow dye-forming coupler; said compound represented by formula (I) being present in each light-sensitive silver halide emulsion layer or a layer adjacent thereto in an amount of from 0.1 to 50 mol% based on the amount of said coupler in each said light-sensitive emulsion layer, and in an amount of from $1\times10^{-5}$ to $8\times10^{-2}$ mol per mol of silver halide in said silver halide emulsion layer containing said compound represented by formula (I) or adjacent to said layer containing said compound represented by formula (I).

* * * * *